US008830137B2

(12) United States Patent
Sengupta et al.

(10) Patent No.: US 8,830,137 B2
(45) Date of Patent: Sep. 9, 2014

(54) TRAVELLING WAVE DISTRIBUTED ACTIVE ANTENNA RADIATOR STRUCTURES, HIGH FREQUENCY POWER GENERATION AND QUASI-OPTICAL FILTERING

(75) Inventors: Kaushik Sengupta, Pasadena, CA (US); Seyed Ali Hajimiri, La Canada, CA (US)

(73) Assignee: California Institute of Technology, Pasadena, CA (US)

( * ) Notice: Subject to any disclaimer, the term of this patent is extended or adjusted under 35 U.S.C. 154(b) by 198 days.

(21) Appl. No.: 13/282,193

(22) Filed: Oct. 26, 2011

(65) Prior Publication Data

US 2012/0212383 A1 Aug. 23, 2012

Related U.S. Application Data

(60) Provisional application No. 61/406,628, filed on Oct. 26, 2010.

(51) Int. Cl.
*H01Q 7/00* (2006.01)

(52) U.S. Cl.
USPC ..... 343/866; 343/742

(58) Field of Classification Search
USPC ..... 343/742, 866, 870
See application file for complete search history.

(56) References Cited

U.S. PATENT DOCUMENTS 6,218,998 B1 * 4/2001 Van Voorhies ..... 343/741
6,600,451 B2 * 7/2003 Mimura et al. ..... 343/741
7,573,432 B1 8/2009 Eydelman et al.
7,952,061 B2 5/2011 Hillis et al.

(Continued)

FOREIGN PATENT DOCUMENTS

| | | | |
|---|---|---|---|
| JP | 2010-200207 | A | 9/2010 |
| KR | 10-0692420 | B1 | 3/2007 |
| WO | 2012/094051 | A3 | 7/2012 |
| WO | 2013/082622 | A2 | 6/2013 |

OTHER PUBLICATIONS

Written Opinion of the International Searching Authority for International Application No. PCT/US2011/057899 mailed on Aug. 3, 2012, 4 pages.

(Continued)

*Primary Examiner* — Tan Ho
(74) *Attorney, Agent, or Firm* — Kilpatrick Townsend & Stockton LLP

(57) ABSTRACT

An integrated distributed active radiator (DAR) device includes first and second conductors disposed adjacent to each other. The conductors define curves which close on themselves to within a distance of a gap. The first conductor first end is electrically coupled to the second conductor second end across the gap. The second conductor first end is electrically coupled to the first conductor second end across the gap. At least one active element is configured to produce a self-oscillation current at a frequency $f_0$. The self-oscillation current has a first direction in the first conductor and a second direction in the second conductor. The DAR device is configured to generate a harmonic current which has the same direction in both conductors. The DAR device is configured to efficiently radiate electromagnetic energy at a harmonic frequency and to substantially inhibit the radiation of electromagnetic energy at the frequency $f_0$.

23 Claims, 49 Drawing Sheets

(56) References Cited

U.S. PATENT DOCUMENTS

| | | | |
|---|---|---|---|
| 2002/0105470 | A1 | 8/2002 | Kim |
| 2004/0065831 | A1 | 4/2004 | Federici et al. |
| 2005/0179606 | A1 | 8/2005 | Holly |
| 2006/0076493 | A1 | 4/2006 | Bluzer |
| 2006/0111619 | A1 | 5/2006 | Castiglione et al. |
| 2007/0235658 | A1 | 10/2007 | Zimdars et al. |
| 2011/0315880 | A1 | 12/2011 | Nemirovsky |
| 2013/0082181 | A1 | 4/2013 | Corcos et al. |
| 2013/0082345 | A1 | 4/2013 | Corcos et al. |

OTHER PUBLICATIONS

International Search Report for International Application No. PCT/US2011/057899 mailed on Aug. 3, 2012, 3 pages.

International Preliminary Report on Patentability for International Application No. PCT/US2011/057899 mailed on Apr. 30, 2013, 5 pages.

International Search Report for International Patent Application No. PCT/US2012/067649 mailed on May 30, 2013, 2 pages.

* cited by examiner

Chip Performance Table

Transmitter Performance

| | |
|---|---|
| Frequency of operation | 276-285 GHz |
| Maximum broadside EIRP | +9dBm |
| Total radiated power (broadside) | 190μW |
| EIRP flatness | less than 1dB between 275-285 GHz |
| Beam-steering | 80° in each of the orthogonal axes in 2D space |
| Beam-steering resolution | continuous (limited by DAC resolution in practice) |
| Side lobes ratio | >10dB |
| Central tim-base VCO tuning range | 90.2-98.5 GHz |

Power consumption

| | |
|---|---|
| Central VCO and Buffers @1.1V | 30mA |
| Divide-by-two elements (total of 8) @1.1V | 8mA per element |
| Phase-rotators (total of 16)@1.1V | 22mA per element |
| Triplers (total of 16) @1.1V | 4mA per element |
| Distributed active radiators (total of 16) @0.8V | 20mA per element |

FIG. 22

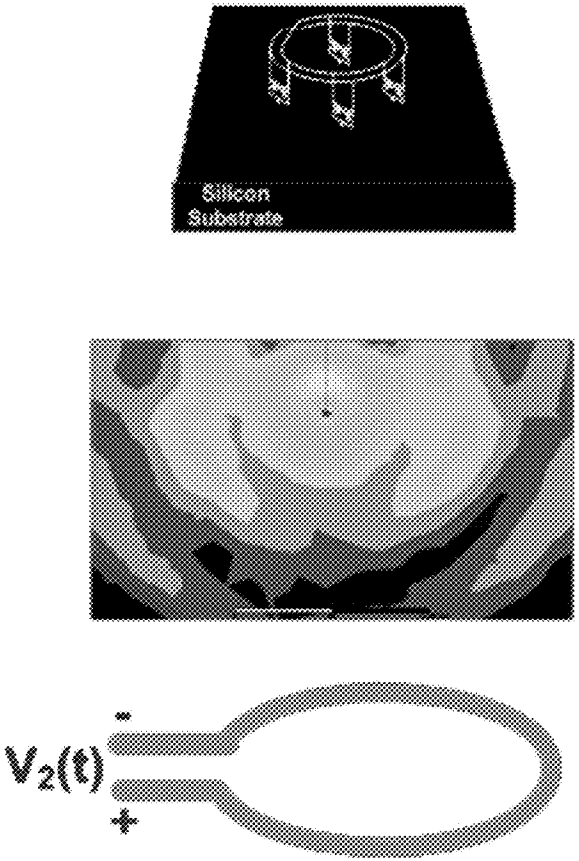
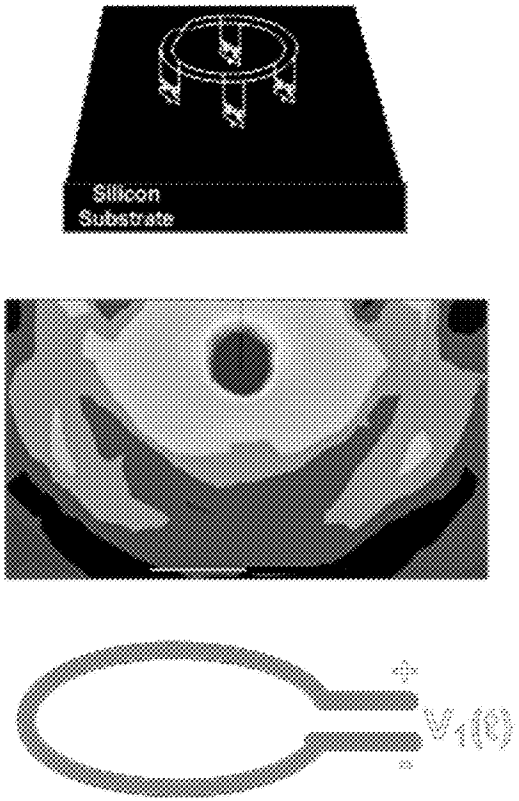
FIG. 34

TRAVELLING WAVE DISTRIBUTED ACTIVE ANTENNA RADIATOR STRUCTURES, HIGH FREQUENCY POWER GENERATION AND QUASI-OPTICAL FILTERING

CROSS-REFERENCE TO RELATED APPLICATIONS

This application claims priority to and the benefit of co-pending U.S. provisional patent application Ser. No. 61/406,628, Travelling Wave Distributed Active Antenna Structures, High Frequency Power Generation and Quasi-Optical Filtering, filed Oct. 26, 2010, which application is incorporated herein by reference in its entirety.

STATEMENT REGARDING FEDERALLY FUNDED RESEARCH OR DEVELOPMENT

This invention was made with government support under FA8650-09-C-7924 awarded by the Air Force. The government has certain rights in the invention.

FIELD OF THE INVENTION

The invention relates to transmitters.

BACKGROUND OF THE INVENTION

Despite the aggressive scaling of silicon-based IC's over the past few decades, transistor characteristics have yet to improve so that 'THz'-range (~300 GHz-to-3 THz) circuits can be effectively designed using conventional techniques. The few attempts at signal generation at these frequencies in CMOS have produced only very small power levels (e.g., tens of nano-watts). Until recently, the terahertz frequency range (0.3-3 THz) has been mostly addressed by high mobility custom III-V processes, bulky and expensive nonlinear optics, or cryogenically cooled quantum cascade lasers. There is a broad range of applications that could benefit from efficient power generation that would allow high power generation and efficient radiation in CMOS. A low cost room temperature alternative could enable a wide range of applications in security, defense, ultra-high speed wireless communication, sensors, and biomedical imaging not currently accessible due to cost and size limitations.

Two major challenges to a fully integrated 'THz' signal source with high enough power for practical applications in CMOS are, 1) effective signal generation above transistor cut-off frequencies, and 2) efficient electromagnetic radiation out of silicon. Traditional methods to generate high-frequency signals above the $f_{max}$ of devices, such as varactors, nonlinear transmission lines or push-push oscillators, and radiating through conventional tuned antennas all suffer from a lack of power scalability due to parasitic scaling, modeling inaccuracies leading to poor efficiency, and low power. Also radiation through traditional antennas (e.g., an integrated dipole in silicon) leads to leaky substrate modes that are often remedied with off-chip structures such as dielectric lenses.

There is a need for an efficient, low-cost, optionally tunable, high-power, stable sub-THz/THz integrated source that can operate at room-temperature.

SUMMARY OF THE INVENTION

According to one aspect, the invention features an integrated distributed active radiator (DAR) device which includes a substrate. A first conductor has a first conductor first end and a first conductor second end. A second conductor has a second conductor first end and a second conductor second end. A return path conductor defines an aperture. The first conductor and the second conductor are disposed adjacent each other and overlaying the aperture. The first conductor and the second conductor each define curves which close on themselves to within a distance of a gap. The first conductor first end is electrically coupled to the second conductor second end across the gap. The second conductor first end is electrically coupled to the first conductor second end across the gap. At least one terminal is configured to receive a source of DC power. At least one active element is electrically connected between the first conductor and the second conductor. The at least one active element is configured to produce a self-oscillation current at a frequency $f_0$. The self-oscillation current has a first direction in the first conductor and a second direction in the second conductor. The second direction is opposite to the first direction in the first conductor. The at least one active element is configured to generate a harmonic current having a harmonic frequency. The harmonic current has a same direction in the first conductor and in the second conductor and a second harmonic return current in the return path conductor. The integrated distributed active radiator device is configured to efficiently radiate electromagnetic energy from the aperture at the harmonic frequency and to substantially inhibit the radiation of electromagnetic energy at the frequency $f_0$.

In one embodiment, the harmonic frequency is an even harmonic of $f_0$.

In another embodiment, the harmonic frequency includes a frequency in the THz band.

In yet another embodiment, the DAR device further includes 2N additional loops before the first conductor first end is electrically coupled to the second conductor second end across the gap, and the second conductor first end electrically is coupled to the first conductor second end across the gap, where N is an integer ≥1.

In yet another embodiment, either of the at least one first conductor and at least one second conductor includes an inductor.

In yet another embodiment, the DAR is configured to radiate from a selected one of a front side and a rear side of the DAR.

In yet another embodiment, a return current path for a radiating signal at the harmonic frequency is provided by a conducting structure disposed adjacent to the DAR.

In yet another embodiment, a current of the return current path for a radiating signal at the harmonic frequency has a different phase with respect to a phase of the same direction current in both of the first and second conductors at the harmonic frequency, the phase difference between the same direction current and the return current is in the range −180 degrees<the phase difference<180 degrees.

In yet another embodiment, the first and second conductors comprise substantially concentric circles, one circle within the other.

In yet another embodiment, the first and second conductors comprise substantially concentric polygons, one polygon within the other.

In yet another embodiment, the at least one active element includes a gain element.

In yet another embodiment, the at least one active gain element includes a selected one of a single ended FET, a cross coupled FET pair, two complimentary FET pairs.

In yet another embodiment, the DAR device further includes a direct biasing.

In yet another embodiment, the DAR device further includes a transmission line biasing, wherein said transmission line biasing is configured to provide an open circuit under a phase locked condition at both $f_0$ and a desired even harmonic of $f_0$.

In yet another embodiment, the DAR device is fabricated in a CMOS technology.

In yet another embodiment, the DAR device further includes one or more additional DAR devices configured as a DAR array.

In yet another embodiment, the DAR array is configured for beam-forming.

In yet another embodiment, the DAR array further includes at least one varactor tuning element which is configured to adjust at least a selected one of beam shape and beam direction of the radiation of electromagnetic energy at the harmonic frequency.

In yet another embodiment, the DAR array includes one or more transmission lines electrically coupled between two or more DAR devices. The transmission line is configured to frequency lock each of the two or more DAR devices.

In yet another embodiment, the DAR device further includes a mutual coupling block which is electrically disposed between at least two of the DAR devices.

In yet another embodiment, the DAR array includes two or more DAR devices configured to frequency lock each of the DAR devices by mutual electromagnetic coupling.

In yet another embodiment, the at least two of the DAR devices further comprise a sense antenna.

In yet another embodiment, the two or more of the DAR devices are frequency locked to each other by a common frequency source derived from a common reference oscillator.

In yet another embodiment, the DAR device further includes an adjustable phase shift element disposed between the common frequency source and each of the DAR devices, the adjustable phase shift elements are configured for beam-forming.

According to another aspect, the invention features a DAR array which includes a central time base having a central time base frequency. A midpoint junction is electrically coupled to the time base. The midpoint junction has a first midpoint junction output port and a second midpoint junction output port and is configured to provide a differential quadrature I signal having a frequency half of the central time base frequency at the first midpoint junction output port and a differential quadrature Q signal having a frequency half of the central time base frequency at the second midpoint junction output port. A first phase shifter has a first phase shifter input port and a first phase shifter output port. The first phase shifter input port is electrically coupled to the first midpoint junction output port. A second phase shifter has a second phase shifter input port and a second phase shifter output port. The second phase shifter input port is electrically coupled to the second midpoint junction output port. A first injection locked frequency tripler has a first injection locked input port and a first injection locked amplifier output port. The first injection locked input port is electrically coupled to the first phase shifter output port. A second injection locked frequency tripler has a second injection locked frequency tripler input port and a second injection locked frequency tripler output port. The second injection locked frequency tripler input port is electrically coupled to the second phase shifter output port. At least one power terminal is configured to accept a source of power to power the DAR array. A first DAR device having a first DAR device $f_0$ input port, and a second DAR device having a second DAR device $f_0$ input port. The first DAR device $f_0$ input port is electrically coupled to the first injection locked frequency tripler output port and the second DAR device $f_0$ input port is electrically coupled to the second injection locked frequency tripler output port. The first and second DARs are configured to radiate an electromagnetic signal from the DAR array at an even harmonic of $f_0$.

In one embodiment, the midpoint junction has a third midpoint junction output port and a fourth midpoint junction output port and is configured to provide a differential quadrature I signal having a frequency half of the central time base frequency at the third midpoint junction output port and a differential quadrature Q signal having a frequency half of the central time base frequency at the fourth midpoint junction output port. A third phase shifter has a third phase shifter input port and a third phase shifter output port. The third phase shifter input port is electrically coupled to the third midpoint junction output port. A fourth phase shifter has a fourth phase shifter input port and a fourth phase shifter output port. The fourth phase shifter input port is electrically coupled to the fourth midpoint junction output port. A third injection locked frequency tripler has a third injection locked input port and a third injection locked amplifier output port. The third injection locked input port is electrically coupled to the third phase shifter output port. A fourth injection locked frequency tripler has a fourth injection locked frequency tripler input port and a fourth injection locked frequency tripler output port. The fourth injection locked frequency tripler input port is electrically coupled to the fourth phase shifter output port. A third DAR device has a third DAR device $f_0$ input port, and a fourth DAR device has a fourth DAR device $f_0$ input port. The third DAR device $f_0$ input port is electrically coupled to the third injection locked frequency tripler output port. The fourth DAR device $f_0$ input port is electrically coupled to the fourth injection locked frequency tripler output port. The third and fourth DARs are also configured to radiate an electromagnetic signal from the DAR array at an even harmonic of $f_0$.

In another embodiment, the DAR array further includes one or more additional DAR arrays as described hereinabove to form a N×M DAR array.

In yet another embodiment, the central time base includes a voltage controlled oscillator.

In yet another embodiment, the voltage controlled oscillator includes symmetric transmission lines with equal path lengths.

In yet another embodiment, the DAR array further includes a buffer amplifier disposed between at least one of the midpoint junction output ports and at least one of the midpoint junction input ports.

In yet another embodiment, the at least one of the phase shifters further includes a phase rotator configured to provide an adjustable phase shift.

In yet another embodiment, the phase rotator is configured to include a weighted sum of quadrature signals.

In yet another embodiment, the weighted sum of quadrature signals is performed by a current addition via two current commuting (Gilbert) cells.

In yet another embodiment, the phase rotator is configured to provide beam forming.

In yet another embodiment, the midpoint junction includes at least one transmission line which branches into a matched differential transmission line.

According to yet another aspect, the invention features a DAR array which includes at least one mutual coupling block having a mutual coupling block first port and a mutual coupling block second port. A first DAR device has a first DAR device input port and a second DAR device has a second DAR device input port. The first DAR device input port is electrically coupled to the mutual coupling block first port. The second DAR device input port is electrically coupled to the mutual coupling block second port. At least one power terminal is configured to accept a source of power to power the DAR array. Both of the first DAR device the second DAR device are frequency locked to each other by the at least one mutual coupling block and self-oscillate at a common frequency $f_0$ and radiate electromagnetic waves at an even harmonic of $f_0$.

In one embodiment, the at least one mutual coupling block includes a transmission line network.

In another embodiment, the transmission line network is configured to provide an open circuit under a phase locked condition at both $f_0$ and a desired even harmonic of $f_0$.

In yet another embodiment, the DAR array includes N additional DAR devices and N additional mutual coupling blocks.

In yet another embodiment, a plurality of mutual coupling blocks are configured to impose boundary conditions that ensure phase locking of corresponding points on a plurality of DAR devices of the DAR array.

In yet another embodiment, an EIRP increases by the square of the number of DAR devices of the Array.

According to yet another aspect, the invention features a DAR array which includes a first DAR device and a second DAR device. A first near-field sensing loop is disposed in the near field of the first DAR device. A second near-field sensing loop is disposed in the near field of the second DAR device. A coupling block electrically couples the first near-field sensing loop to the second near-field sensing loop. At least one power terminal is configured to accept a source of power to power the DAR array. Both of the first DAR device and the second DAR device are wirelessly frequency locked to each other by the a first near-field sensing loop and the second near-field sensing loop and both DAR devices self-oscillate at a common frequency $f_0$ and radiate electromagnetic waves at an even harmonic of $f_0$.

In one embodiment, the DAR array further includes N additional DAR devices, and N additional near-field sensing loops. Each of the N additional sensing loops is disposed in the near field of the each of the additional DAR devices. Each of the N additional coupling blocks is configured to add another one of the N additional DAR devices to the DAR array.

In another embodiment, each of the near-field sensing loops is configured to provide a voltage at a pair of sense antenna terminals which is proportional to the time derivative of the coupled magnetic flux from the near-field of one of the DAR devices.

In yet another embodiment, a lowest energy state of the DAR array system is achieved when each of the DAR devices sustains traveling waves in the same direction and each corresponding point of each DAR device has substantially the same phase at the same time.

In yet another embodiment, the DAR array further includes a plurality of transmission line networks. Each of the of transmission line networks is configured to bias a DAR device.

In yet another embodiment, the coupling block includes a resistor network.

In yet another embodiment, the resistor network is configured to maximize the power dissipated in the sense loops under an unlocked condition.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

In FIG. 14A $\phi=0°$. In FIG. 14B $\phi=90°$.

In FIG. 21A $\phi=0°$. In FIG. 21B $\phi=90°$.

FIG. 22 is a performance table for an exemplary THz transmitter.

FIG. 34 shows an illustration of two uncoupled DAR free running oscillators radiating at almost the same frequencies.

DETAILED DESCRIPTION

A distributed active radiator (DAR) structure according to the invention is a self-oscillatory device, which, when supplied with a source of DC power, oscillates at a fundamental frequency $f_0$ and radiates RF power at a harmonic $N\times f_0$ (typically $2f_0$). Each DAR device consolidates the functions of signal generation, frequency multiplication, filtering, and radiation into a single integrated device. Cancellation of radiation at the fundamental frequency and radiation of the harmonic frequency, typically a second harmonic, is accomplished quasi-optically with low loss. Arrays of DAR structures are also described hereinbelow. Such devices can achieve three orders of magnitude higher total radiated power than previously reported at terahertz frequencies (e.g., 300 GHz).

DAR Operation

Figure 1A:
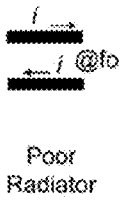
FIG. 1A shows an illustration of two opposite direction currents at a frequency $f_0$ flowing in two adjacent strips of conductive material, which produces a poor radiator.
Figure 1B:
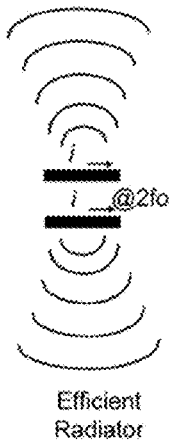
FIG. 1B shows an illustration of two same direction currents at a frequency $2\times f_0$ flowing in two adjacent strips of conductive material, which produces an efficient radiator.

Turning now to FIG. 1A, in each DAR device, two small electrical currents travel instantaneously in opposite directions in two adjacent current paths at a fundamental frequency $f_0$. The two currents are separated by a distance much less than the wavelength of interest and cancel each other's electromagnetic (EM) radiations in the far-field. At the same time, as shown in FIG. 1B, the currents in the same two adjacent paths, propagate in phase at a harmonic $N\times f_0$ and reinforce their radiated field. Therefore, quasi-optical filtration is achieved when the fundamental currents are constrained to travel in opposite directions (FIG. 1A) while the desired harmonic to be radiated from the DAR, typically a second harmonic, is in phase (FIG. 1B).

Figure 1C:
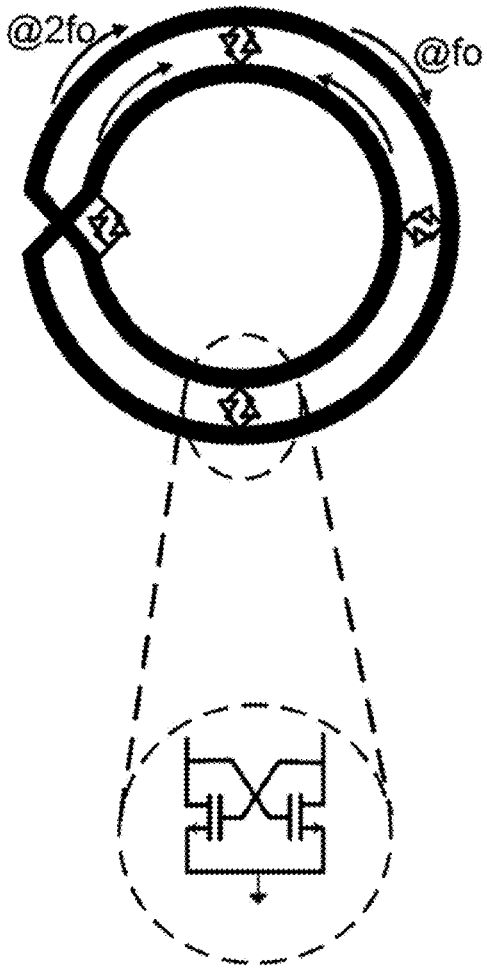
FIG. 1C shows a schematic diagram of one exemplary DAR structure according to the invention.

FIG. 1C shows one exemplary DAR structure, where a traveling wave at a frequency $f_0$ produces the conditions shown in FIG. 1A and FIG. 1B. The radiation and ohmic energy losses of such system can be compensated by introduction of active elements that simultaneously sustain a fundamental signal and generate harmonic content through their nonlinear trans-conductances and capacitances. This is a new kind of the traveling wave oscillator in which the transmission lines and the ground plane are placed in such a way to attenuate radiation at the fundamental radiation and to enhance radiation at the desired harmonic frequency (e.g., the second harmonic).

Figure 1D:
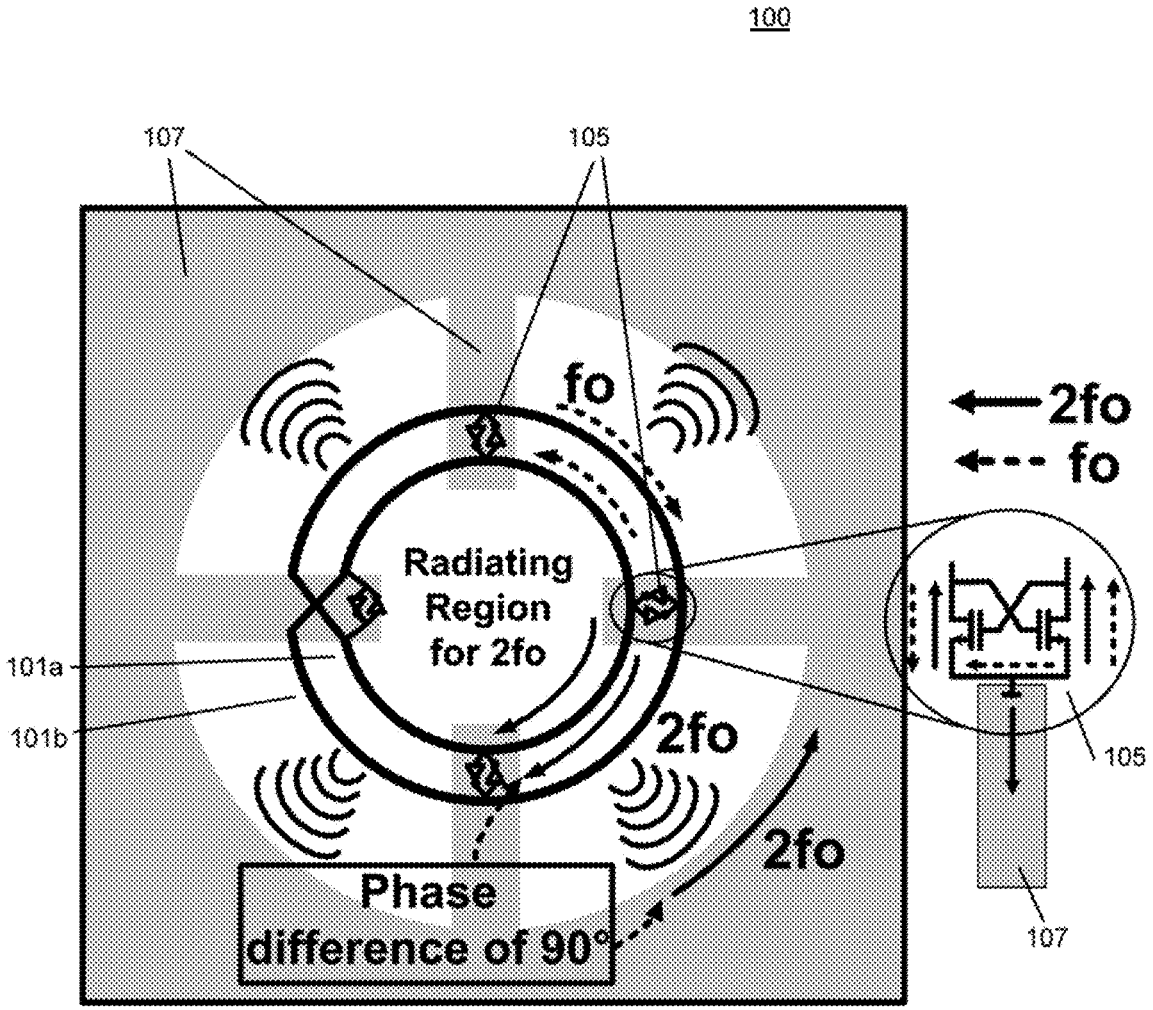
FIG. 1D shows a schematic diagram of one exemplary distributed active radiator (DAR) according to the invention.

FIG. 1D shows a schematic diagram of one exemplary distributed active radiator (DAR) device 100 according to the invention. Device 100 is formed in or on a substrate (not shown in FIG. 1D). A first conductor 101*a* has a first conductor first end, and a first conductor second end. The first conductor 101*a* is disposed adjacent to a second conductor 101*b*. Similar to the first conductor 101*a*, the second conductor 101*b* has a second conductor first end, and a second conductor second end. The first and second conductors each define nearly closed curves which close on themselves to within a distance of a gap. Conductor 101*a* and conductor 101*b* are cross connected to each other across the gap distance, creating one continuous electrically conductive closed curve. In more detail, to form a complete closed curve in the exemplary embodiment of FIG. 1D which includes both conductors, the first conductor 101*a* first end is electrically coupled to the second conductor 101*b* second end across the gap, and the second conductor 101*b* second end is electrically coupled to the first conductor 101*a* first end across the gap. The complete closed curve is "Möbius like" in that tracing the closed path includes a full traversal of both conductors. Unlike Möbius strips, however there is typically no Möbius twist at the cross connection point across the gap distance. Each DAR device includes at least one active element 105 disposed between the first conductor and the second conductor. In the exemplary embodiment of FIG. 1D, there are four active elements 105 disposed between first conductor 101*a* and the second conductor 101*b* shown at the 90 degree locations of the closed curve, here substantially a circular curve including the "cross-over" connections 103 across the gap distance. There is also at least one terminal (not show for simplicity in FIG. 1D) which is configured to receive a source of DC power. The DC power is used to bias the at least one active element so that it can reinforce a self-oscillation of different direction currents at a frequency $f_0$ in both the first conductor 101*a* and the second conductor 101*b*. Also, in the exemplary of FIG. 1D, the currents at $f_0$ and the higher order harmonic currents (here $2f_0$), are shown as out of phase by 90°. While shown in FIG. 1D as 90°, any suitable phase other than 180° can be used in a DAR device as the phase difference between the currents at $f_0$ and the harmonic currents.

As described hereinabove, a DAR device typically includes two loops (including both of the first and second conductors) in the form of the Möbius like structure. However there can be additional turns before the connections 103 across the gap distance. For example, a single DAR device can further include n additional loops before the first conductor first end is electrically coupled to the second conductor second end across the gap, and the second conductor first end electrically is coupled to the first conductor second end across the gap, where $n \geq 1$. Such multi-loop DAR structures can be configured to provide radiation at higher harmonics of $f_0$ than $2f_0$.

The conductors of a DAR can be made from any suitable conductive material. Exemplary materials include any suitable integrated metallization. Carbon nanotubes and carbon fiber structures are also believed to be suitable materials for use as DAR conductors. DAR conductors can also include one or more inductors or inductive elements.

Figure 1E:
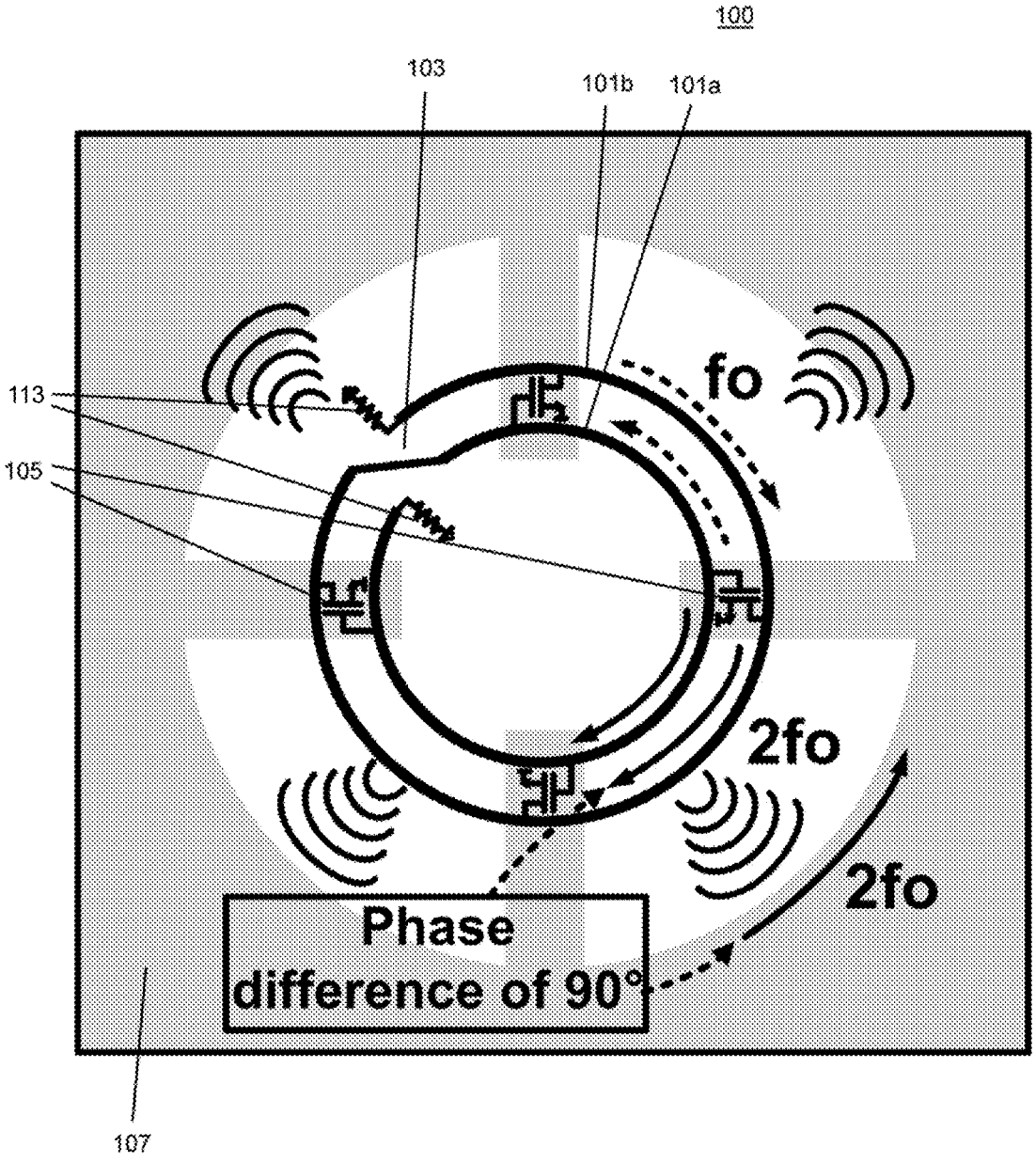
FIG. 1E shows a schematic diagram of an exemplary DAR where each active element includes one single ended FET.

The at least one active element 105 can be made using any suitable technology, such as for example, CMOS, bipolar, type III-V devices, carbon nanotube devices or transistors, or any other device which has gain. The at least one active element 105 can be made from any suitable gain element in any suitable gain element circuit topology. For example, in some embodiments, active element 105 can be a single gain element. For example, FIG. 1E shows a schematic diagram of one exemplary DAR where each active element 105 includes one FET in a single ended FET circuit topology. In the exemplary embodiment of FIG. 1E, one end of each of the conductors is effectively electrically coupled together via two resistances or impedances. This is the same as tying them together, since both resistors or impedances are tied to a common point. Also, in the exemplary view of FIG. 1E, the currents at $f_0$ and the harmonic currents (here $2f_0$), are shown as out of phase by 90°. While shown in FIG. 1E as 90°, any suitable phase other than 180° can be used in a DAR device as the phase difference between the currents at $f_0$ and the harmonic currents.

Figure 1F:
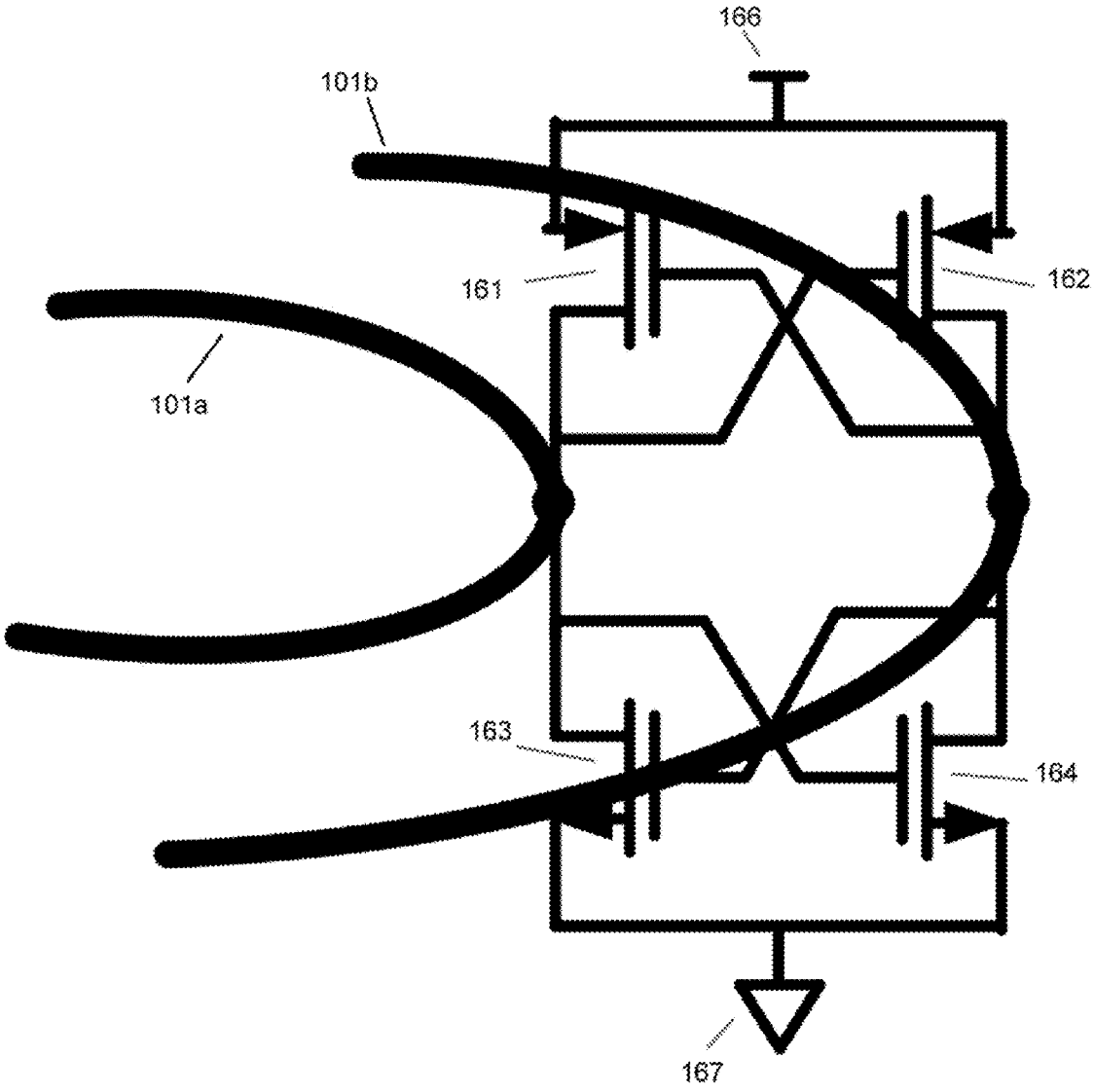
FIG. 1F shows two complementary cross-coupled pairs of FETs that can be used for the active elements shown in FIG. 1D.

In yet another exemplary embodiment, as shown in FIG. 1F, two complimentary cross coupled pairs of FETs can be used for each one or the one or more active elements 105. Each of the two P channel FETs (161, 162) have their source terminals electrically coupled to a power supply terminal 166. Similarly, each of the pair of N channel FETs (163, 164) have their source terminal connected to a common terminal 167. The drain terminals of the left side of both of the FET pairs is electrically coupled to conductor 101*a*, the drain terminals of the right side of both of the FET pairs is electrically coupled to conductor 101*b*.

In other embodiments, a DAR device 100 can include one or more cross coupled active element pairs. In Alternative embodiments, any suitable type oscillator, such as, for example, a differential oscillator can also be used in place of a gain element 105. The one or more active elements 105 of a DAR can be biased using any suitable bias method, such as for example, a cascode bias method. Exemplary bias methods are described in more detail hereinbelow.

A DAR device 100 is configured such that when DC power is applied to the at least one terminal, the DAR device 100 simultaneously performs the functions of signal generation, frequency multiplication, quasi-optical filtering and providing a desired harmonic radiation. While attenuating radiation of electromagnetic energy at frequency $f_0$, a DAR device 100 efficiently radiates electromagnetic energy (due to the same direction current in both of the first and second conductors at a frequency) at a frequency $N \times f_0$ (typically $2f_0$), which is the desired harmonic frequency radiation. The return current in the ground plane 105 at the radiated harmonic frequency is out of phase (typically by about 90°) with the currents in the first conductor 101*a* and the second conductor 101*b* at the harmonic frequency (e.g., $2 \times f_0$). This phase difference of the currents between the currents in conductors 101*a* and 101*b*, and the return current in the ground plane 105 at the radiated harmonic frequency, combined with the traveling wave nature of a DAR device, contributes to the high radiation efficiency of each DAR device 100. A DAR device can be configured to radiate predominantly from either the "top side" or the "bottom side" of an integrated structure or monolithic chip. However, harmonic radiation does not radiate to the "side", and therefore it does not undesirably couple into the substrate. Thus, by contrast with conventional integrated antennas (e.g., integrated dipole antennas), a DAR device does not radiate significant electromagnetic energy into the substrate.

Active devices 105 can be realized as cross-coupled NMOS pairs (regenerative elements). For example, the schematic diagram of FIG. 1D shows suitable cross-coupled NMOS pairs configured as regenerative elements. These regenerative elements can force the fundamental currents in the adjacent branches of the loop to be in opposite directions and either source or sink second harmonic currents in the same direction. The return path of the second harmonic currents goes through the source of the cross-coupled pair. Therefore, in order for the second harmonic to radiate, its return path is "separated", removing the ground from underneath the loop and providing a local ground path for the second harmonic current to propagate. This separation causes the same loop to operate as a coplanar stripline for the first harmonic while simultaneously operating as a distributed radiating structure for the second harmonic. Therefore, each DAR device simultaneously performs the functions of generation, frequency multiplication, radiation and filtering in a single device. The drains of all of the transistors "see" the same second harmonic radiative impedance. Such a distributed arrangement overcomes the disadvantages and limitations of a traditional narrowband antenna impedance match, such as is encountered for larger device sizes.

In one exemplary embodiment according to FIG. 1D, a loop was realized on a 2.1 μm thick aluminum layer, where the inner loop diameter was 70 μm and the ground plane diameter was 140 μm. Four cross-coupled pairs were laid out equidistant along the loop circumference. The fundamental frequency of oscillation was designed for 150 GHz, to provide a second harmonic radiation at 300 GHz.

Radiating electromagnetic DAR structures such as the structure of FIG. 1D are particularly suitable for integrated implementation. In one exemplary embodiment, the traveling wave provided a circular polarization with a simulated radiation efficiency of 35% at 300 GHz over a 300 μm thick silicon substrate with 10 Ω-cm resistivity. The radiating traveling wave of a DAR device generates circularly polarized radiation at a radiation efficiency (typically >50%), far higher than that of a comparable integrated dipole supported by a silicon lens (typically <10%). The high dielectric constant of the silicon substrate leads to radiation primarily from the backside.

DAR Arrays

Integrated DAR arrays can be made from two or more DAR devices. A distributed implementation of integrated arrays can be used for power combining. For example, an array of DARs can be mutually locked for a lossless quasi-optical power combination. A phase control can be implemented in each DAR device for beam forming. DAR arrays can be designed to partially cancel substrate modes by separating the elements by half a wavelength of the dominant radiating $TE_1$ mode. Exemplary simulations have shown that the radiation efficiency of 2×1 and 2×2 arrays can be 45% and 53% at 300 GHz, respectively.

Figures 2A, 2B:
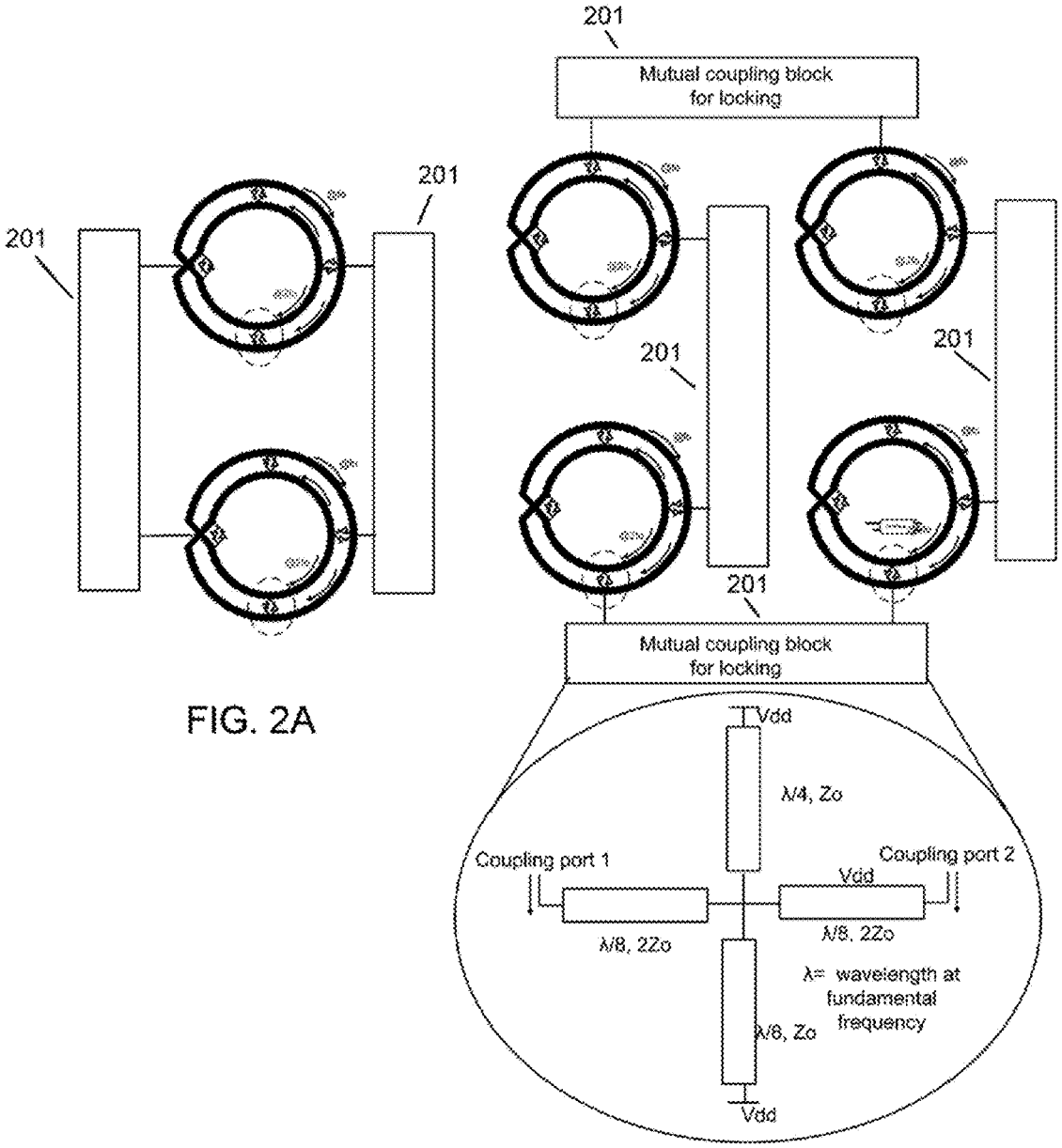
FIG. 2A shows a schematic diagram of an exemplary transmission line network for locking two DARs.
FIG. 2B shows a schematic diagram of an exemplary transmission line network for locking four DARs.

FIG. 2A shows a schematic diagram which illustrates one exemplary embodiment of a mutual locking mechanism of two DAR devices using a transmission line network. FIG. 2B shows a schematic diagram which illustrates one exemplary embodiment of a mutual locking mechanism of four DAR devices using a transmission line network. The network also provides bias for the structure. An exemplary mutual coupling block suitable for use as a transmission line network is shown in more detail in the lower portion of FIG. 2B. The transmission line network provides an open circuit under phase locked condition at both the fundamental frequency (e.g., 150 GHz) and at the second harmonic frequency (e.g., 300 GHz) so as not to load the structure. The multiple coupling networks at various points on the circumference impose boundary conditions which ensure phase locking of corresponding points on all the radiators. The array enables a coherent combination of the desired second harmonic (e.g., 300 GHz) signal in air and raises the EIRP by the square of the number of radiators.

Figure 2C:
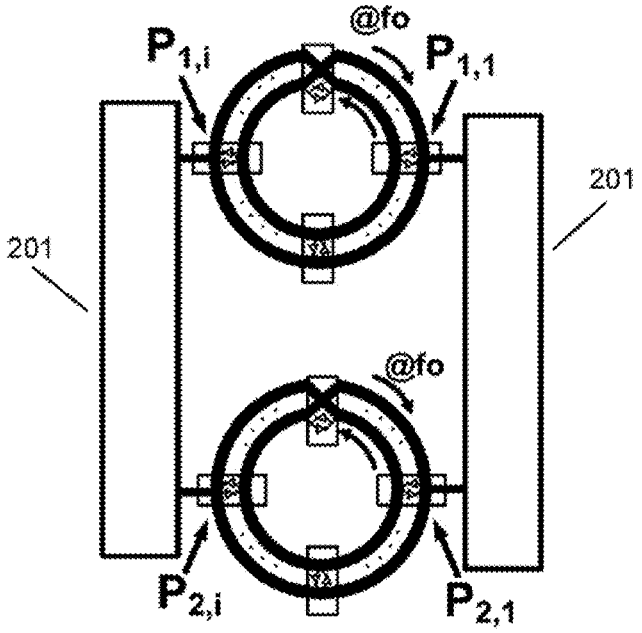
FIG. 2C shows a schematic diagram of an exemplary 2×1 DAR array using mutual coupling blocks.
Figure 2D:
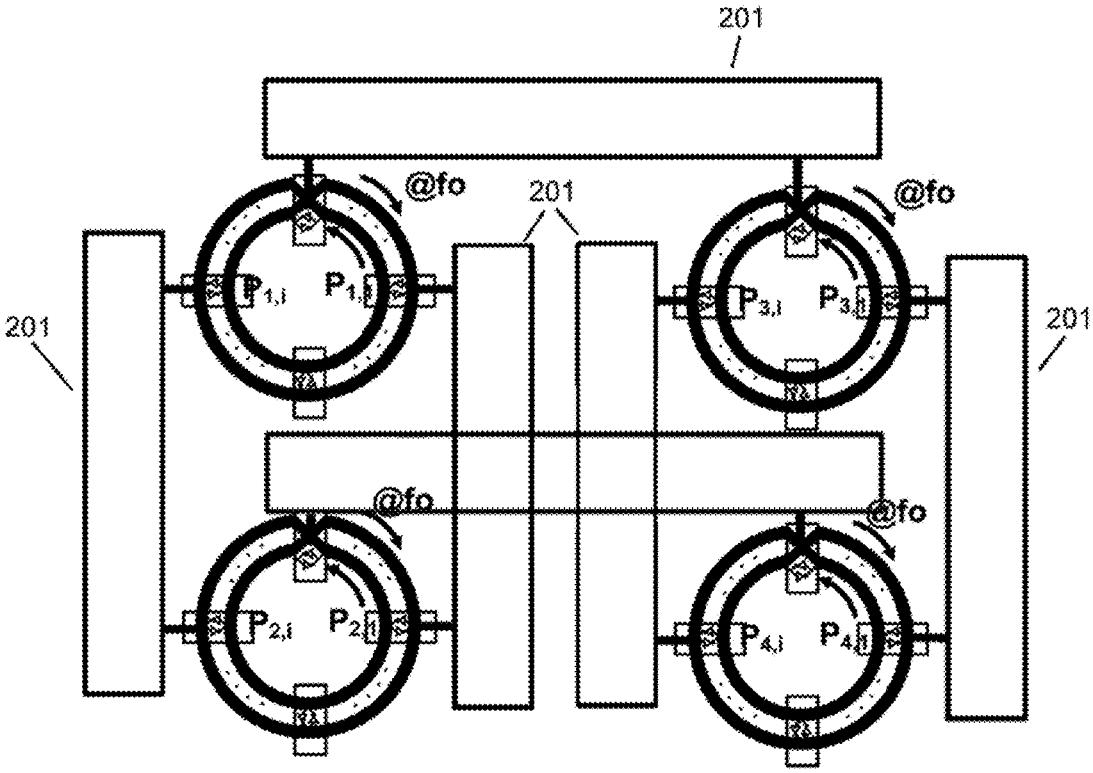
FIG. 2D shows a schematic diagram of an exemplary 2×2 DAR array using two of the DAR arrays of FIG. 2C.
Figure 2E:
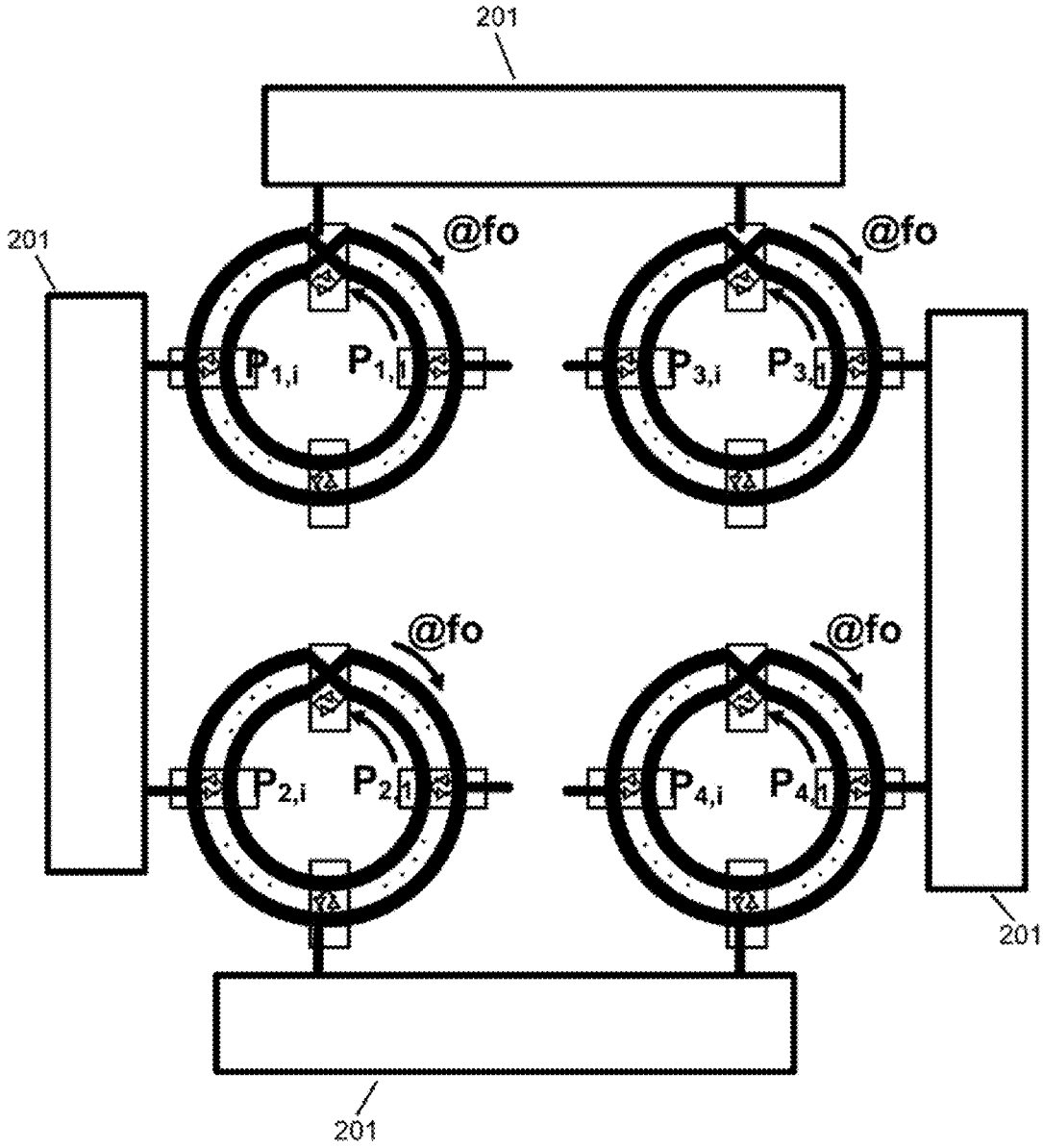
FIG. 2E shows one embodiment of a 2×2 DAR array that uses four mutual coupling blocks 201.
Figure 2F:
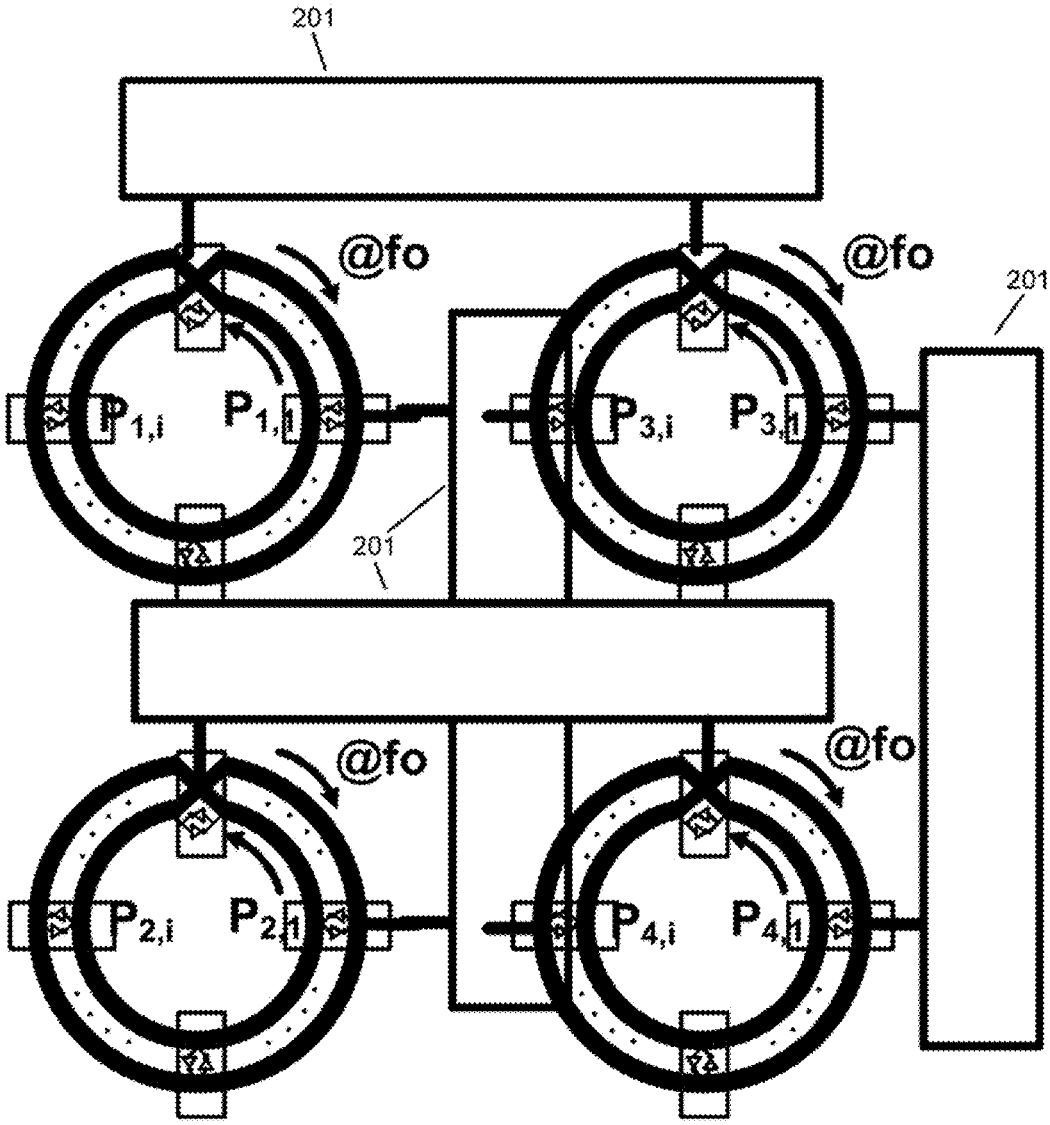
FIG. 2F shows another embodiment of a 2×2 DAR array that uses four mutual coupling blocks 201.

Mutual coupling blocks can be used to lock two respective, same position active elements in each DAR of a DAR array to each other. By locking two corresponding (same positioned) active elements, both the instantaneous phase at each active element and the direction of the traveling wave (currents flowing in the same direction in both DARs) can be made to be the same in each of the locked DARs. FIG. 2C shows a schematic diagram of an exemplary 2×1 DAR array using mutual coupling blocks 201. The corresponding active elements $P_{1,i}$ and $P_{2,i}$ are locked by the mutual coupling block 201 on the left side of the drawing and the corresponding active elements $P_{1,1}$ and $P_{2,1}$ are locked by the mutual coupling block on the right side of the drawing. FIG. 2D shows a schematic diagram of an exemplary 2×2 DAR array using two of the DAR arrays of FIG. 2C and two additional mutual coupling blocks 201 (the two additional horizontal mutual coupling blocks 201 in the FIG. 2D). However, as shown by the schematic diagrams of FIG. 2E and FIG. 2F there are more efficient ways to achieve a 2×2 DAR array using less than the six mutual coupling blocks 201 of FIG. 2D. For example, FIG. 2E shows one embodiment of a 2×2 DAR array that uses only four mutual coupling blocks 201. FIG. 2F shows another embodiment of a 2×2 DAR array that uses only four mutual coupling blocks 201. A suitable number of mutual coupling blocks for an N×M DAR array is generally that number of mutual coupling blocks which ensure that same position transistors in each DAR have the same instantaneous phase and the direction of the traveling waves is the same in each of the DARs of the DAR array.

Figure 3:
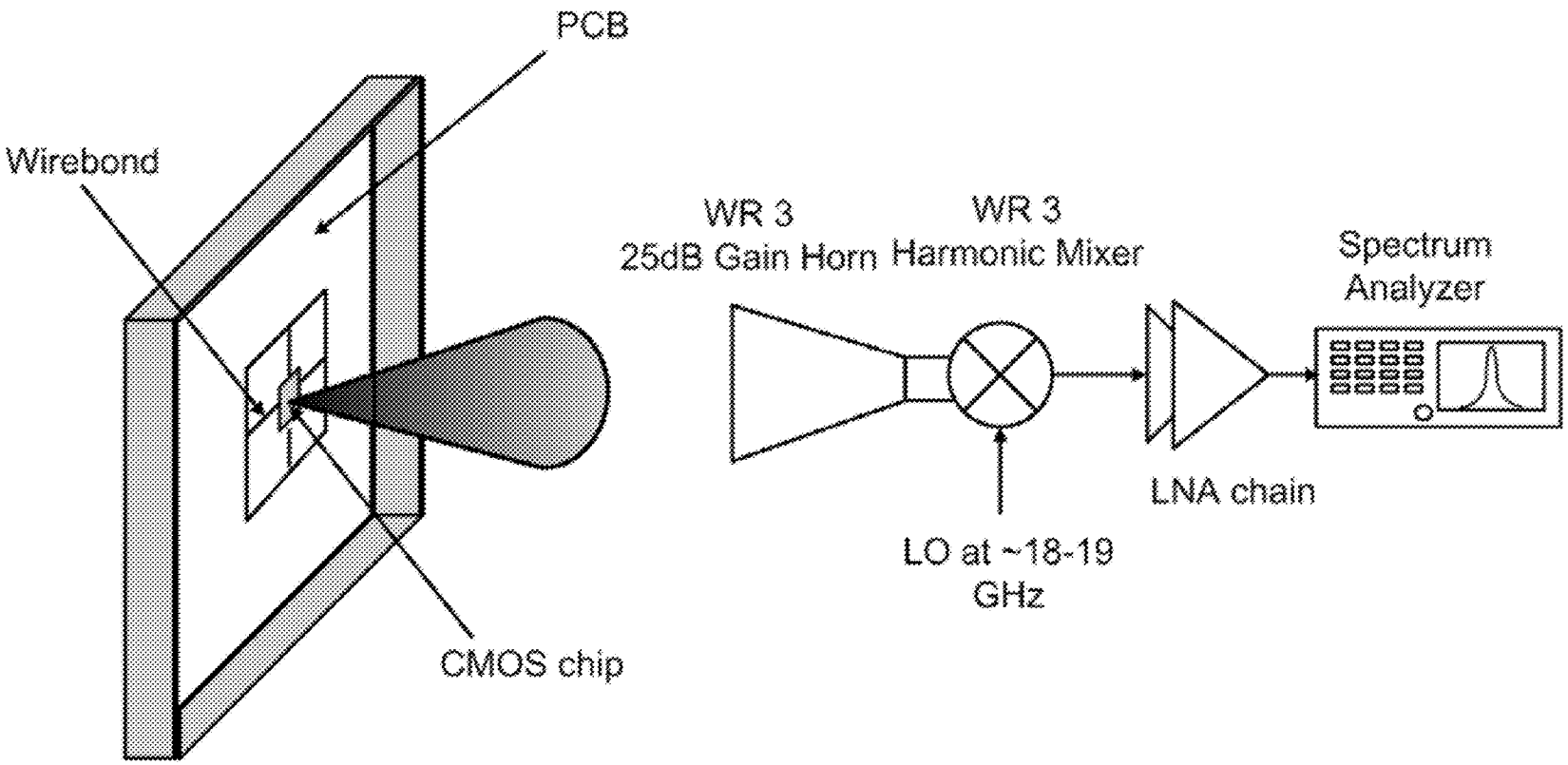
FIG. 3 shows a block diagram of one exemplary measurement setup.
Figure 4A:
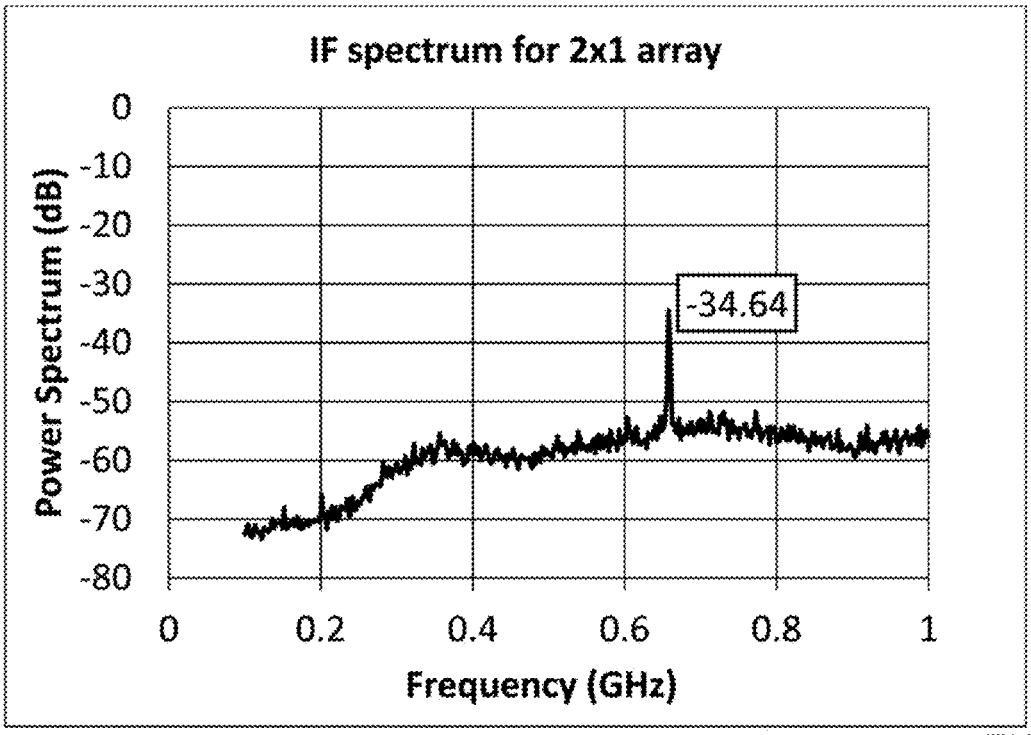
FIG. 4A shows a graph of the measured IF spectrum for an exemplary 2×1 array of DARs on an integrated chip.
Figure 4B:
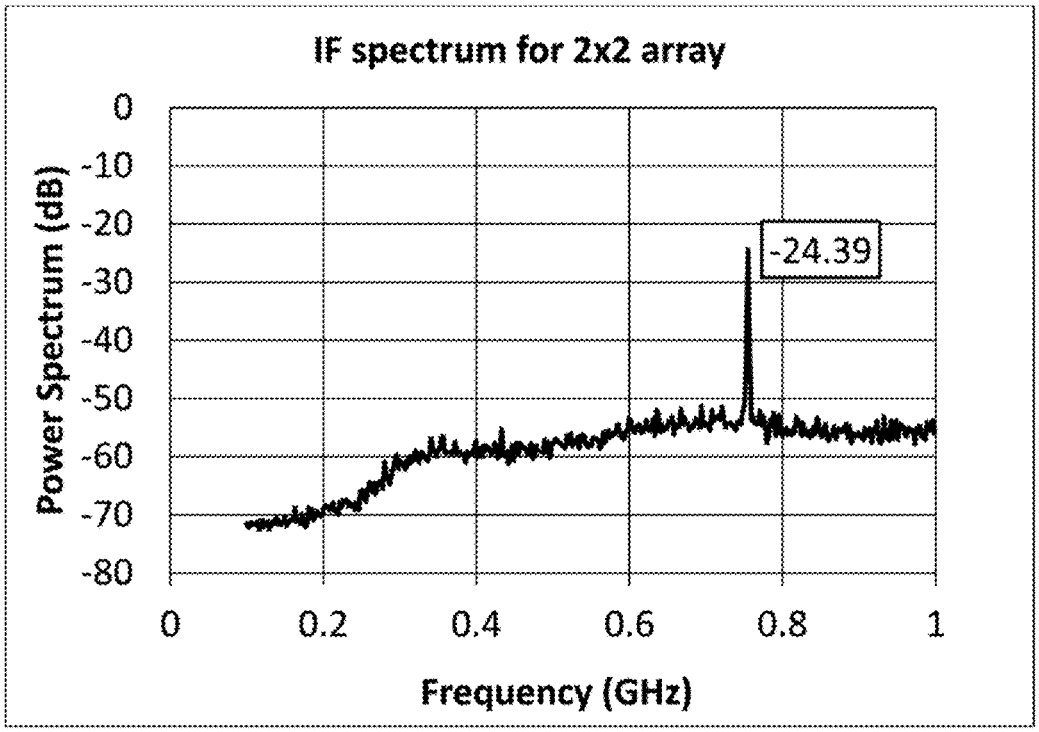
FIG. 4B shows a graph of the measured IF spectrum for an exemplary 2×2 array of DARs on an integrated chip.

FIG. 3 shows a block diagram of one exemplary measurement set up. In this exemplary embodiment, the radiation from the "backside" of a DAR CMOS chip was captured by a horn antenna and then down-converted by a harmonic mixer and the resulting IF signal was amplified by low noise amplifiers and analyzed using a spectrum analyzer. The setup was calibrated using a calibrated source from 290-300 GHz with a calorimeter-based power meter giving absolute power measurements from 75-2000 GHz. Radiated output from the 2×1 array was detected at 298 GHz and the absolute power radiated from the backside was measured to be 12.6 μW. FIG. 4A shows a graph of the measured IF spectrum for an exemplary 2×1 array of DARs on an integrated chip. FIG. 4B shows a graph of the measured IF spectrum for an exemplary 2×2 array of DARs on an integrated chip.

Figure 5A:
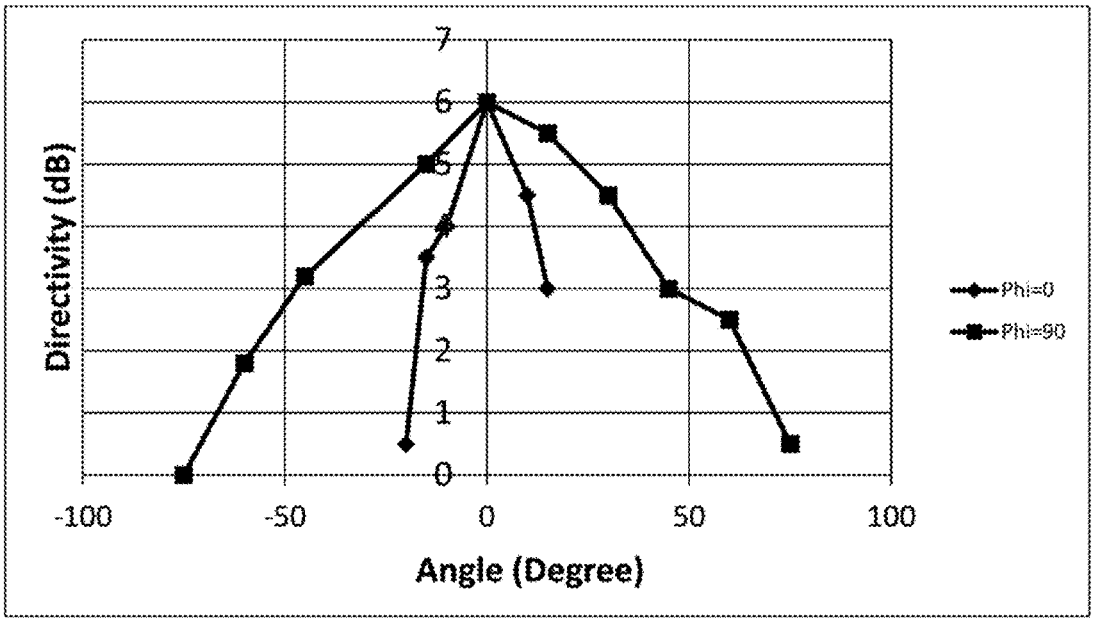
FIG. 5A shows a graph the measured far-field radiation pattern for the 2×1 array.
Figure 5B:
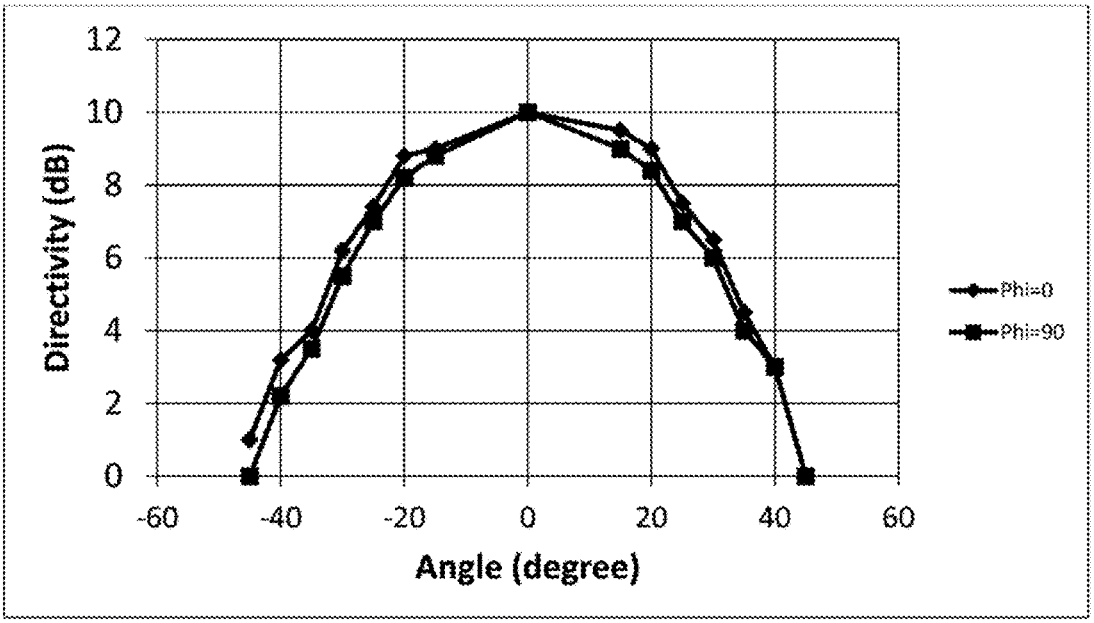
FIG. 5B shows a graph the measured far-field radiation pattern for the 2×2 array.
Figure 6B:
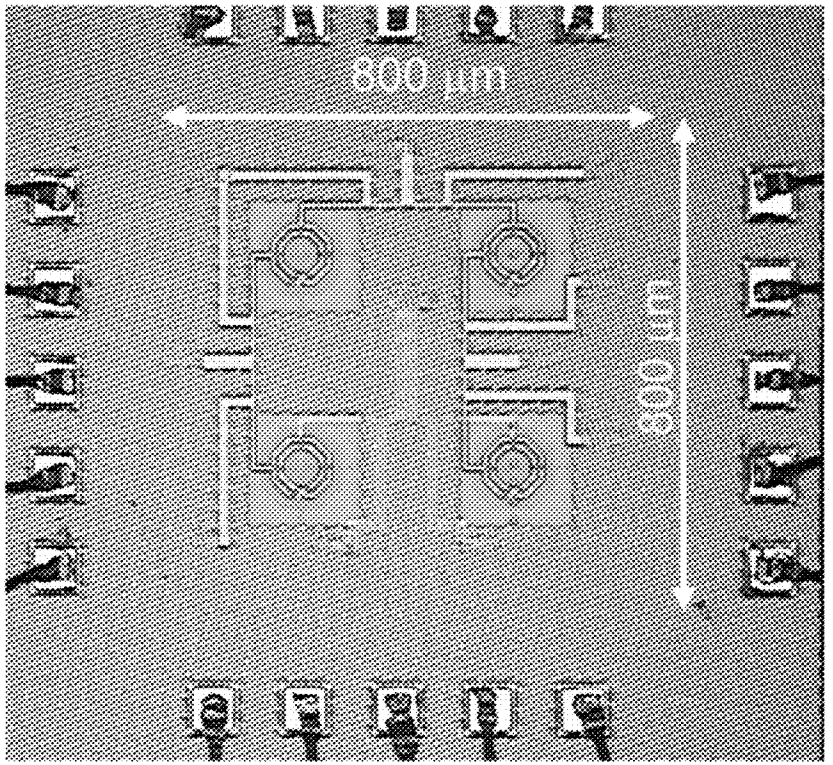
FIG. 6B shows a photomicrograph of an exemplary 2×2 array.
Figure 6A:
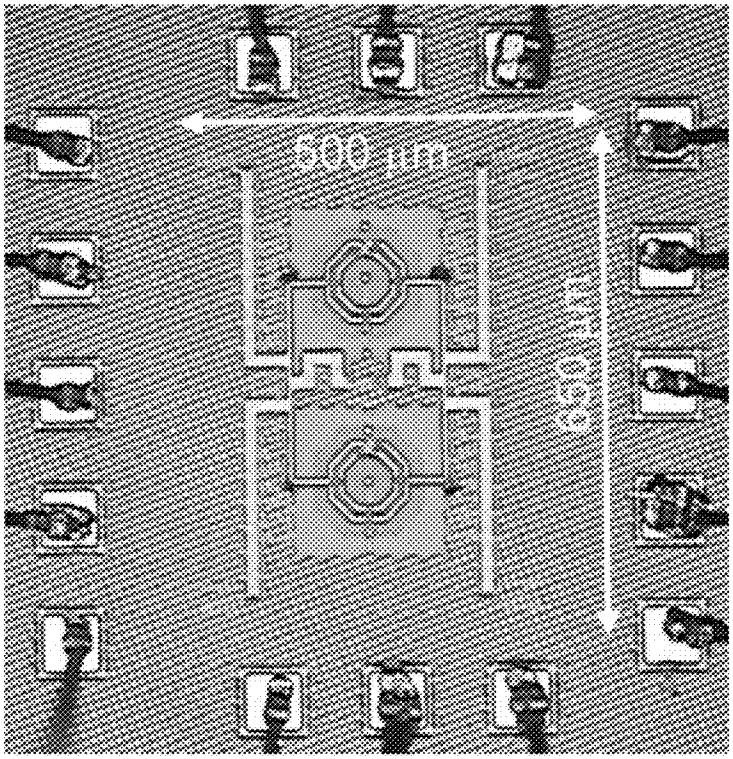
FIG. 6A shows a photomicrograph of an exemplary 2×1 array.

FIG. 5A shows a graph the measured far-field radiation pattern for the 2×1 array. FIG. 5B shows a graph the measured far-field radiation pattern for the 2×2 array. The measured boresight directivity of the array was found to be 6 dB which compares well against a simulated value of 5.6 dB. The boresight directivity was measured by noting the total radiated power, the receiver antenna aperture, and the received power at various distances in the far-field using Frii's free-space propagation model. This implies an EIRP of −13 dBm. The 2×2 array radiated at 291 GHz with a measured total output power of 80 μW. The measured directivity of 10 dB results in a net EIRP of −1 dBm. These exemplary chips drew 22 mA with a 0.85 V power supply voltage used per DAR. The active area of the 2×1 array was 500×650 $\mu m^2$ while that of the 2×2 array measured 800×800 $\mu m^2$. FIG. 6A shows a photomicrograph of the exemplary 2×1 array discussed hereinabove. FIG. 6B shows a photomicrograph of the exemplary 2×2 array discussed hereinabove.

Beam-Forming Using Near-Field Coupling of Distributed Active Radiator Arrays

Fully integrated terahertz systems in CMOS can provide significantly lower cost alternatives to current technology. Integrated terahertz systems and devices will be useful in communication, computation, security, medical diagnostics, global environment monitoring, and industrial safety applications. However, generation of high enough THz power in silicon has been problematic. In Sengupta, et. al., "Distributed Active Radiator for THz Signal Generation," ISSCC Dig. Tech. Paper, pp. 288-289, Feb. 2011, we described how a holistic approach to system design and removal of the various artificial levels of partition in conventional design strategies, such as electromagnetics, circuits, device physics, and radiation opens up a new design space.

The Distributed Active Radiator (DAR) as described herein combines signal generation, frequency multiplication, quasi-optical filtering and desired harmonic radiation in the same electromagnetic structure. This allows generation of three orders of magnitude more radiated power at THz frequencies in CMOS compared to integrated devices of the prior art. DAR decouples power scaling from efficiency, removes the need for additional circuitry for filtering and matching network and has very low power lost to substrate modes, thus solving the problem of THz power generation in integrated devices. DAR devices and arrays as described herein can provide a high DC to THz conversion efficiency. There is no need for expensive post-processing (e.g., substrate thinning). There is also no need for an external silicon lens.

DAR devices and arrays are highly efficient radiating THz sources. It is contemplated, for example, that many DARs can be coherently locked to achieve a high THz power and a high EIRP. While transmission line based coupling has been used to synchronize a 2×2 array to achieve an almost 1 mW EIRP at 0.3 THz, it is believed that a larger array of coherently locked 10×10 DARs can be used to generate 500 mW EIRP. However, the physical layout constraints make it difficult to scale transmission line based locking to large arrays. Such physical layout constraints also can restrict the spacing of DARs in 2D arrays which should be optimized for partial cancellation of the dominant $TM_0$ substrate mode for higher radiation efficiency.

We now discuss the philosophy of holistic system design, and describe a method to exploit near-field electromagnetics as an alternative to transmission line based locking to coherently lock DARs and beam-form DAR radiation patterns. This method is truly scalable, since it removes the task of synchronization from the DARs to another level of abstraction. As proof-of-concept of DAR near-field sensing and coupling, we demonstrated 2×1 and 2×2 arrays of locked DARs, which radiated at 198 GHz and 191.2 GHz with a boresight EIRP of −9.2 dBm and −1.9 dBm respectively. The 2×2 array had additional varactor tuning elements which allowed beam-forming at 191.2 GHz with a measured scanning range of approximately ±30° in each of the two orthogonal directions in 2D space.

Distributed Active Radiator (DAR)

Figure 7:
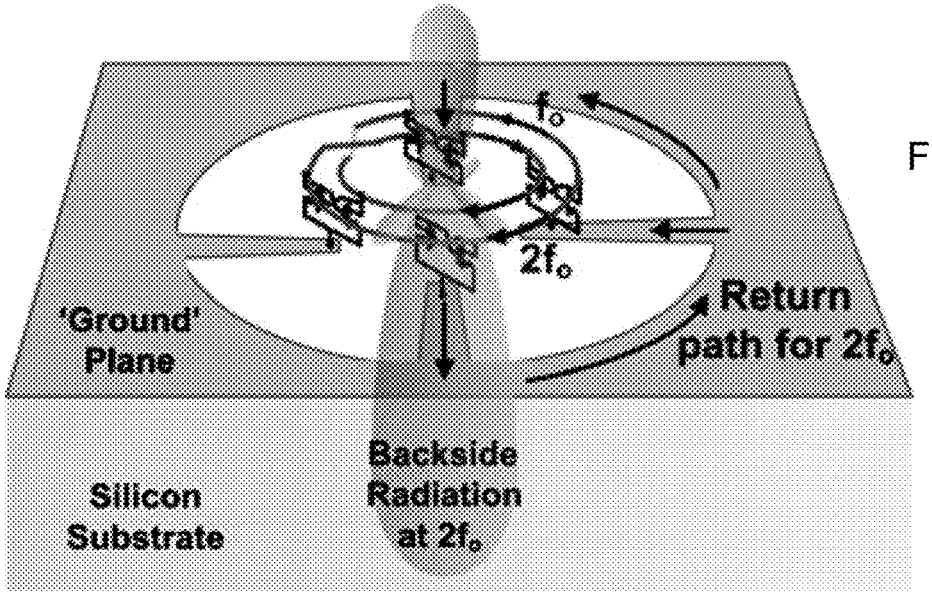
FIG. 7 shows an illustration of perspective view of the single DAR structure of FIG. 1D.

Before describing DAR near-field sensing and coupling, we describe DAR devices according to the invention in more detail. As described hereinabove, in one embodiment a DAR sustains a fundamental oscillation at a design frequency near $f_{max}$, and while doing so, efficiently radiates out the second harmonic, quasi-optically cancels the first harmonic, enabling harmonic generation, radiation, and filtering in a low-loss compact footprint, without any external lens. Now, describing DAR operation in more detail, FIG. 7 shows an illustration of another view of a single DAR structure. Each integrated DAR device has a conductive (typically metallic) strip (an analog of a Möbius strip, a closed curve, however typically without the classic Möbius twist) with cross-coupled pairs of active elements to sustain a traveling wave oscillation at a designed fundamental frequency. As a wave at the fundamental mode travels along the loop, it generates harmonics due to the nonlinear capacitance and transconductance. A DAR device extracts these harmonics very efficiently and filters quasi-optically the undesired fundamental mode through manipulation of current loops (the shape, length and spacing of the conductive strips of the DAR structure) at different harmonics. Each self-oscillatory DAR device provides efficient frequency doubling and second harmonic radiation.

The first harmonic currents in the two adjacent branches of the "Möbius like" loop are out of phase, since, as described hereinabove, one current in one branch is the return current of the other branch at the fundamental frequency $f_0$. Such closely placed out-of-phase currents ensure that the electromagnetic radiation at the first harmonic is minimal, thereby achieving low-loss filtering of the undesired first harmonic without additional circuitry. However, some harmonic currents (typically the second harmonic), in both of the branches travel in the same direction and therefore reinforce each other's radiated fields. The return currents of the desired harmonic to be radiated (typically $2f_0$) go through the ground plane. In some embodiments, the ground plane is connected to sources of the cross-coupled transistors, and the ground plane is removed in areas directly adjacent to the DAR conductors, with ground plane strips providing connections to the cross coupled transistors, as shown in FIG. 7. Thus, the second harmonic return current is separated phase-rotated (by 90°) from the forward current facilitating efficient radiation of the second harmonic. The same "Möbius like" strip therefore acts as a coplanar stripline at the first harmonic and distributed radiator at the second harmonic. No additional matching or filtering circuitry is therefore needed. In one exemplary implementation, the fundamental oscillation frequency was designed to be 100 GHz, with desired radiation at 200 GHz.

DAR devices and DAR arrays are particularly well suited for integrated implementations. The DAR radiating traveling wave generates circularly polarized radiation leading to about a 54% (simulated) radiation efficiency at 200 GHz over a 300 μm thick silicon substrate of 10 ohm-cm resistivity without using external lens, compared to 5-10% of that of a dipole supported by a silicon lens. In some embodiments, DARs can be configured so that radiation occurs primarily from the "backside" of a substrate due to the high dielectric constant of the silicon substrate. However, unlike conventional systems of the prior art, the signal is not generated in a block and then propagated with loss to a lossy radiating element. In DAR, all of the functionality for each DAR device happens at the same place and at the same time in the same DAR structure. Thus, each DAR device achieves both high harmonic conversion and high radiation efficiency.

Near-Field Coupling of DAR Arrays, Beam-Forming and Bias

DARs are particularly well suited for building 2D N×M element DAR arrays. Many DARs in a DAR array can be locked to each other to generate higher power with higher EIRP. Optionally adding phase control to some or all of the DAR elements of a DAR array can provide an additional radiated beam-forming function.

Near-Field Sensing and Locking

In this section, we describe how to co-design circuits as well as scalable electromagnetic methods that can be used to synchronize large arrays for coherent combination of DAR devices in space. First, to help understand embodiments using near field sensing, imagine two uncoupled oscillators running at similar frequencies and radiating power at their fundamental frequencies, each radiated signal being picked up by separate receiver antennas. The received signals have one-to-one relationships with the phase and frequency of the corresponding radiating oscillator. To coherently lock two DAR devices, the phase of the fundamental frequency at each corresponding point on both the DARs should be the same.

Now, instead of physically coupling the two oscillators, if the receiver antennas are coupled together with suitable impedance, then the parent oscillators can be made to 'wirelessly' lock to each other if the radiative coupling is strong enough. This "wirelessly locking" method removes the locking mechanism to a different level of abstraction allowing for an independent optimization and placement of the power generating elements, while synchronization happens wirelessly in the 'background'. This method is unlike other radiative coupling methods of the prior art, where radiating oscillators are constrained to be placed in close proximity to ensure locking.

At distances much greater than the fundamental wavelength, each DAR device quasi-optically filters the fundamental power in the far-field. However in the near-field, the two out-of phase fundamental currents in the adjacent branches do not cancel their fields. The near-field zone within the die (e.g., within a silicon die) contains rich information about phase and frequency of DAR operation which can be used to synchronize and beam-form two or more DAR devices (e.g., at sub-THz frequencies).

Figure 8:
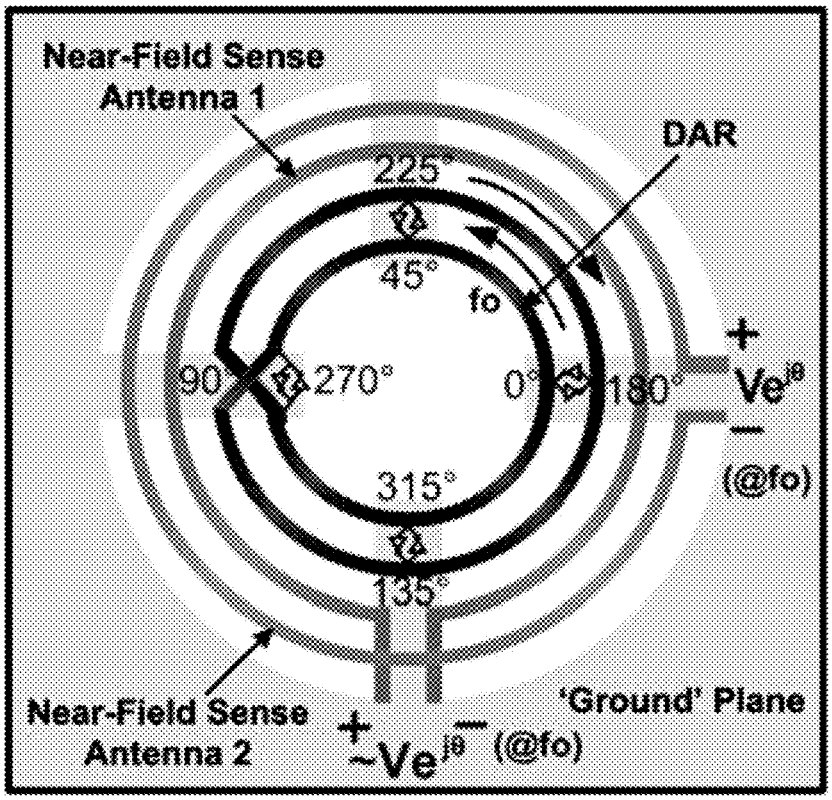
FIG. 8 shows a schematic diagram of one exemplary embodiment of a DAR device using near-field sense antennas for coherent locking of multiple DARs.

FIG. 8 shows a schematic diagram of one exemplary embodiment of a DAR device which uses near-field sense antennas useful for coherently locking multiple DARs. In this exemplary embodiment of FIG. 8, two antennas are placed close to each DAR device to sense the near-field at the fundamental frequency. Since the voltage at each sense antenna terminal pair is proportional to the time derivative of the coupled magnetic flux, rotating a sense antenna about the boresight axis does not affect the terminal voltage.

Bias Methods

There are several methods for providing the power to a DAR device. These methods to provide electrical power are referred to herein as biasing or "bias" methods. All of these bias methods provide the electrical power, from a DC power source, which is converted by each DAR device to an RF power in the form of the cancelling RF currents at $f_0$ and the radiating same direction RF harmonic currents. The DC power of each bias method is typically present as one or more DC power supply "rails". DC power is supplied from any convenient DC power source via a power terminal on a DAR device or DAR array. For example, the DC power can be provided by a battery or by a rectified AC mains power supply.

Direct Bias Method

Several "direct" biasing methods are described herein. Direct bias methods include, for example, a direct bias of a singled ended FET drive circuit, a cross-coupled FET pair circuit, and a complementary cross-coupled P-FET pair and N-FET pair circuit having four or more FETs. In direct biasing, DC power (applied to the device or device array via the power terminal) provides one or more "rail voltages" (e.g., $V_{dd}$, or $V_{dd}$ and $V_{ss}$) which can be "directly" connected to an active circuit including one or more of the gain elements making up the DAR active element. "Direct" connections to the gain elements can include intermediate components, such as for example, bias resistors.

Transmission Line Bias Method

Figure 9B:
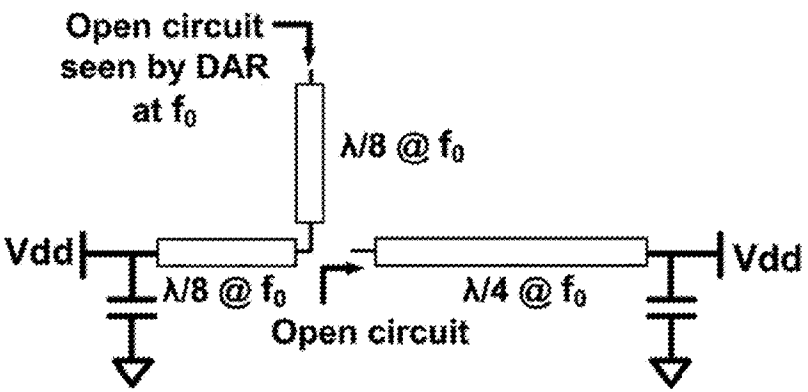
FIG. 9B shows a schematic diagram of an equivalent transmission line bias circuit at the DAR fundamental frequency $f_0$.
Figure 9C:
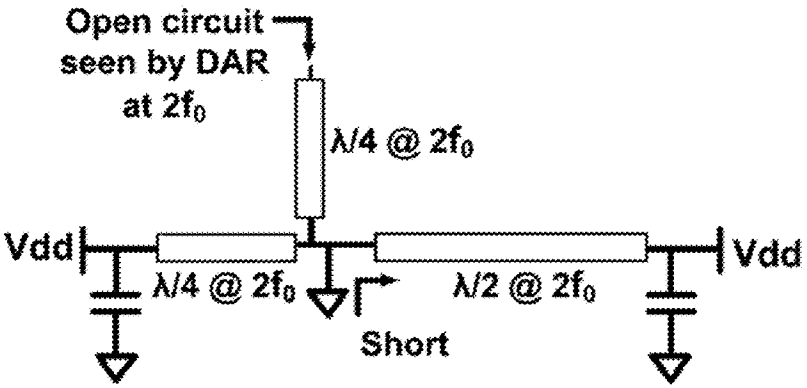
FIG. 9C shows a schematic diagram of an equivalent transmission line bias circuit at a desired DAR harmonic frequency.
Figure 9A:
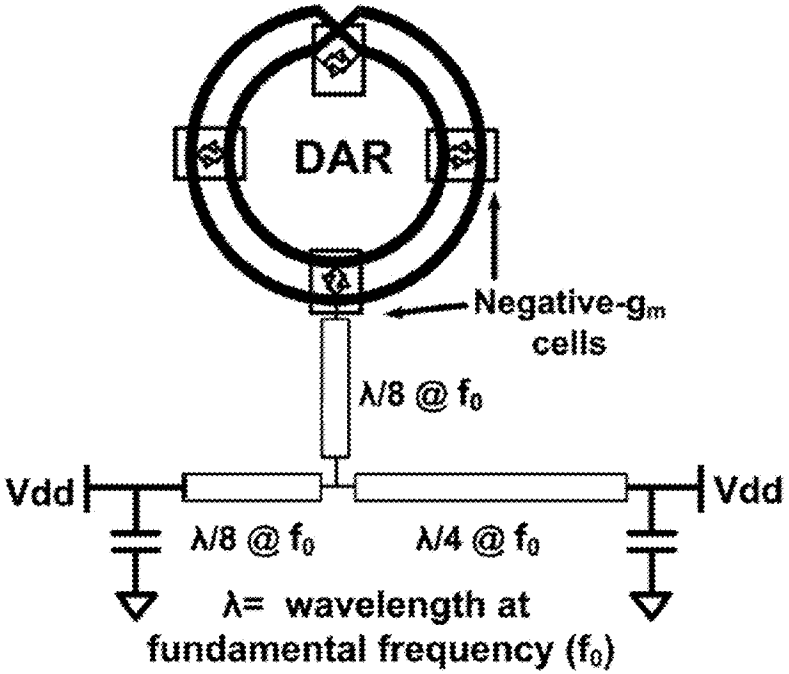
FIG. 9A shows a schematic diagram of a DAR device biased by an exemplary transmission line network.

Another type of bias is transmission line bias method. In the transmission line bias method, DC power is applied from the rails of one or more power supplies to one end of a transmission line. The at least one active element is powered by a leg of a transmission line network. FIG. 9A shows a schematic diagram of a DAR device biased by an exemplary transmission line network. FIG. 9B shows a schematic diagram of an equivalent transmission line bias circuit at the DAR fundamental frequency $f_0$. At $f_0$, the transmission line network presents a substantially open circuit to the conductors of the DAR so as to efficiently convert the DC power source to RF power in the self-oscillatory DAR device. FIG. 9C shows a schematic diagram of an equivalent transmission line bias circuit at a desired DAR harmonic frequency. The transmission line network also presents a substantially open circuit to the conductors at the desired harmonic frequency (e.g., $2f_0$).

Near-Field DAR Array Coupling Blocks

Figure 9F:
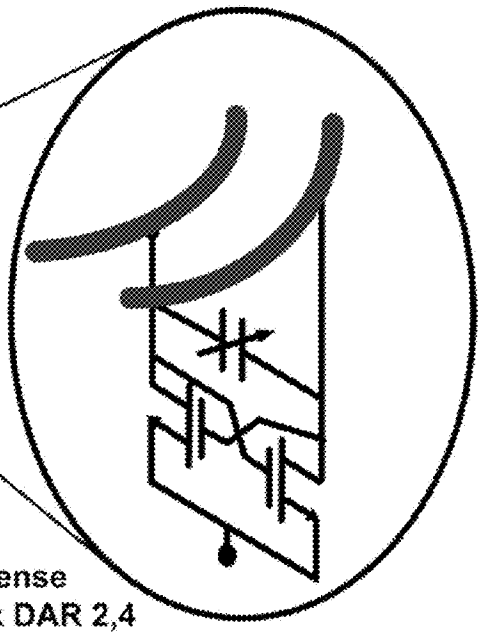
FIG. 9F shows a schematic diagram of a DAR cross-coupled pair having an optional varactor for beam-forming.
Figure 9D:
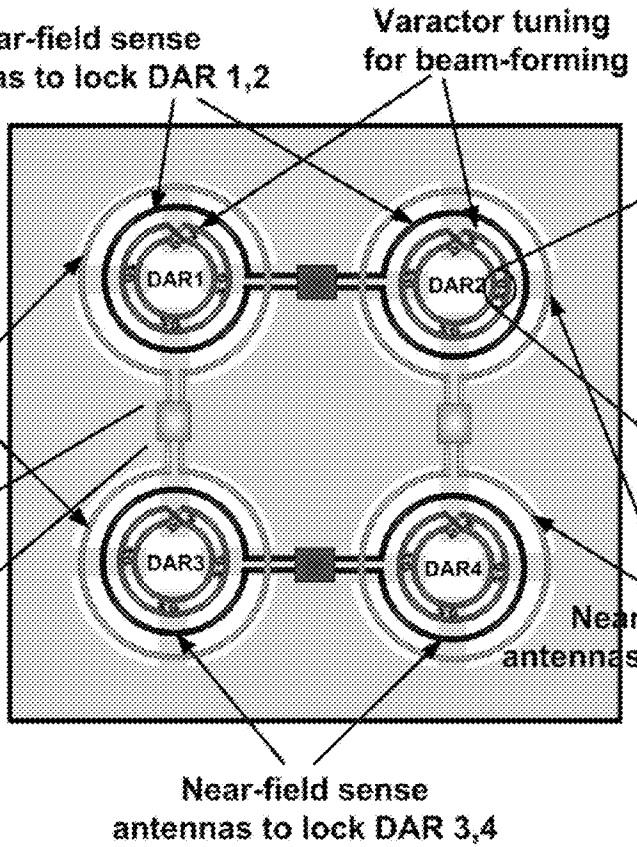
FIG. 9D shows a schematic diagram of one exemplary near-field coupling mutual locking circuit.
Figure 9E:
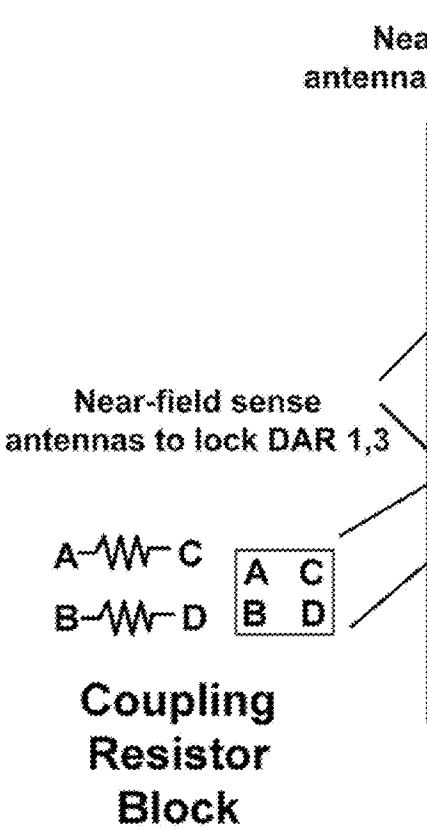
FIG. 9E shows a coupling resistor bock of the exemplary mutual locking circuit of FIG. 9D.

FIG. 9D shows a schematic diagram of one exemplary mutual locking mechanism useful in near-field coupling for locking and optionally for beam-forming in an exemplary 2×2 DAR array. To lock adjacent DARs, near-field sense antennas of each DAR device are coupled to another DAR in the DAR array. FIG. 9E shows a coupling resistor bock as one exemplary mutual locking mechanism suitable for use in the DAR array of FIG. 9D. Resistor values can be chosen to maximize the power dissipated in the sense loops under an unlocked condition. This power dissipation in unlocked conditions makes unlocked conditions unstable. Therefore, the lowest stable energy state of the DAR array system is when each of the DARs sustains traveling waves in the same direction and each corresponding point has exactly the same phase. The DAR array system automatically settles to this state, even if it starts from a different initial condition. The exemplary DAR array of FIG. 9D can also be optionally configured for beam forming FIG. 9F shows a schematic diagram of a DAR cross coupled pair having an optional varactor for beam-forming Such near-field coupling of DAR arrays (distributed coupling) as described hereinabove is very different from lumped transformer coupling, since the phase of the fundamental frequency changes by almost 180° over the sense antenna circumference. Also, a traveling wave DAR structure can avoid false locking. If the DAR were a single loop sustaining a radiating traveling wave, then the near-field distribution in space at any time would be a rotational transformation of the field configuration at an earlier time about the boresight axis. For such a structure, the magnetic flux would be constant over time. However, the inherent asymmetry of the two branches of the DAR with respect to the sense loop antenna at the first harmonic, and the cross-over in each DAR, make the magnetic flux and therefore the sense antenna voltage periodically change at the fundamental frequency. Thus, the only two possible fundamental current distributions are currents traveling in opposite directions, which have similar signatures on the terminal voltage of the sense antenna. However, simulations show that the inherent substrate coupling makes the coherently locked state the preferred state. Therefore, by using coupling methods as described herein, all of the DARs combine coherently in space under a locked condition. This coherent locked condition has been confirmed by measurements of the polarization of the radiated beam. Each DAR can be biased using a t-line network as shown in FIG. 9A, which does not load the DAR at either the fundamental or second harmonic.

Beam-Forming

In some embodiments, beam-forming can be added to an N×M DAR array by adding varactor tuning elements to the one or more cross-coupled pairs of each DAR in the array. When the natural resonant frequency of each DAR device is changed (e.g., by tuning the varactors), coupling due to the near-field sensor antennas causes the DARs to pull toward a common frequency. This pulling toward a common frequency causes an additional phase shift in each element within the locking range which can be used to provide beam-forming. With individual control over resonant frequency of each DAR, a DAR array can steer the beam independently in 2D space. For example, for one exemplary 2×2 DAR array, the simulated locking range was found to be 3.9 GHz with a beam-steering capability of ±35° in two orthogonal directions.

EXAMPLE

Measurement Results

Figure 10B:
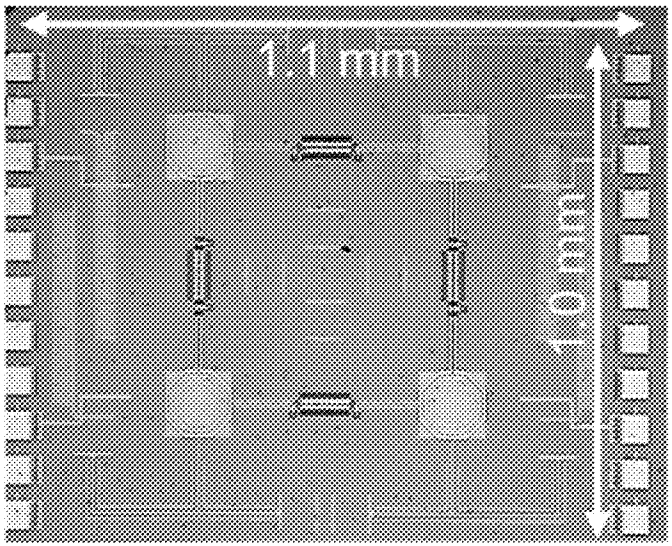
FIG. 10B shows a 2×2 DAR array.
Figure 10A:
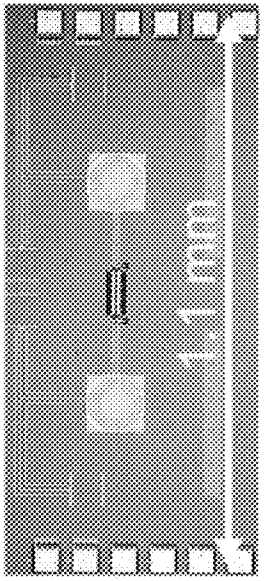
FIG. 10A shows a die 2×1 DAR array with varactors for beam-forming.

Integrated DAR array chips were implemented in 65 nm bulk CMOS with an estimated $f_{max}$ of near 200 GHz with a 3.25 μm thick Cu layer. FIG. 10A shows a die 2×1 DAR array with varactors for beam-forming. Radiation was captured from the backside of the chip through the 300 μm thick silicon substrate. No external lens was used to correct for substrate modes. FIG. 10B shows a 2×2 DAR array embodiment of the same type DAR array as shown in FIG. 10A.

Figure 11:
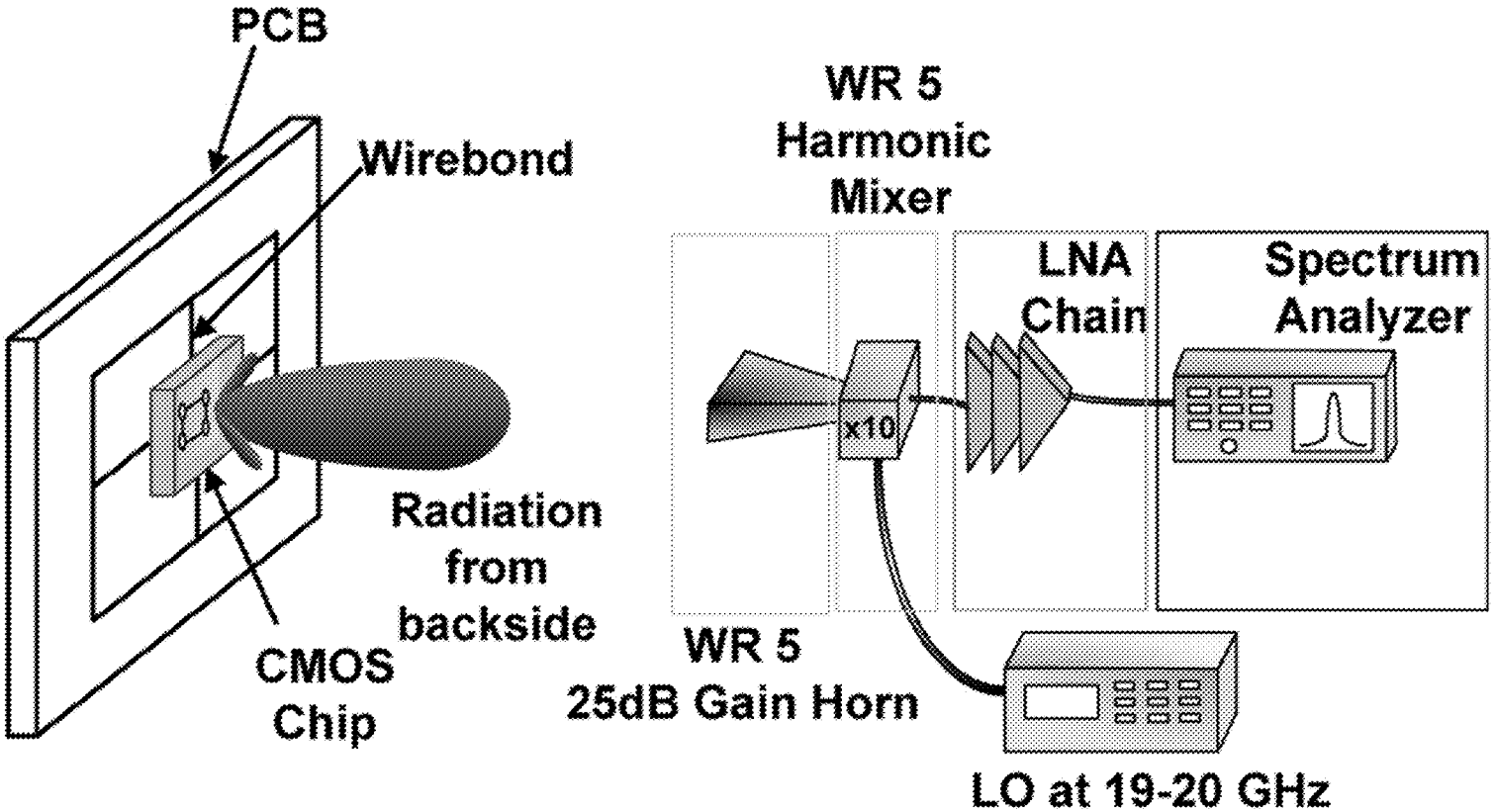
FIG. 11 shows a block diagram of the measurement setup used to evaluate the exemplary DAR arrays.

FIG. 11 shows a block diagram of the measurement setup used to evaluate the exemplary DAR arrays. The radiation from the backside of the DAR array under test was captured by a WR-5 (140-220 GHz) antenna and then down-converted by a harmonic mixer by the 10th harmonic of the local oscillator (LO). The IF signals were amplified by low noise amplifiers (LNAs) and analyzed using a spectrum analyzer. The set-up was calibrated using a calorimeter based Erickson power-meter which gives absolute power measurements from 75-2000 GHz. Each DAR was biased at 0.8V drawing 24 mA of current. The total radiated power was calculated from the measured radiation pattern, while EIRP was calculated directly from the power measured at the far-field (at d=20 mm) by the 25 dB gain standard horn receiver antenna.

Figure 12:
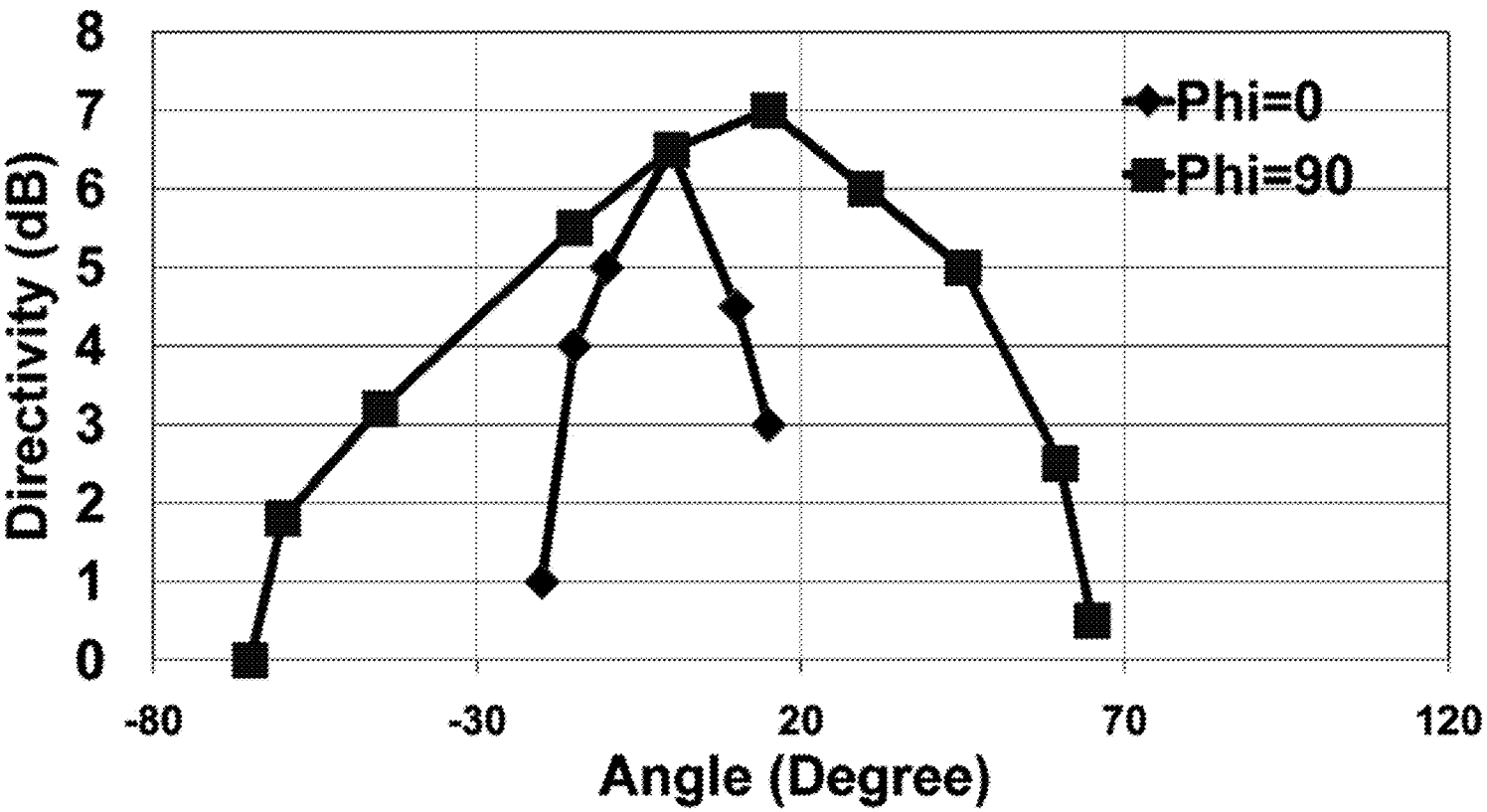
FIG. 12 shows a graph of the measured far-field radiation pattern at 198 GHz for a 2×1 array in the two orthogonal planes.

For the 2×1 array, power was detected at the second harmonic frequency of 198 GHz. FIG. 12 shows a graph of the measured far-field radiation pattern at 198 GHz for the 2×1 array in two orthogonal planes ($\phi$=0° and $\phi$=90°). The measured boresight EIRP was −9.2 dBm. The total radiated power was 24 μW and the boresight directivity was 7 dBi. The beam was verified as almost circularly polarized.

Figure 13A:
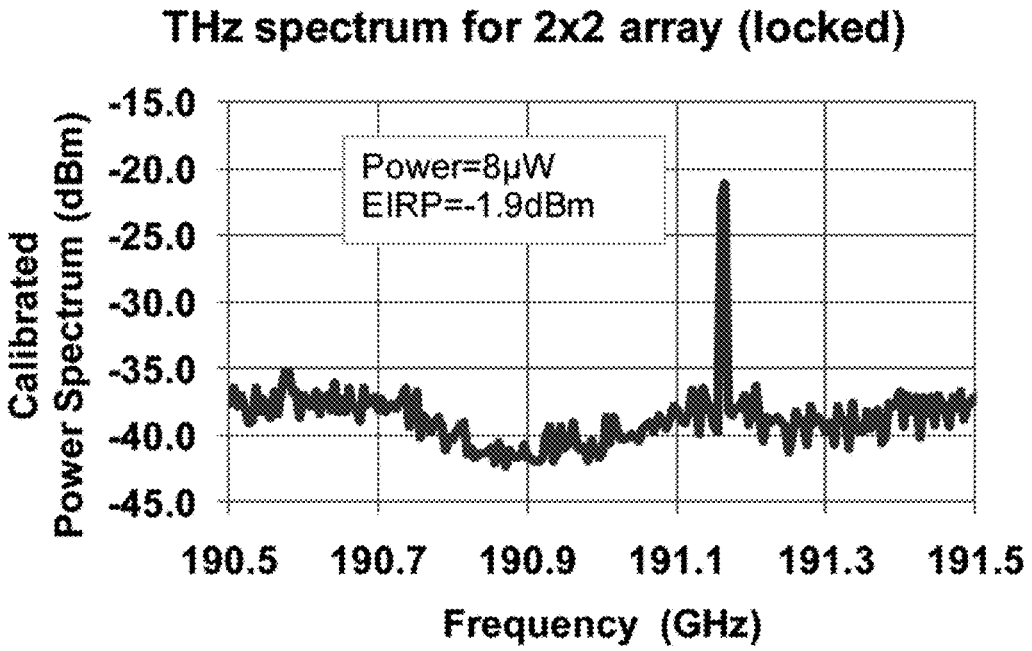
FIG. 13A is graph showing the calibrated THz spectrum for the locked array at a far-field distance of 20 mm.
Figure 13B:
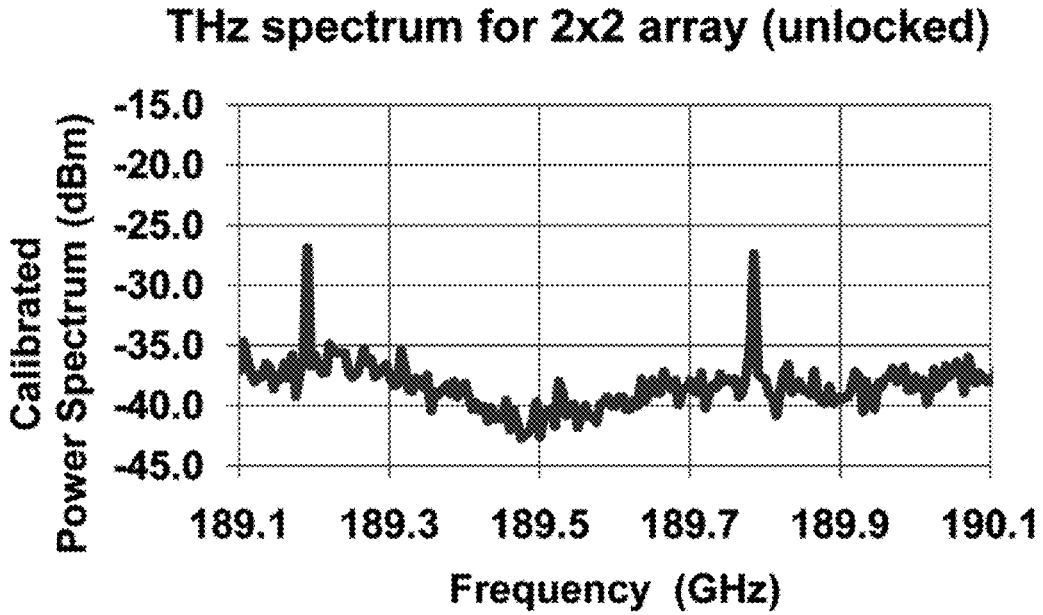
FIG. 13B is graph showing the calibrated THz spectrum for when the array goes out of locking range the spectrum splits.
Figure 14A:
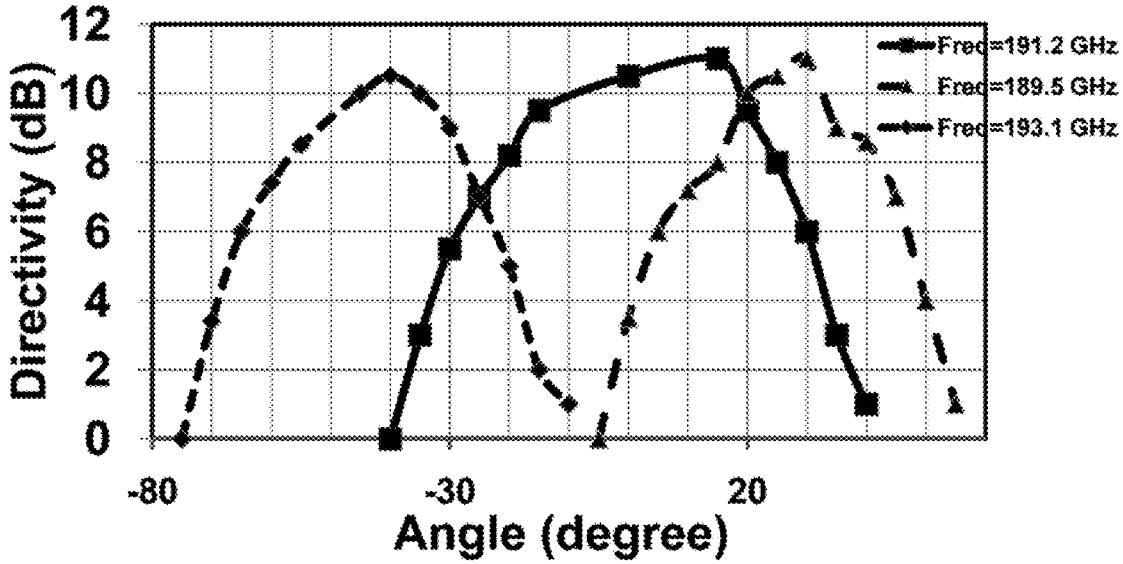
FIG. 14A and FIG. 14B are graphs showing the far-field radiation patterns of the 2×2 array in two orthogonal directions.
Figure 14B:
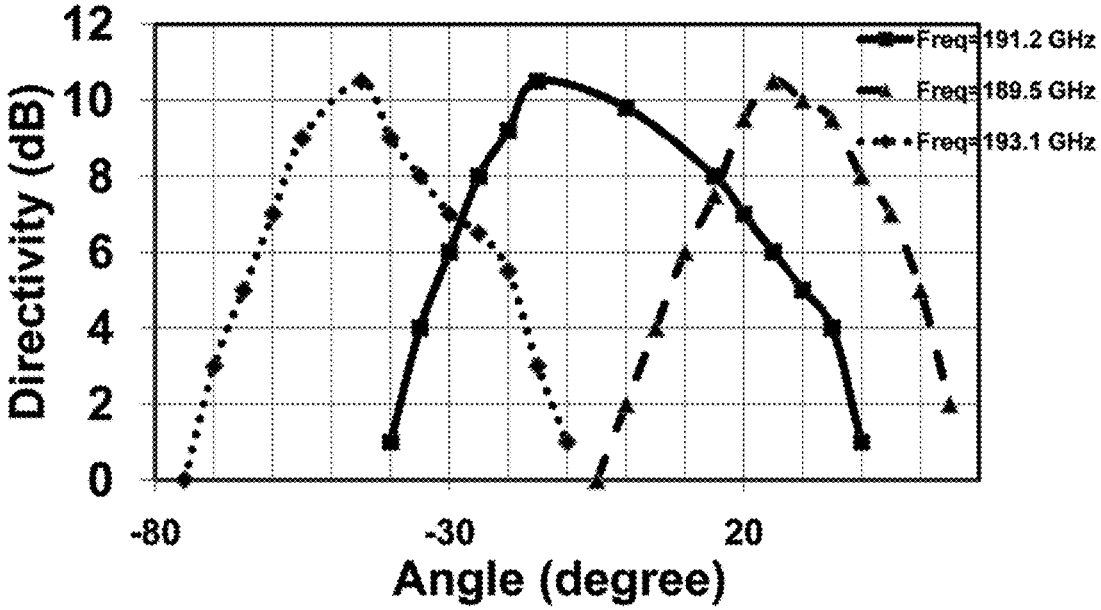

For the 2×2 array with varactors, radiation was detected at 191.2 GHz at the nominal tuning of the DAR array. FIG. 13A is graph showing the calibrated THz spectrum for the locked array at a far-field distance of 20 mm. FIG. 13B is graph showing the calibrated THz spectrum for when the array goes out of locking range the spectrum splits. The exemplary 2×2 array with varactors is capable of beam-forming in 2D space. FIG. 14A and FIG. 14B are graphs showing the far-field radiation patterns of the 2×2 array in two orthogonal directions (FIG. 14A $\phi$=0°; FIG. 14B $\phi$=90°) for the center frequency and at the edges of locking range. The locking range was measured to be 3.6 GHz with a scanning range of approximately ±30° in each direction. In the broadside setting, the total radiated power was measured to be 58 μW with a net EIRP of −1.9 dBm. The radiated beam was also found to be nearly circularly polarized.

While laboratory testing of DAR devices as described herein has been done for a desired radiated harmonic frequency of $2f_0$, as described hereinabove, it is contemplated that other harmonic frequencies of $f_0$ ($N \times f_0$) can be generated and radiated by DAR devices and DAR arrays.

4×4 Power-Generation and Beam-Steering Array

An above-$f_{max}$ 4×4 power-generation and beam-steering DAR array for THz applications is now described. An efficient power generation and radiation approach for THz applications has been described hereinabove, where a distributed active radiator (DAR) radiates directly out of a silicon chip with high conversion efficiency from DC to THz EIRP. In a 4×4 power-generation and beam-steering DAR array, 16 DAR's can be mutually injection locked to beam-form and beam-steer using two different coupling mechanisms. While it is possible to achieve coherent array operation on a small scale using injection locking, this approach can be less suitable for scaling to larger arrays, due to the complexity of the necessary coupling networks. Furthermore, in an injection locking setting, the center frequency of the radiated signal is determined by the consensus locking frequency of the elements and is thus still collectively free running in nature.

DAR Array Architecture Using a Centralized Frequency Generation Scheme

An N×M scalable array architecture for power-generation and beam-steering at THz frequencies using a centralized frequency generation scheme is now described. This centralized frequency generation scheme is compatible with phased locking to a low frequency external reference.

Figure 15:
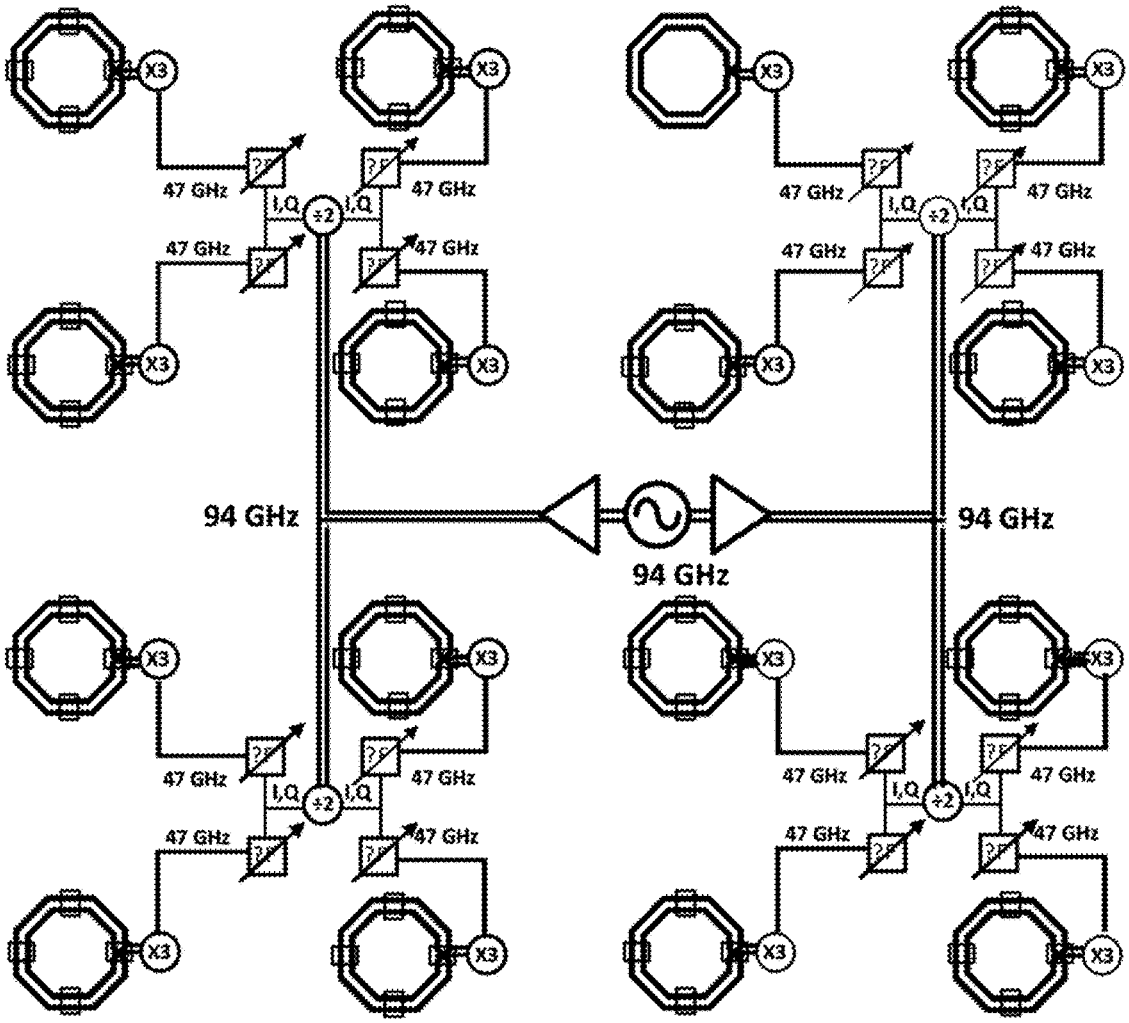
FIG. 15 shows a block diagram of an N×M array architecture.

As an example, a 4×4 element array was implemented in a 45 nm SOI CMOS process ($f_{max}$~195 GHz and substrate resistivity of 10 Ωcm) that achieved +9 dBm EIRP between 0.27-0.28 THz with 80° digitally controlled electronic beam-scanning in each of the orthogonal axes in 2D space (azimuth and elevation). FIG. 15 shows a block diagram that illustrates one exemplary embodiment according to the array architecture with centralized frequency generation scheme. Lower frequency signals are generated and distributed at sub-harmonic frequencies to minimize the loss in signal distribution at high frequencies. An on-chip voltage controlled oscillator (VCO) with cross-coupled transistors serves as the central time-base. The on-chip VCO can be phase locked to an external low-frequency reference. The VCO generates a tunable differential signal centered at 94 GHz, which is one third of the radiation frequency. Two buffers distribute the generated signal to four symmetric midpoint junctions on the chip where divide-by-two blocks generate differential quadrature (I and Q) signals centered at 47 GHz. These differential quadrature (I and Q) signals are then fed to individual phase rotators that are routed to each array element. The phase rotation is achieved by a digitally controlled weighted summation of the I and Q signals at 47 GHz. The output of each of the phase shifters with individual phase control drives injection-locked frequency triplers, whose oscillation frequency about 140 GHz. The fundamental frequency of the radiating elements is injection locked to the tripler output, thus controlling the second harmonic of the DAR, which is the radiation frequency around 280 GHz. In this embodiment, the phase rotation induced by each phase rotator ($\Delta\phi$) at 47 GHz directly translates to a phase shift of 6θ at the radiated frequency of 282 GHz. A DAR and or DAR array can thus efficiently radiate a near THz or THz frequency (e.g., 282 GHz) which is higher than the $f_{max}$ (e.g., 195 GHz) of any of its own active components.

Figure 16A:
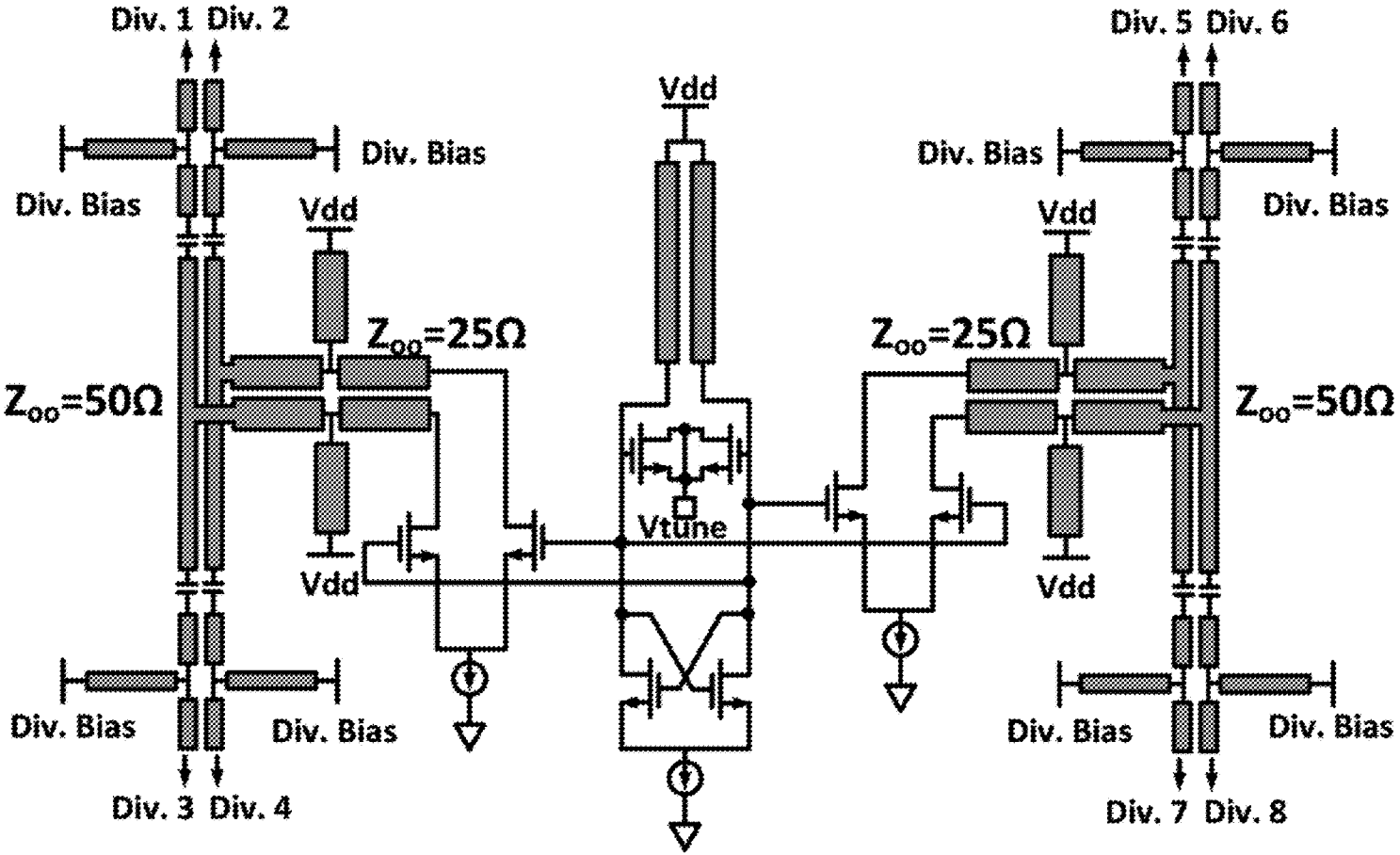
FIG. 16A shows a schematic diagram of one exemplary central time-base VCO with buffers.
Figure 16B:
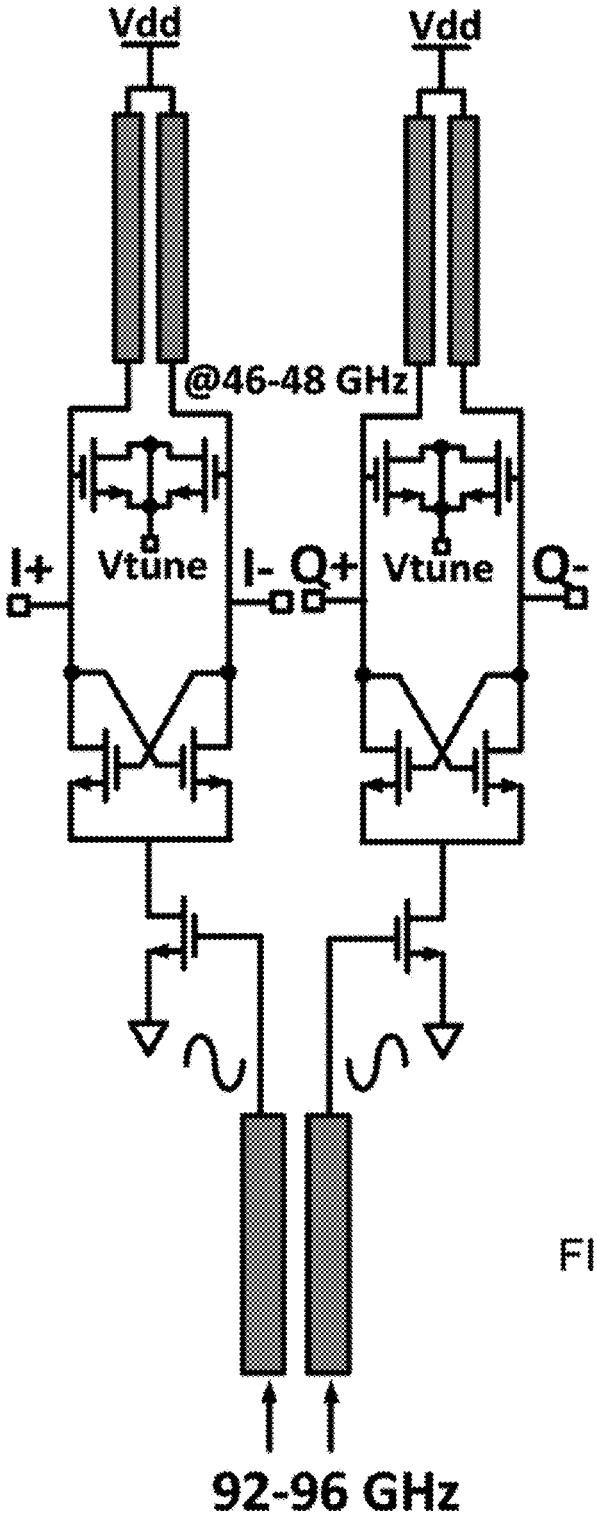
FIG. 16B shows a schematic diagram of a divide-by-two circuit useful for generating differential IQ signals.
Figure 16C:
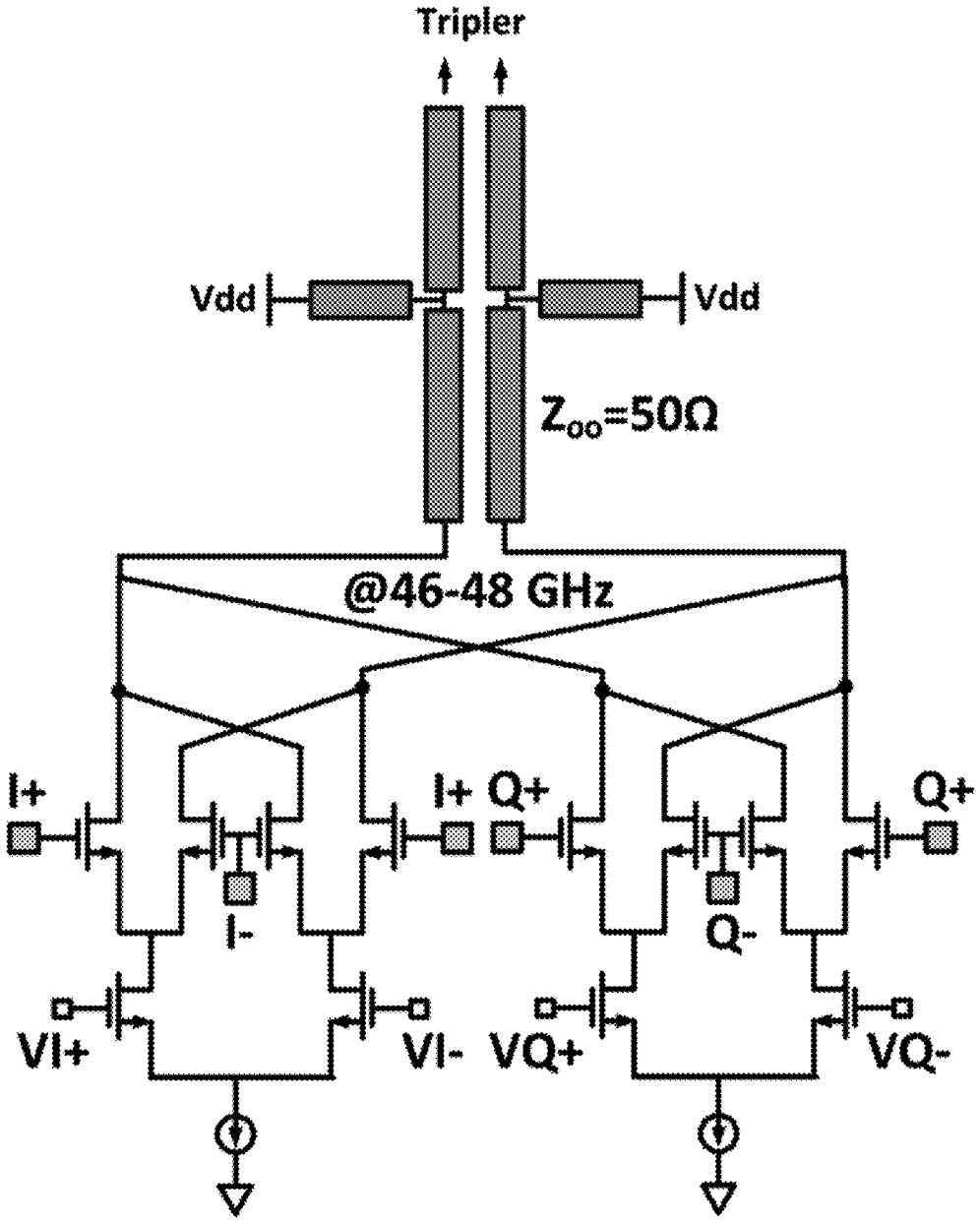
FIG. 16C shows a schematic diagram of a phase rotation circuit using a weighted summation of quadrature signals.

FIG. 16A shows a schematic diagram of one exemplary central time-base VCO and the buffers suitable for use in a Power-Generation and Beam-Steering DAR Array. The oscillator output is distributed to four symmetrical midpoint junctions with equal delays using modeled symmetric transmission lines with equal path lengths. The oscillator core with buffers drives the on-chip substrate-shielded differential coplanar striplines with grounded stubs having an odd mode impedance of $Z_{oo}$=25 Ω. FIG. 16B shows a schematic diagram of an exemplary divide-by-two circuit useful for generating the differential I Q signals. As shown in FIG. 15 and FIG. 16B in more detail, the t-lines branch out into two matched differential t-lines with $Z_{oo}$=50 Ω and distribute the differential signals to drive eight single-ended injection-locked divide-by-2's. The inputs of the divide-by-2's are matched to 50 Ω for maximum power transfer to ensure wide locking range over process variations and frequency tuning range. FIG. 16C shows a schematic diagram of one exemplary phase rotation circuit using a weighted summation of quadrature signals. The phase rotator performs a weighted sum of the quadrature signals by current addition via two current commuting (Gilbert) cells. The phase-control voltages are generated through a digital serial interface and a 6-bit on-chip DAC (not shown in FIG. 16C). The output of each of the phase rotators with individual phase control drives injection-locked frequency triplers through a t-line matching network, as shown in FIG. 15. Each of the 16 distributed active radiator elements (DARs, which are self-sustaining traveling wave oscillators) are locked to their associated tripler outputs.

Figure 17:
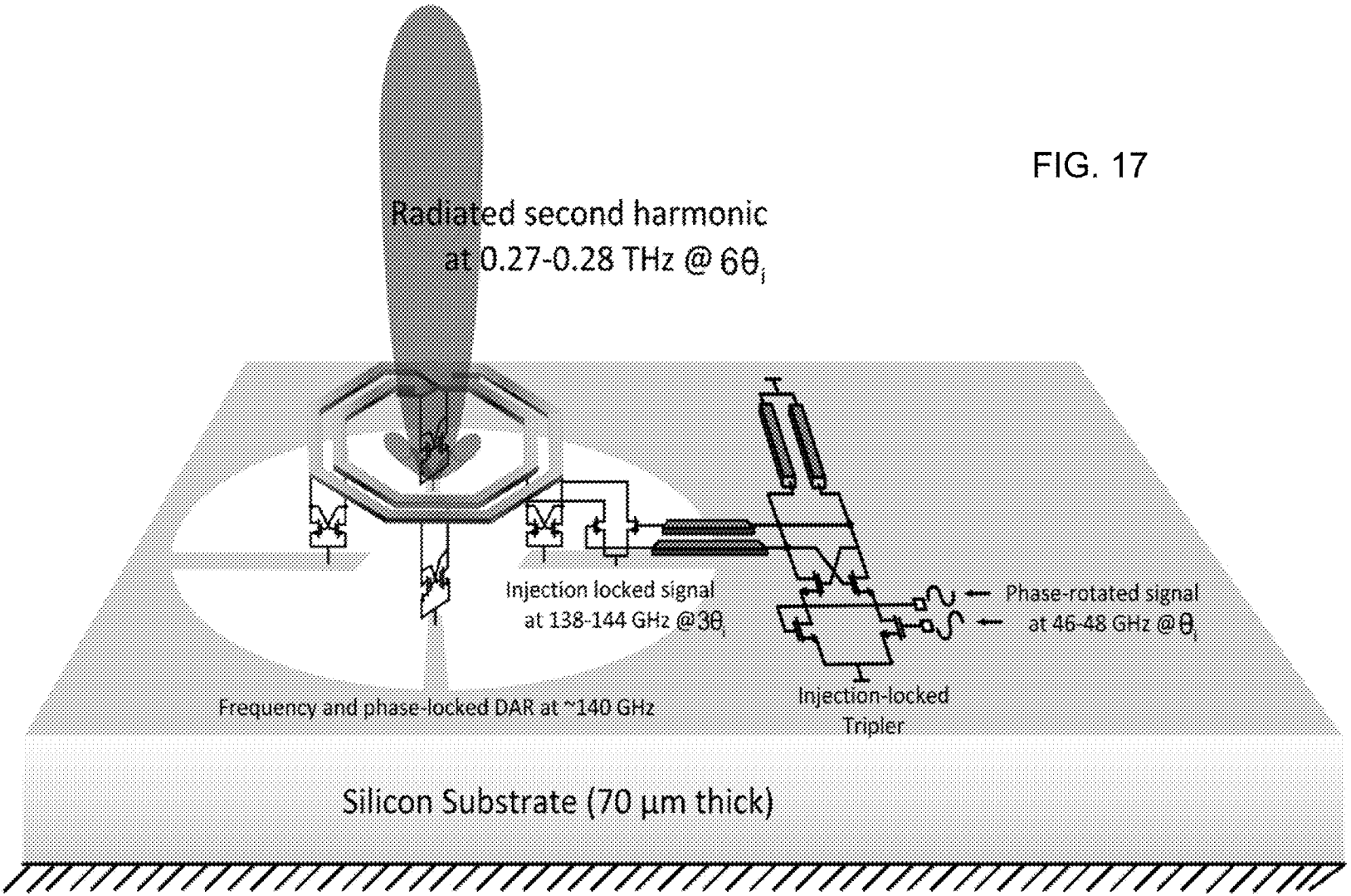
FIG. 17 shows a schematic diagram of an injection-locked tripler and a DAR device.

FIG. 17 shows a schematic diagram of one exemplary injection-locked tripler with a coupled DAR (as can be used for each element of a DAR array). FIG. 17 shows frequency multiplication, phase scaling, and radiation at 0.28 THz from a grounded substrate of 70 μm thickness. The DAR active radiators have the same fundamental oscillation frequency as the tripler output, however in this exemplary embodiment, the DARs radiate power efficiently at the second harmonic (e.g., at 280 GHz). In DAR signal generation, frequency doubling, quasi-optical filtering of the undesired fundamental and radiation of the desired signal at the doubled frequency all happen simultaneously and locally at each DAR. This allows both the DARs to achieve much higher DC-to-THz EIRP conversion efficiency than a conventional frequency generation and multiplication chain connected to a tuned antenna. The DAR is particularly suitable for high efficiency radiation through the substrate, even through an un-thinned substrate. Due to thermal considerations in such a large-scaled integrated system the substrate can be back-lapped to 70 μm and then mounted on brass to radiate from the top side, as shown in FIG. 17.

EXAMPLE

An exemplary DAR array chip was implemented in a 45 nm digital SOI CMOS process with a 2.1 μm thick top aluminum layer, highest $f_{max}$~195 GHz, and a substrate resistivity of 10 Ω-cm. The chip measured 2.7×2.7 $mm^2$ and the radiating elements were separated by 500 μm, which corresponds to approximately a λ/2 placement in air and 3λ/2 of the dominant substrate mode in silicon, which provided both partial substrate mode cancellation and increased radiation efficiency. Test measurements were made using the exemplary DAR array chip described hereinabove.

Figure 18:
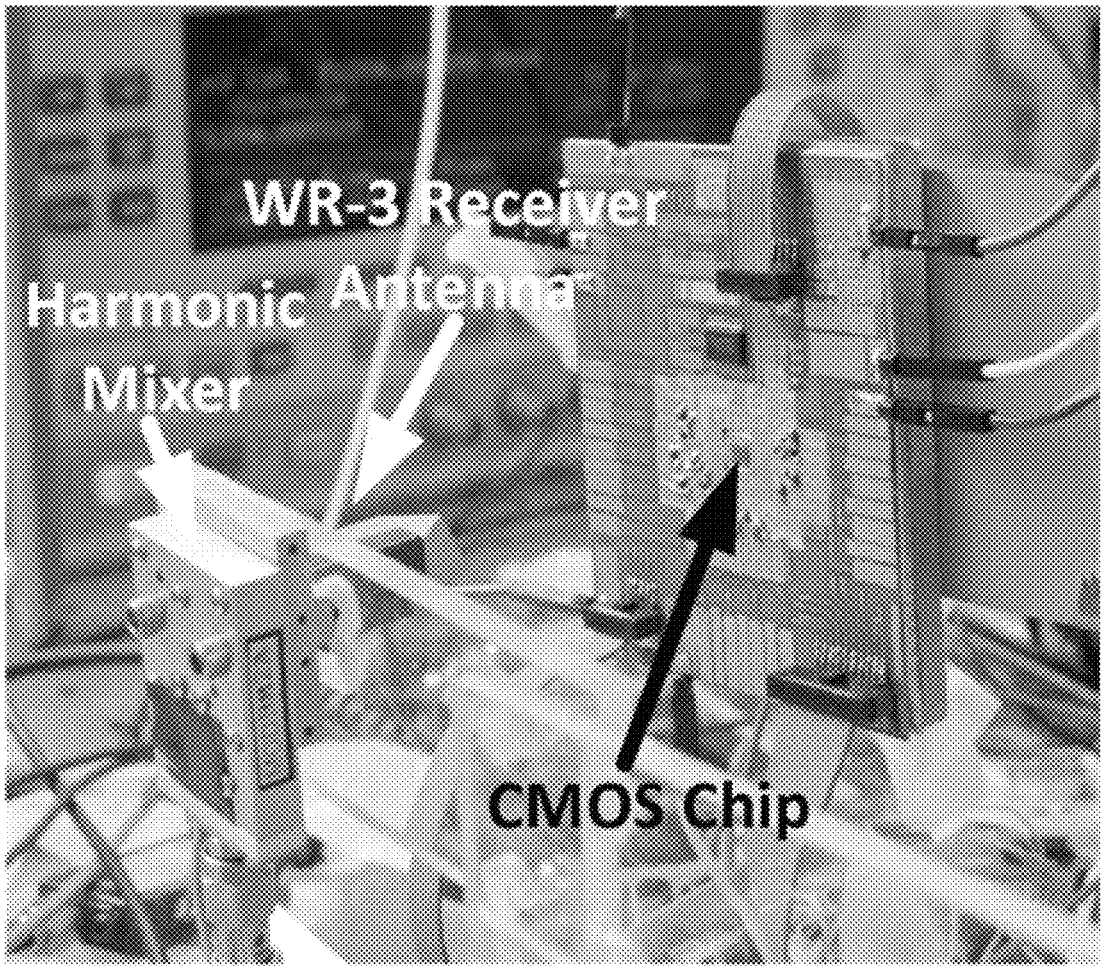
FIG. 18 is an illustration of a measurement set-up showing an exemplary chip radiating from the "top-side".
Figure 19:
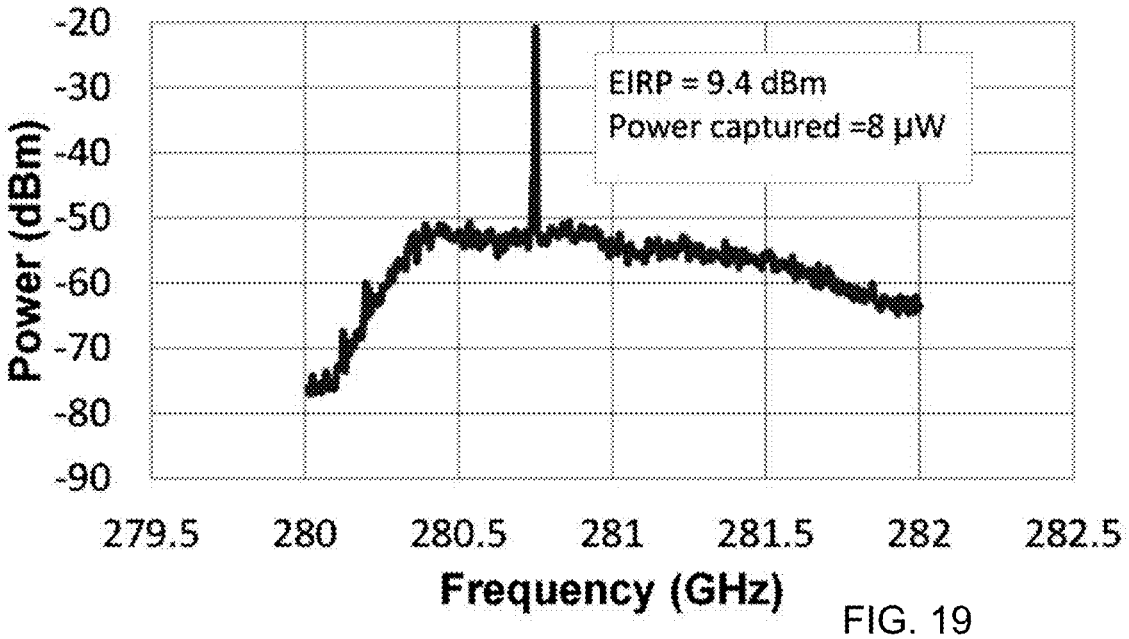
FIG. 19 shows a graph of measured power versus frequency.
Figure 20:
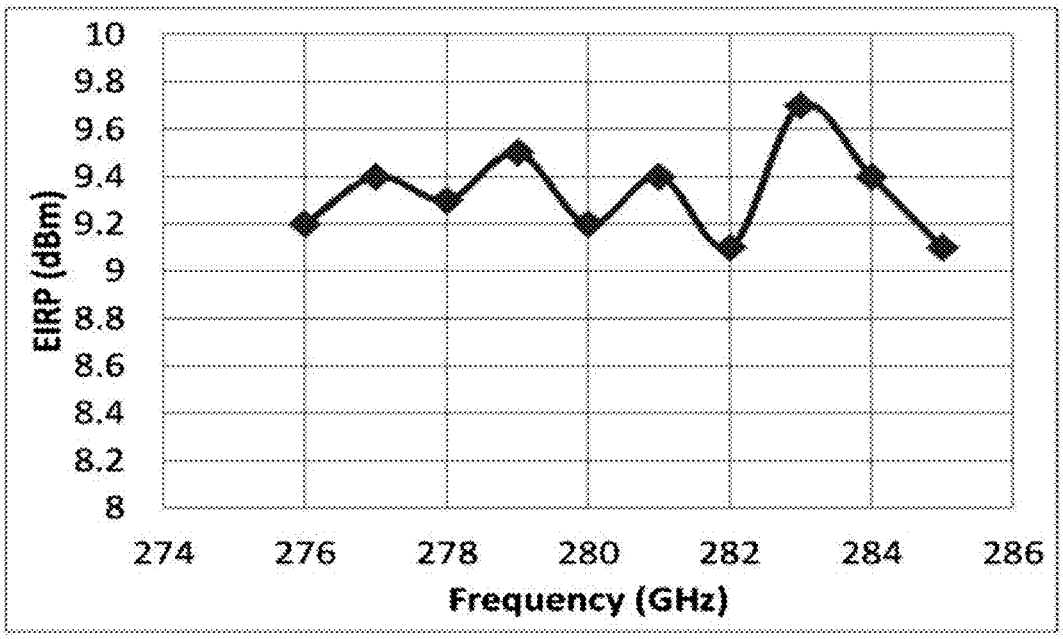
FIG. 20 is a graph of EIRP versus frequency.
Figure 21A:
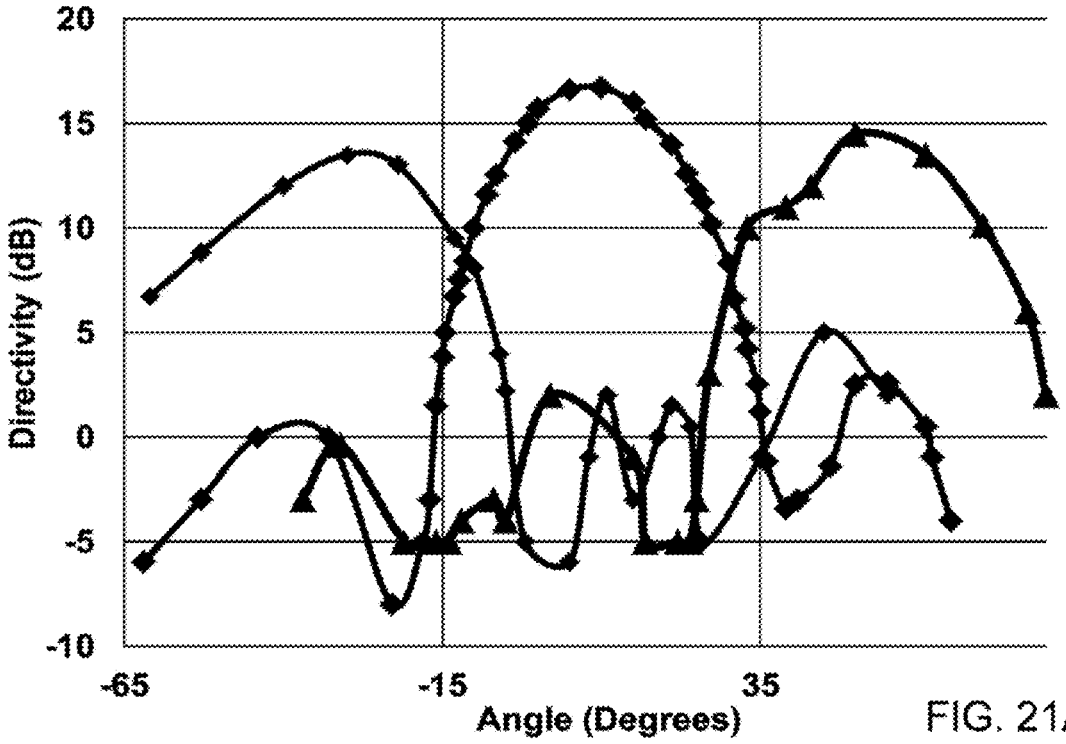
FIG. 21A and FIG. 21B are graphs of the measured radiation patterns at 0.28 THz.
Figure 21B:
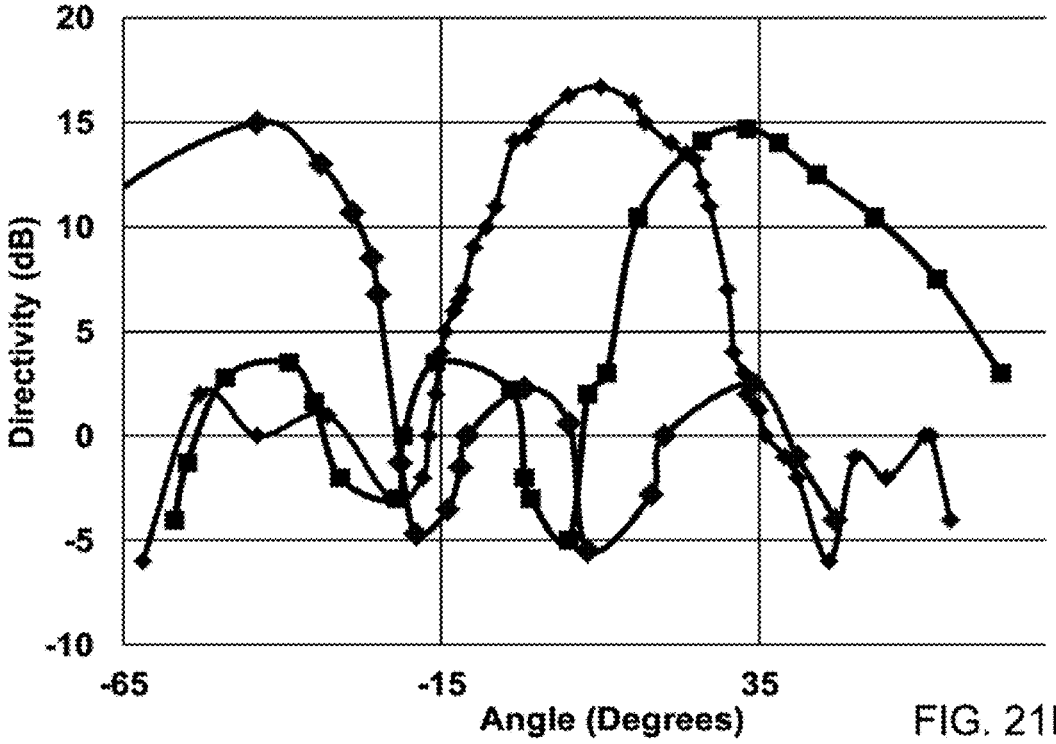
Figure 23:
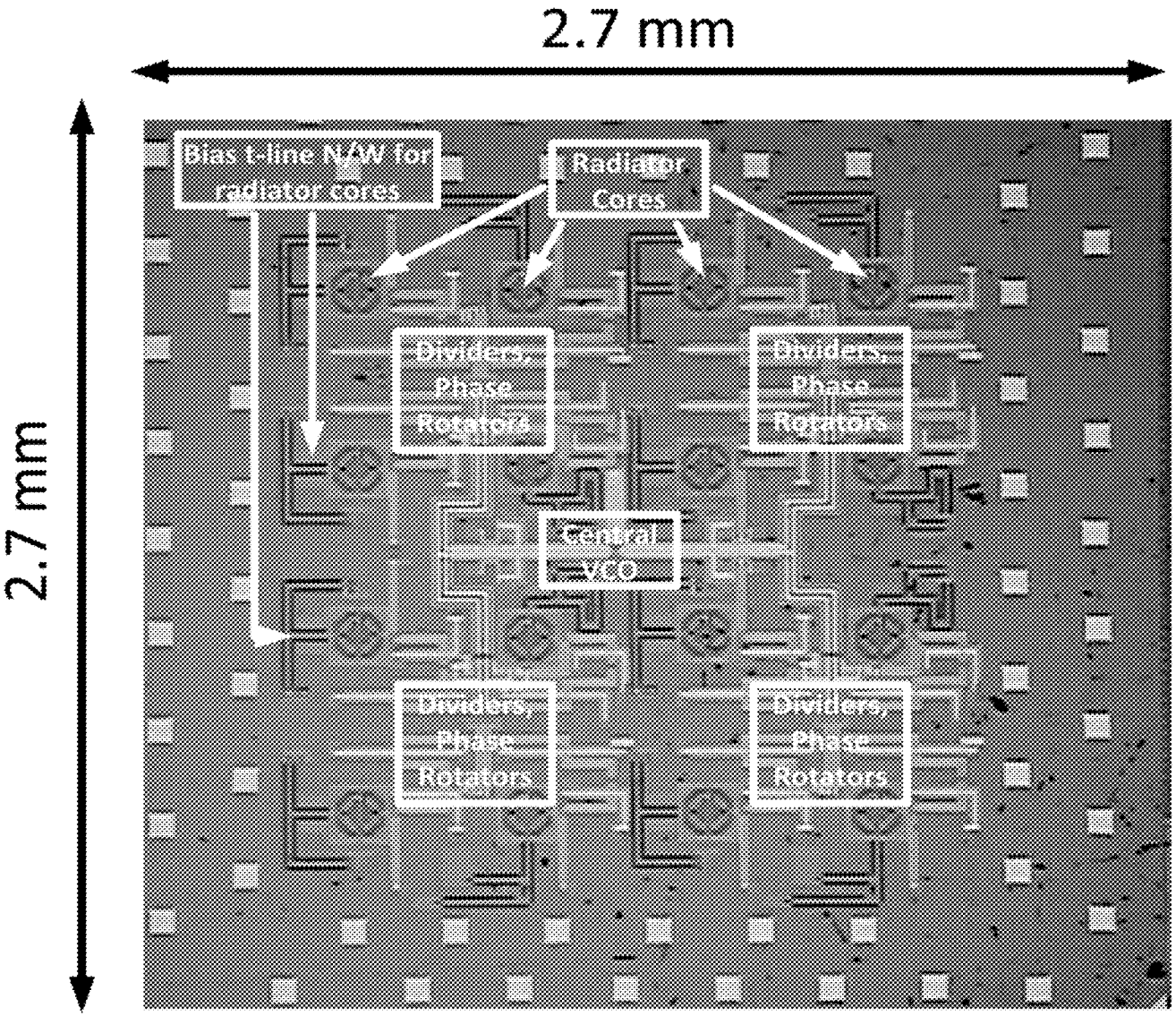
FIG. 23 shows a photomicrograph the exemplary THz transmitter of FIG. 22.

FIG. 18 shows the measurement set-up including the exemplary DAR array. In this exemplary embodiment, the DAR array chip was configured to radiate from the top-side, with the radiation captured by the calibrated receiver. The chip was mounted on brass and a printed circuit board (PCB) supported the low frequency digital signals and the power supplies. The DAR traveling wave radiators on the chip radiated circularly polarized modes from the top-side of the chip which was captured by a 25 dB gain linearly polarized diagonal WR-3 antenna and then down converted by harmonic mixer and analyzed using a spectrum analyzer. Due to a polarization mismatch, only half of the available free-space power was captured by the receiver. The set-up was calibrated by using an Erickson power meter. The calibrated THz spectrum at 280.7 GHz was detected at a far-field distance of 50 mm. FIG. 19 shows a graph of measured power versus frequency including the calibrated receive signal at 280.7 GHz. The 8 μW power captured power translates to a broadside EIRP of +9.4 dBm. FIG. 20 is a graph of EIRP versus frequency. The graph of FIG. 20 shows that the broadside EIRP remained above 9 dBm over the entire frequency tuning range. The chip was rotated through a 90° span during which the power captured did not vary significantly, thus verifying the circular polarization of the radiated beam. The frequency of the radiated signal, limited by the locking range of the tripler, was tunable between 276-285 GHz by controlling the tuning voltage of the central VCO (92-95 GHz). Thus, it can be seen that the DAR array architecture described hereinabove is compatible with phased locking to a low frequency external reference. FIG. 21A and FIG. 21B are graphs of the measured radiation patterns at 0.28 THz showing broadside radiation and beam-steering of around 80° in each of the two orthogonal directions in 2D space (FIG. 21A ϕ=0°; FIG. 21B ϕ=90°). The broadside directivity was measured to be 16.6 dBi and the electronic beam-steering range was shown to be approximately 80° in each of the two orthogonal directions in space. The table of FIG. 22 shows the performance of the exemplary THz transmitter, and FIG. 23 shows a photomicrograph the exemplary THz DAR array transmitter of FIG. 22.

Applications

Figure 24:
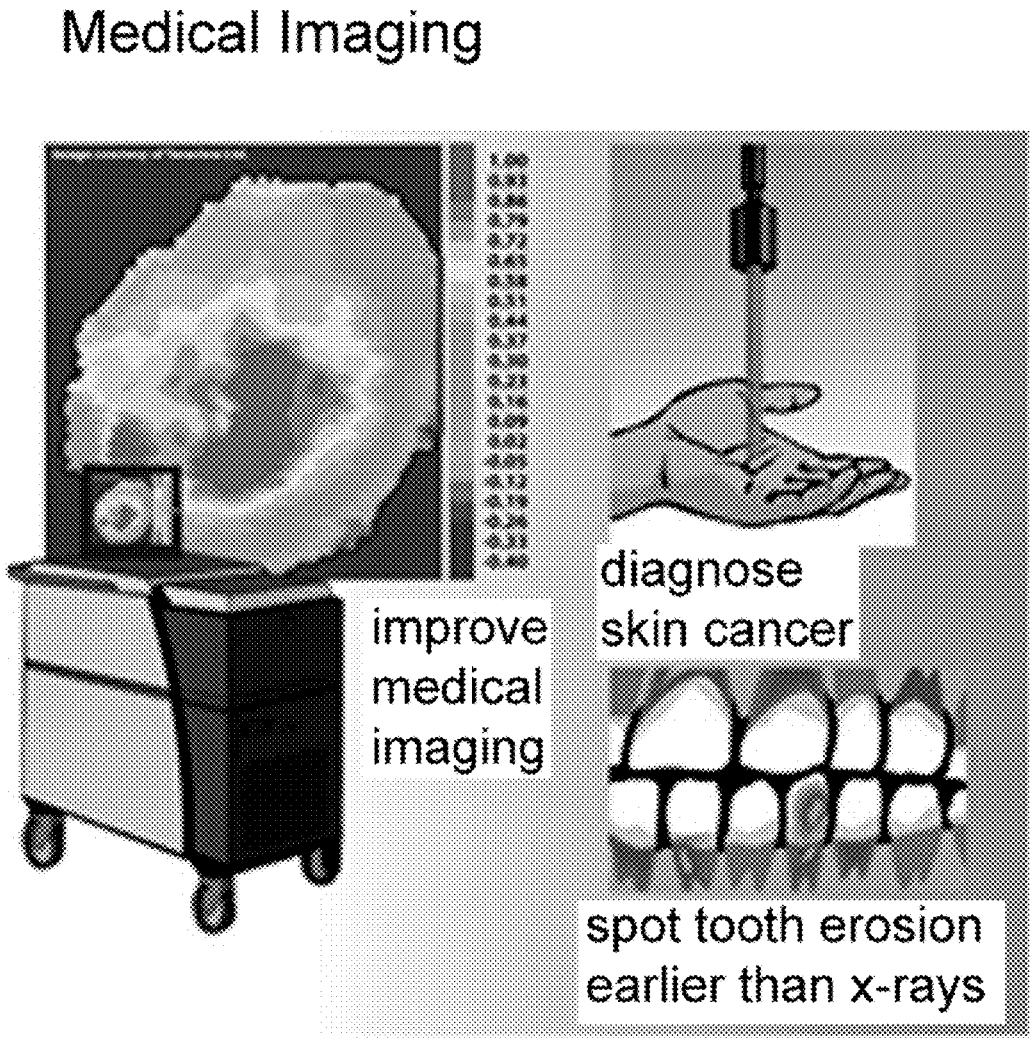
FIG. 24 is an illustration showing exemplary medical applications.

Instrumentation, detectors, and imagers based on DAR devices and DAR arrays can be used in security and defense applications, medical diagnostic applications, wireless communication and data transfer applications, and in nondestructive testing and quality control applications. Terahertz radiation is advantageous in medical applications since it is a non-ionizing radiation, and is less harmful to patients than ionization radiation, such as for example, conventional x-rays. FIG. 24 is an illustration showing exemplary medical imaging applications including a potential for diagnosing cancers, such as skin cancer, and for early identification of tooth decay.

Theoretical Description

Figure 25A:
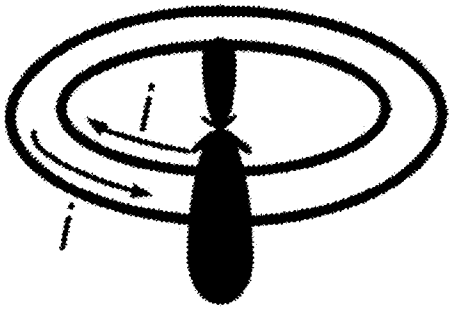
FIG. 25A to FIG. 25C are illustrations showing the basic operation of a DAR device.
Figure 25B:
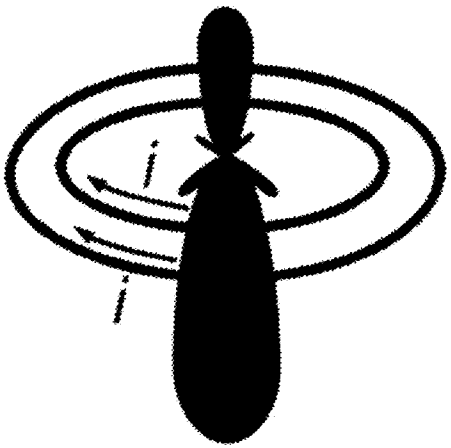
Figure 25C:
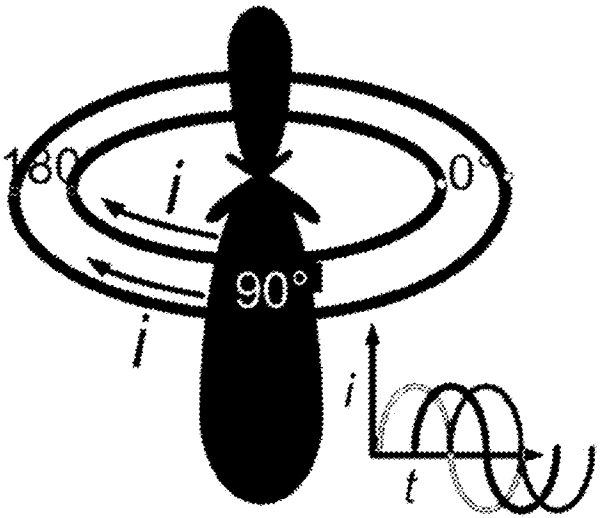

DAR device operation is now described in more detail hereinbelow. FIG. 25A to FIG. 25C are illustrations reviewing the basic operation of a DAR device as described hereinabove. FIG. 25A shows how two out of phase currents cancel radiation at a fundamental frequency $f_0$. Cancellation at $f_0$ occurs because transmission lines are poor radiators. FIG. 25B illustrates how two in-phase currents add their radiation in phase at $2f_0$, and FIG. 25C illustrates how the travelling wave of the two in-phase currents at $2f_0$ is out of phase by 90 degrees with the return current of the nearby ground plane thus enhancing radiation at $2f_0$. Thus, the same loop behaves as a transmission line at $f_0$ and as a radiator at $2f_0$. (The cross connection of the two strips is not shown in FIG. 25A to FIG. 25C for simplicity.)

Figure 26A:
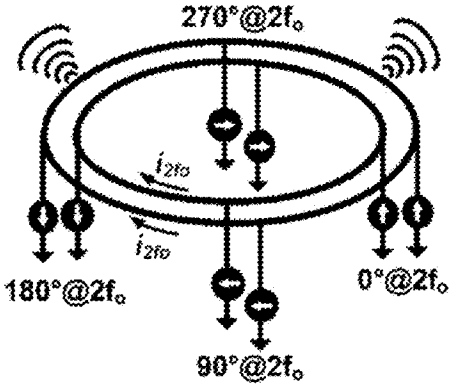
FIG. 26A to FIG. 26F are illustrations showing the operation of a DAR device in more detail.
Figure 26B:
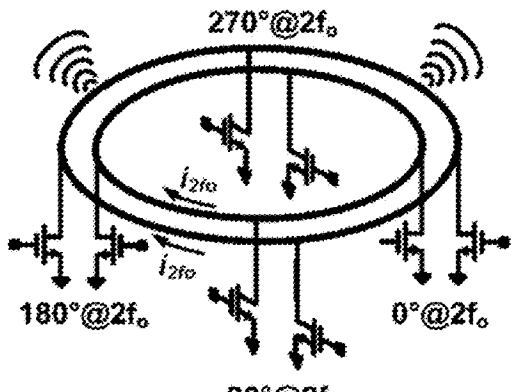
Figure 26C:
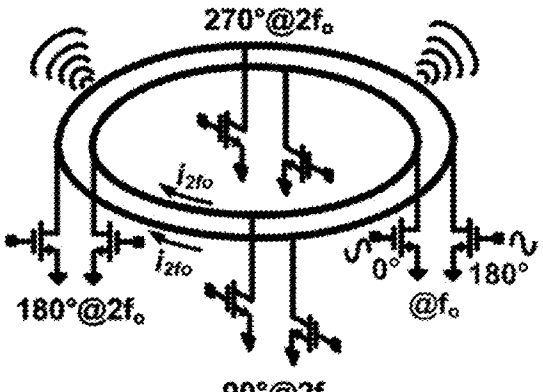
Figure 26D:
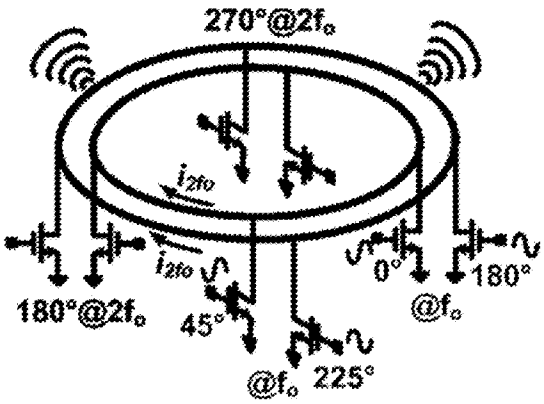
Figure 26E:
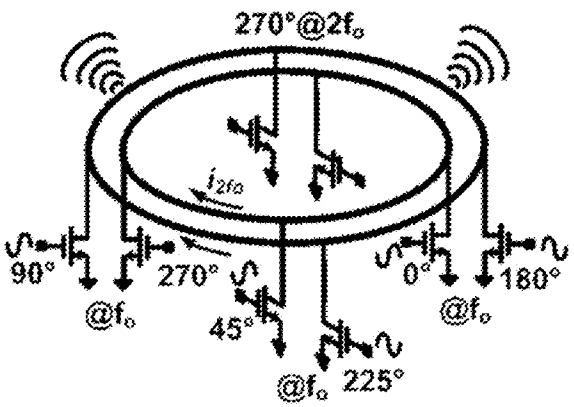
Figure 26F:
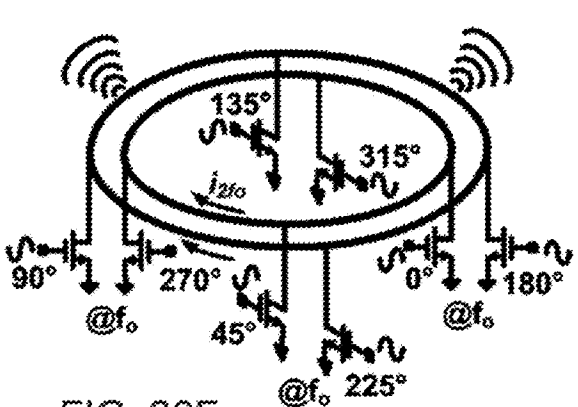

FIG. 26A to FIG. 26F show more detailed illustration of the operation of a DAR device. FIG. 26A to FIG. 26F show the same two strips of FIG. 25A to FIG. 25C, again not showing the cross connection for simplicity. In FIG. 26A, the traveling wave at $2f_0$ can be seen as represented by the current $i2f_0$. These distributed common mode currents at $2f_0$ are pumped in a constant phase progression. FIG. 26B illustrates how active elements, such as for example, FETs in some embodiments, can be used as current pumps. FIG. 26C shows how these active elements can, for example, be driven differentially at $f_0$. The non-linear transconductance and capacitance is used to generate $2f_0$ as a common mode current. FIG. 26D shows how, for this exemplary embodiment, while the gate signals of the transistors in the lower middle of the drawing are both at a phase of 90° at $2f_0$ in FIG. 26D, the gates are a phases of 45° and 225° respectively at $f_0$. FIG. 26E shows how, for this example, while the gate signals of the transistors on the left side of the drawing are both at a phase of 180° at $2f_0$ in FIG. 26E, the gates are a phases of 90° and 270° respectively at $f_0$. FIG. 26F shows similarly that while the gate signals of the transistors in the upper middle of the drawing are both at a phase of 270° at $2f_0$ (as shown in FIG. 26E), in FIG. 26F, the gates are a phases of 135° and 315° respectively at $f_0$.

Figure 27:
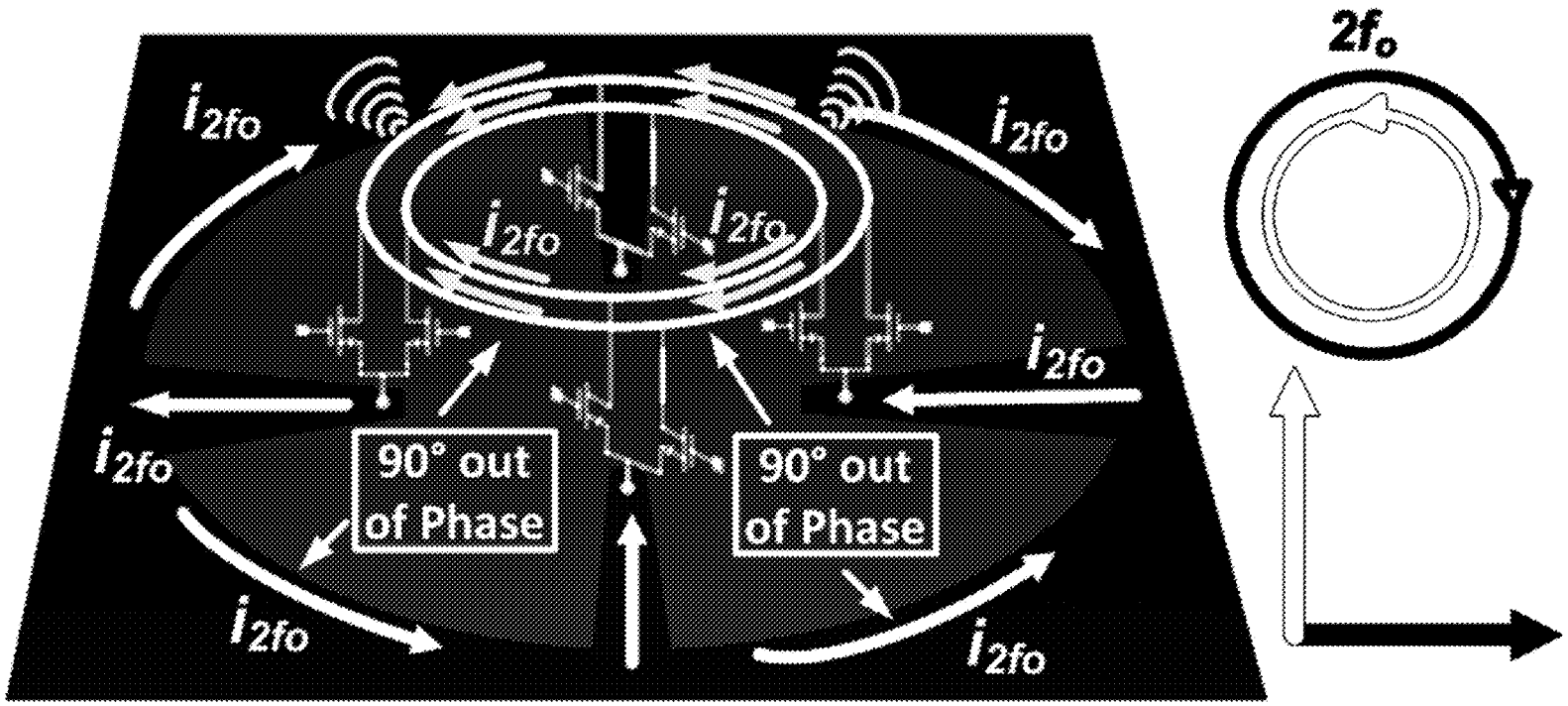
FIG. 27 is an illustration showing common currents at $2f_0$.
Figure 28:
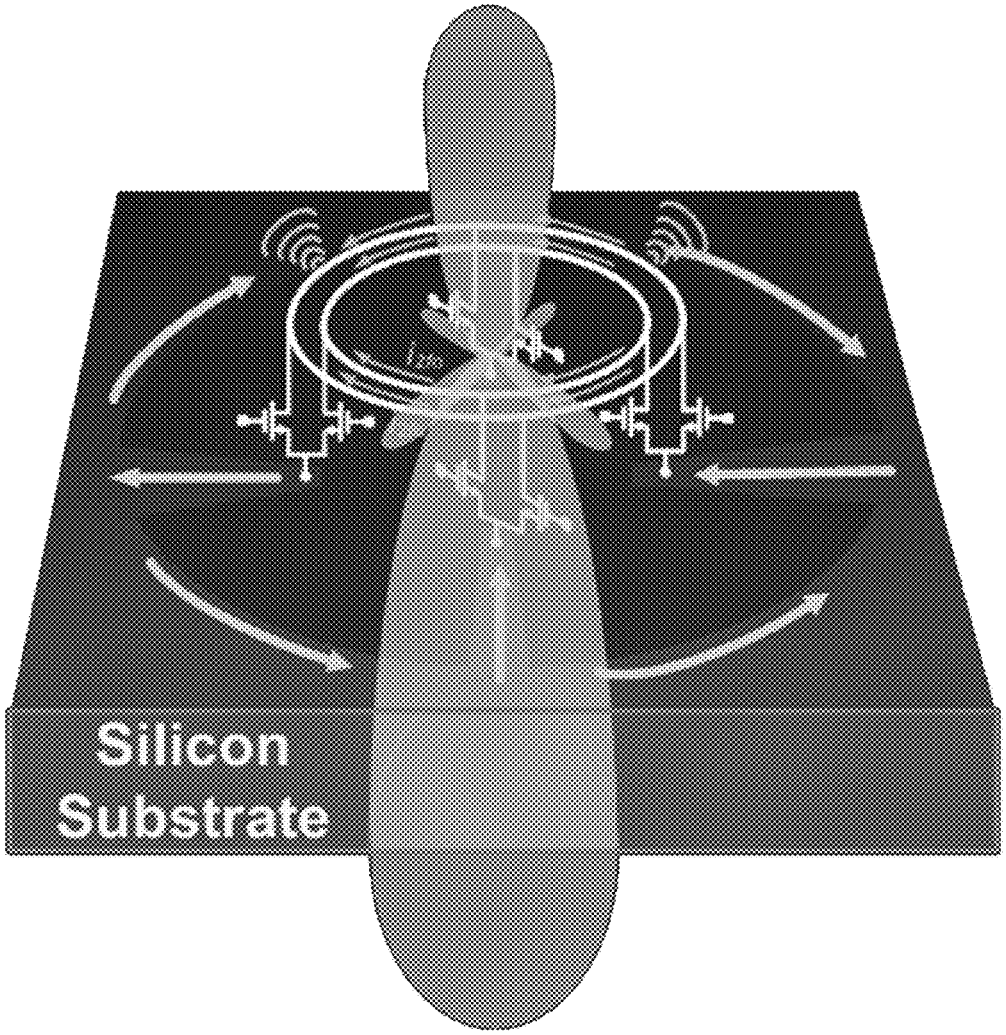
FIG. 28 shows one exemplary radiation pattern from a DAR silicon substrate.
Figure 29:
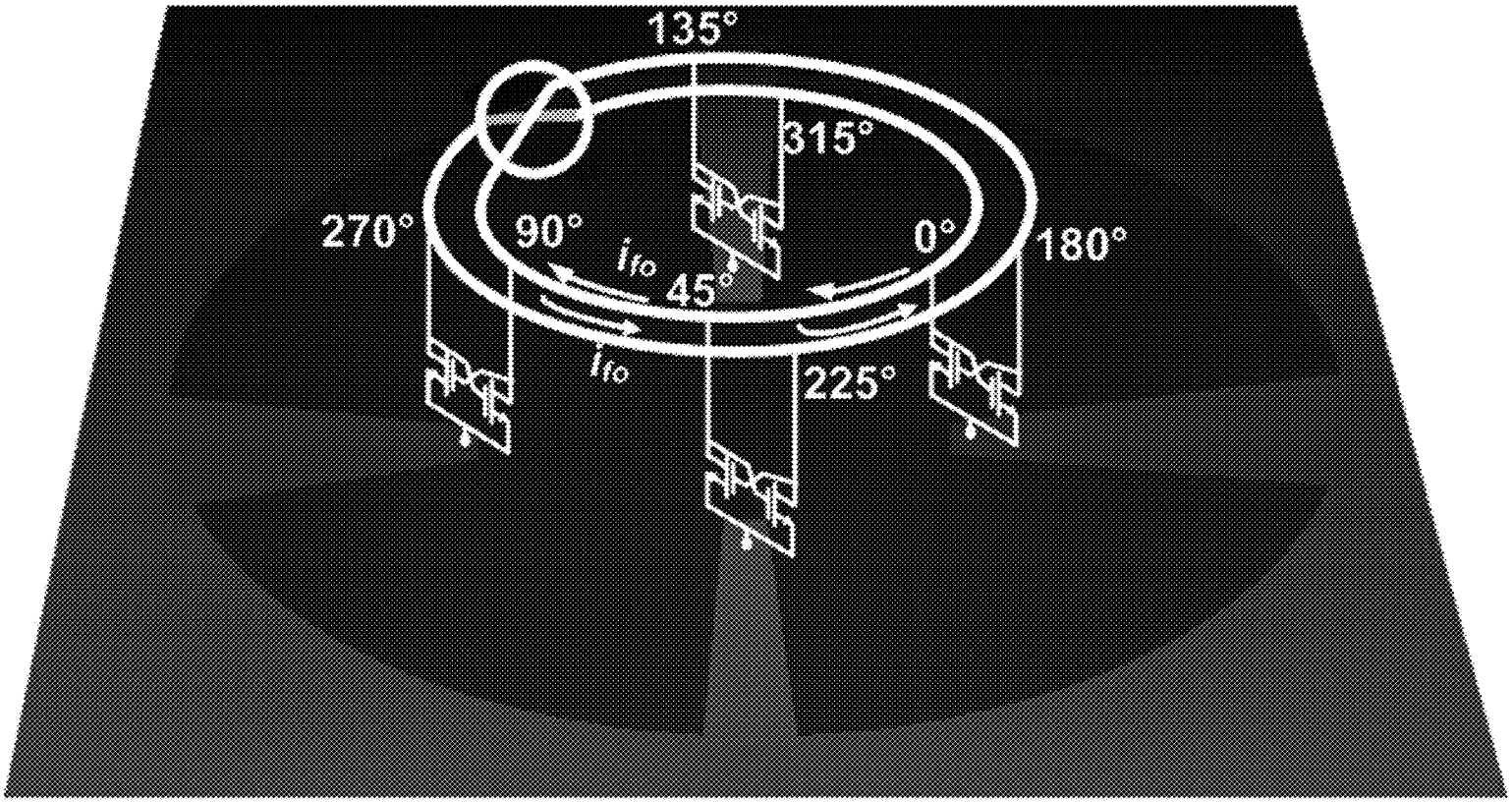
FIG. 29 shows the cross coupling between the strips of a DAR.
Figure 30:
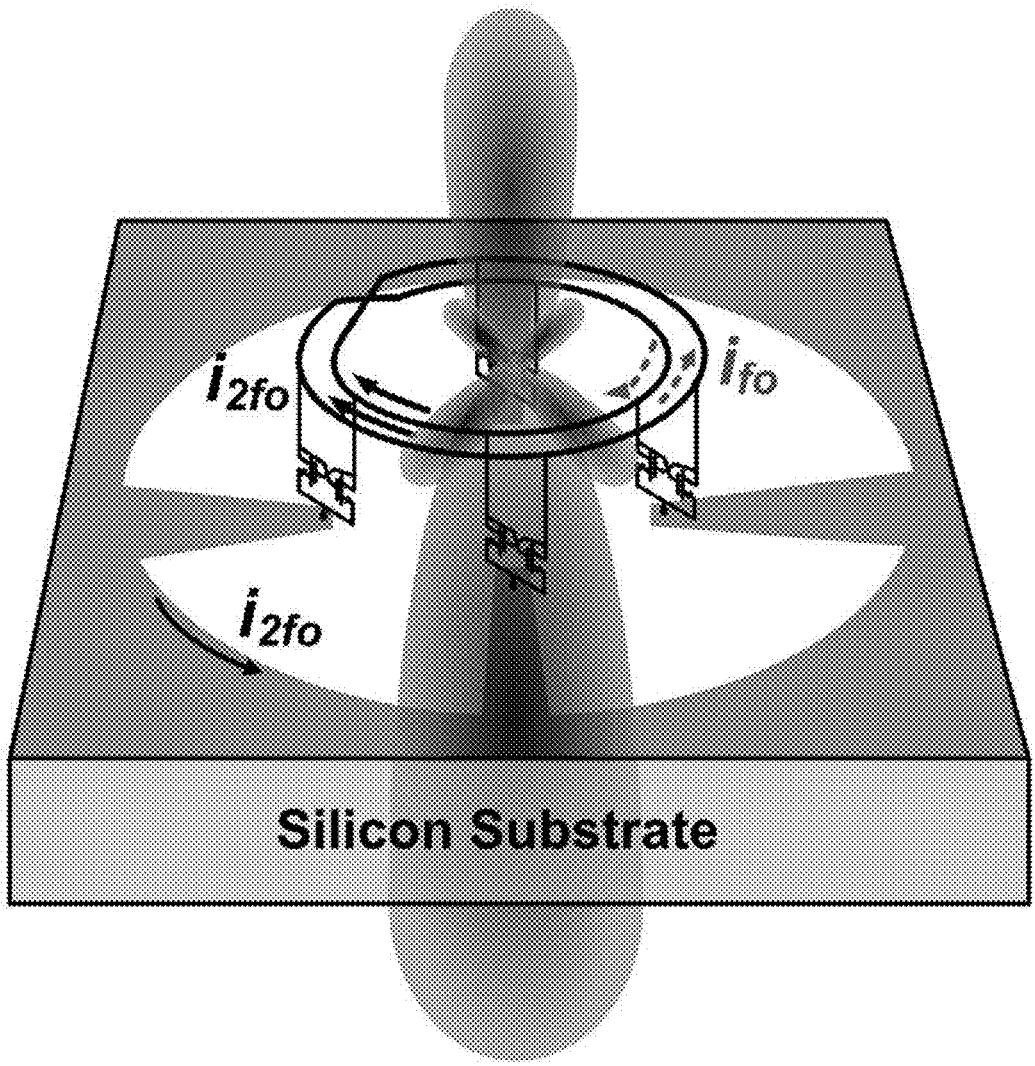
FIG. 30 is an illustration showing how a single DAR simultaneously performs the functions of oscillation, harmonic generation, radiation, and filtering.
Figure 31:
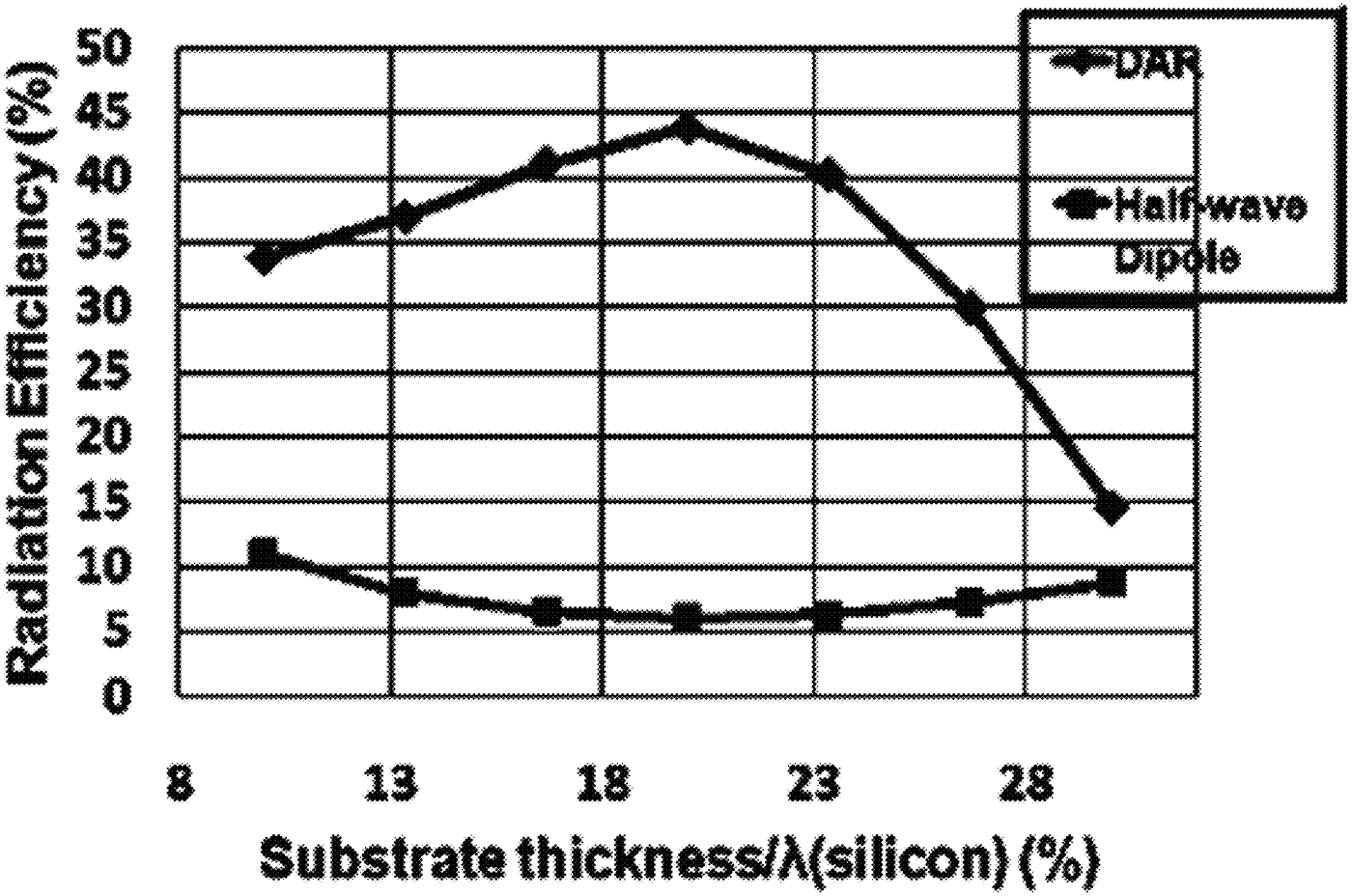
FIG. 31 shows an exemplary graph of radiation efficiency versus substrate thickness for the DAR of FIG. 30.

FIG. 27 shows how the common currents at $2f_0$ use the ground plane as the return path. The current is phase rotated at 90° to facilitate radiation. FIG. 28 shows one exemplary radiation pattern from a DAR silicon substrate at a frequency of $2f_0$. FIG. 29 shows the cross coupling between the strips of a DAR. With the cross-coupling and as a self-oscillatory system, the phases for the differential drive at $f_0$ are derived from loop itself FIG. 30 shows how a single DAR performs the functions of oscillation, harmonic generation, radiation, and filtering. Such DARs are scalable, lending themselves to efficient power combination as multiple sources. Such DARs also have very low power loss due to substrate modes. FIG. 31 shows an exemplary graph of radiation efficiency versus substrate thickness for the DAR of FIG. 30.

DAR Arrays

Figure 32:
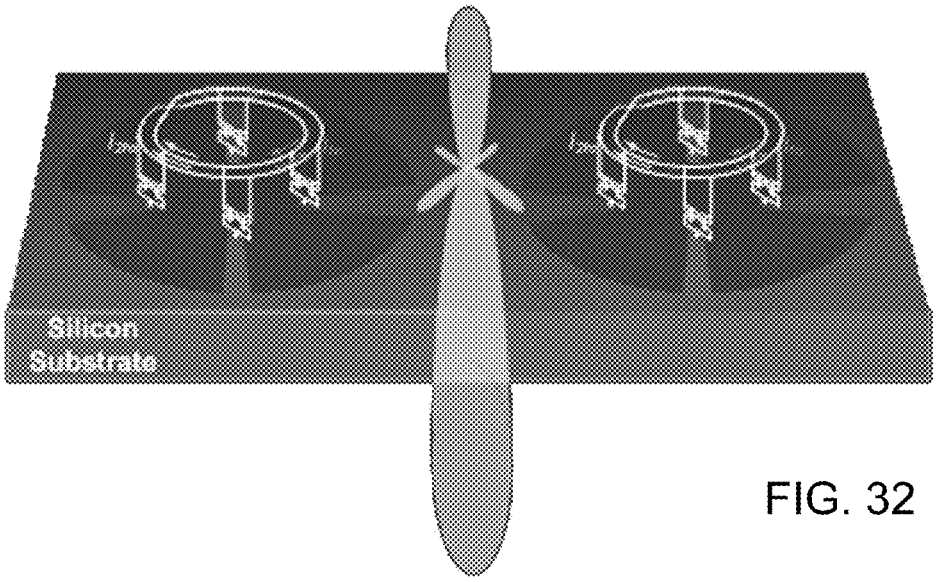
FIG. 32 shows an illustration of a 2×1 DAR array.
Figure 33:
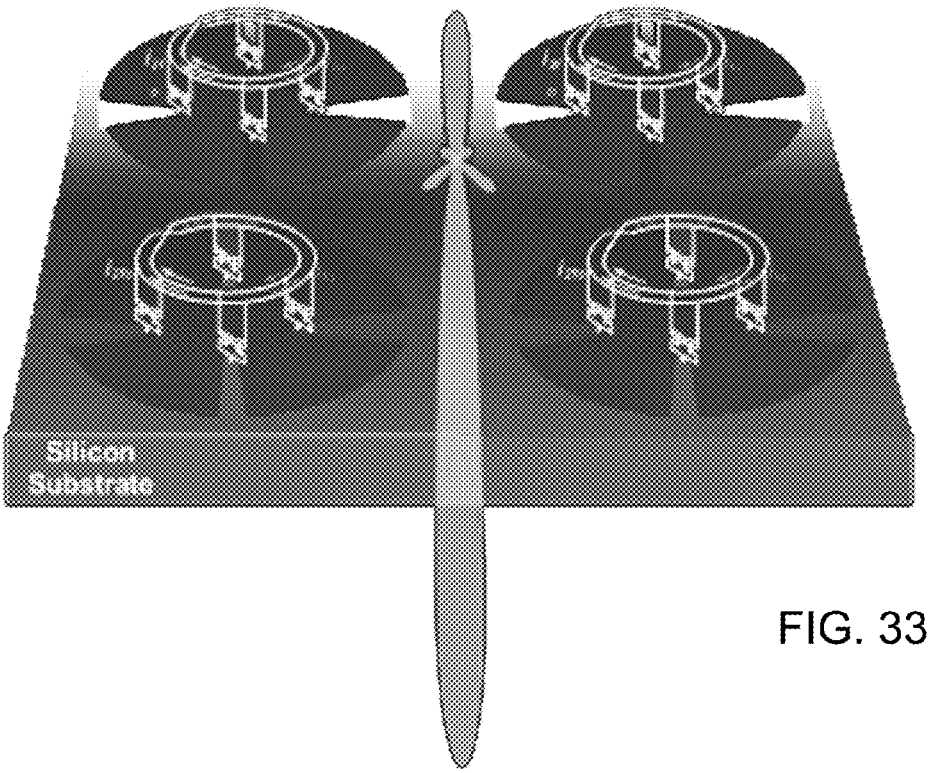
FIG. 33 shows an illustration of a 4×4 DAR array.

Now turning to a more detailed description of the operation of DAR arrays, FIG. 32 shows an illustration of an exemplary 2×1 DAR array, and FIG. 33 shows an illustration of an exemplary 4×4 DAR array. Such DAR arrays can provide almost lossless power combination. In some embodiments, the radiated power is given by 10 log (N), where N is the number of DARs in an array, and EIRP increases as 20 log (N). Radiation efficiency is improved in part due to a partial cancellation of the substrate modes.

There are at least three methods for locking the oscillation of DARs in an array. These include transmission line locking, radiative locking, and locking to a common driving oscillator. The concept of radiative, or near-field, locking is now described in more detail.

FIG. 34 shows an illustration of two uncoupled DAR free running oscillators radiating at almost the same frequencies. The contour graphs under each DAR show examples of the radiated field intensity at a given time. A loop (a secondary antenna) can be disposed in the vicinity of each DAR. Using the secondary antennas, phase and frequency information can be captured from the radiated fields from each DAR. The secondary antennas can sense the far-field and near-field DAR radiated fields.

Figure 35:
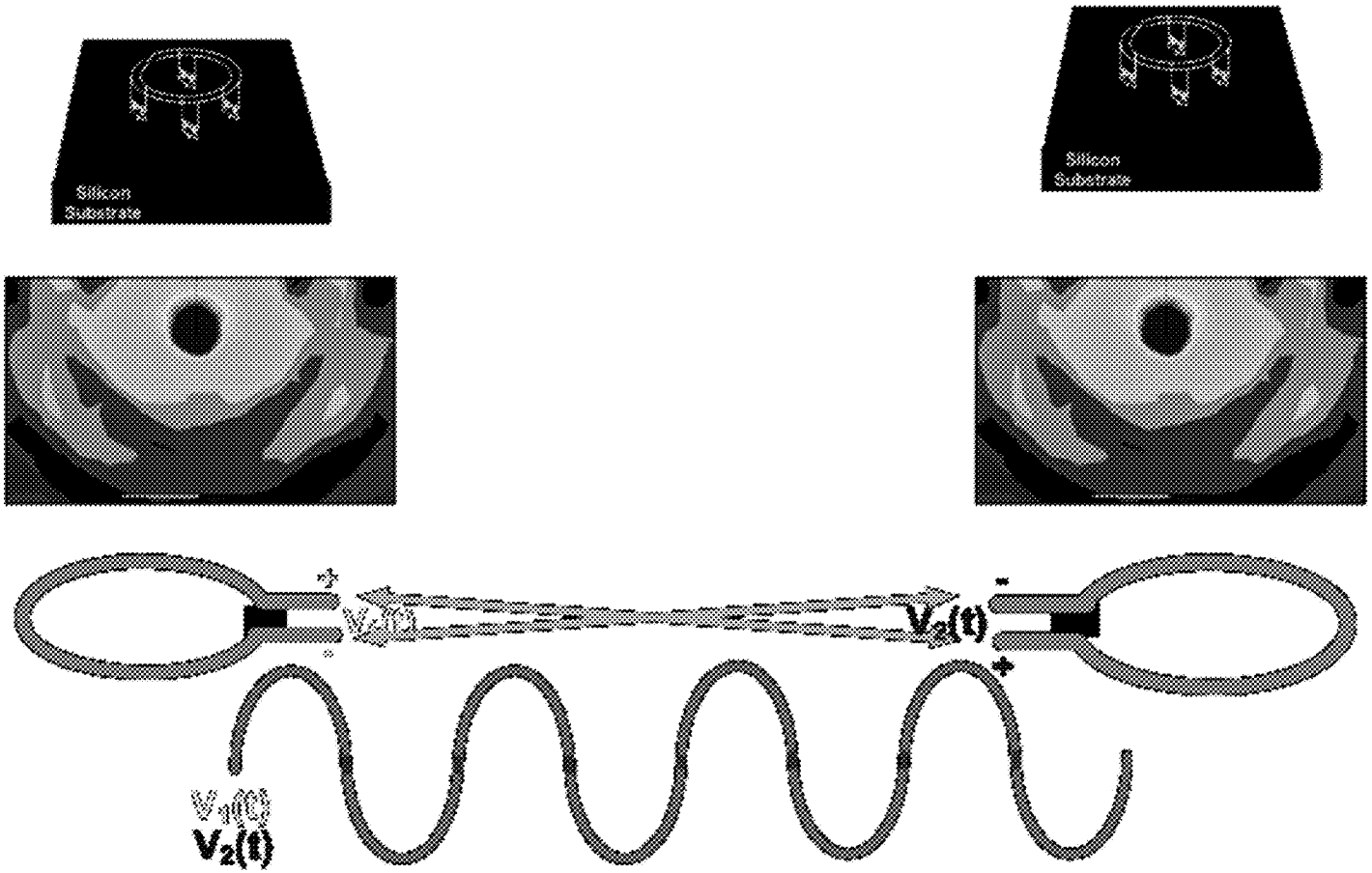
FIG. 35 shows a conceptual illustration of a connection between two DAR secondary loop antennas.

FIG. 35 shows a conceptual illustration of a connection between two DAR secondary loop antennas. Since the sensed voltage phase and frequency is related to the phase and frequency of each corresponding oscillator, a connection between the two secondary antennas allows for an independent optimization and placement of power generating DAR array elements, while locking is performed "wirelessly" (i.e. with no direct electrical connections between each of the DARs in a DAR array).

Figure 36A:
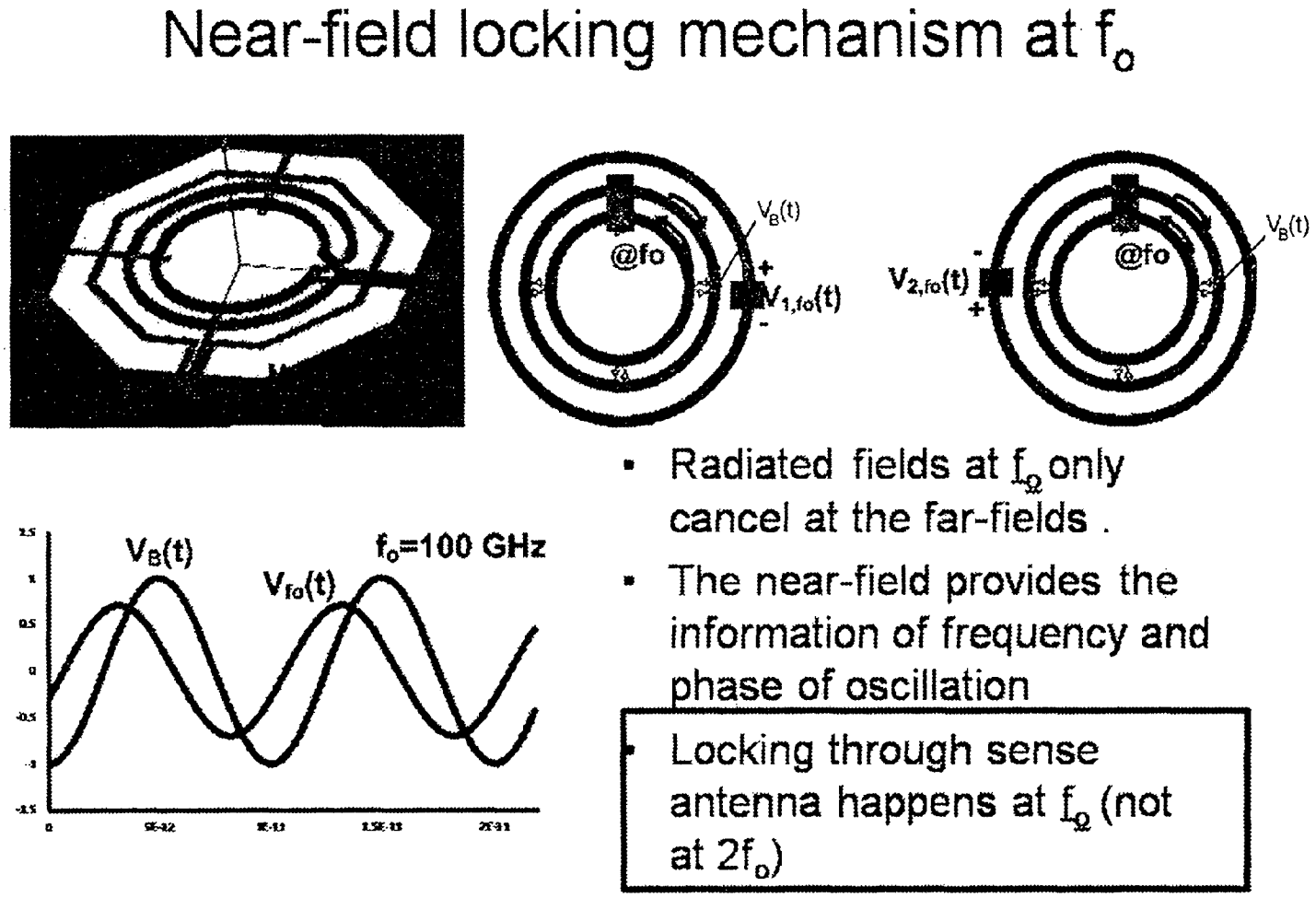
FIG. 36A shows an illustration of a near-field locking mechanism at $f_0$.
Figure 36C:
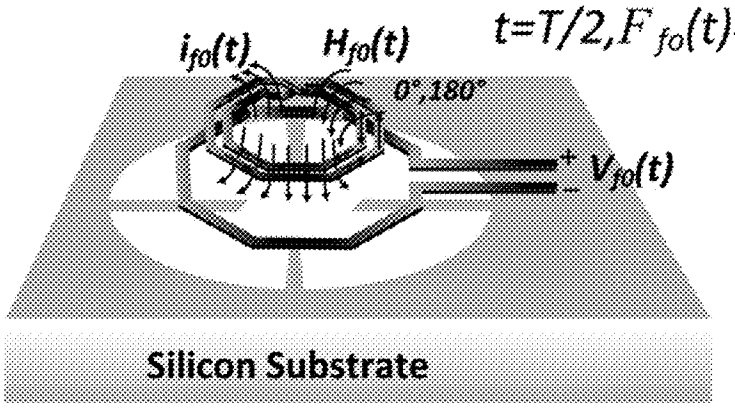
FIG. 36C shows a field line drawing that illustrates lines of magnetic flux at $f_0$ at a time of t=T/2.
Figure 36B:
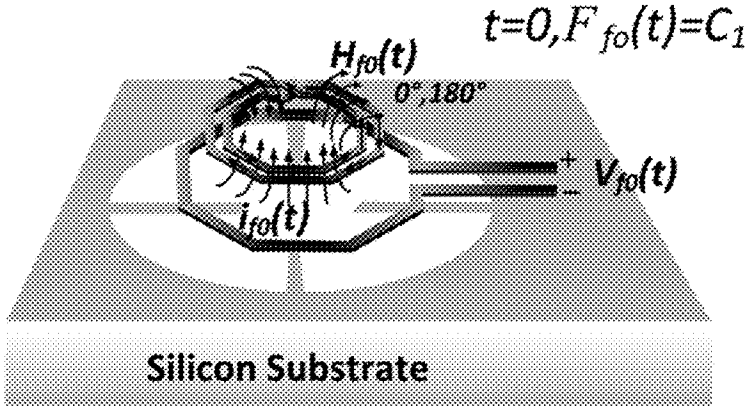
FIG. 36B shows a field line drawing that illustrates lines of magnetic flux at $f_0$ at a time of t=0.
Figure 36D:
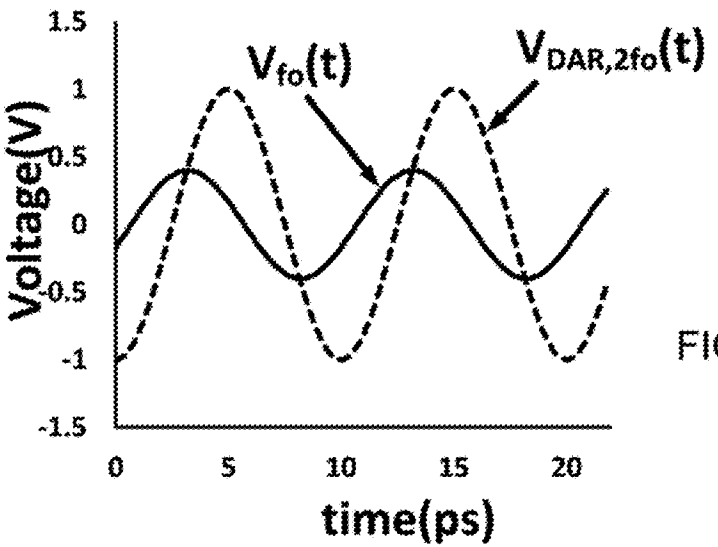
FIG. 36D shows a graph of a sense antenna voltage versus time.
Figure 36E:
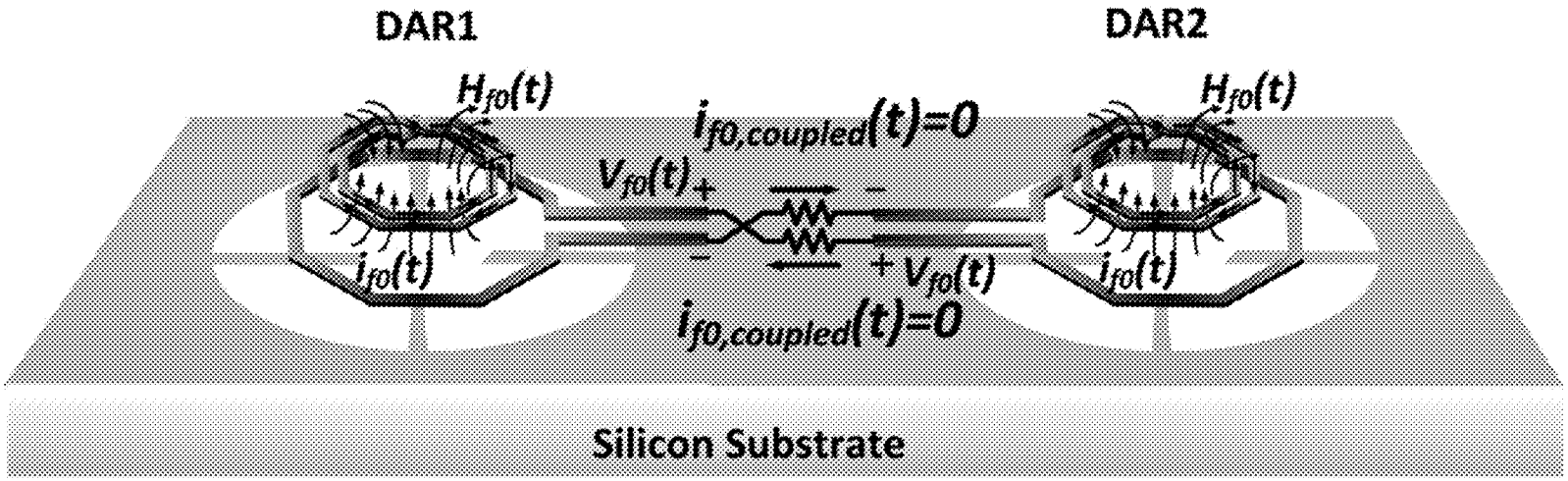
FIG. 36E shows schematic diagram with magnetic flux lines for two DAR devices of a wirelessly coupled DAR array

FIG. 36A shows an illustration of the near-field locking mechanism at $f_0$. The radiated fields at $f_0$ cancel at the far-fields. However the near-field provides the frequency and phase of oscillation and thus locking between DAR's takes place at $f_0$, and not at $2f_0$. FIG. 36B shows a field line drawing which illustrates lines of magnetic flux at $f_0$ at a time of t=0. While the exemplary sense antenna is shown in FIG. 36B is shown below the plane of the DAR conductors, a sense antenna can be disposed in any suitable position, including below the DAR, in the plane of each DAR device, or above the plane of each DAR device. FIG. 36C shows a field line drawing which illustrates lines of magnetic flux at $f_0$ at a time of t=T/2. FIG. 36D shows a graph of the sense antenna voltage versus time. FIG. 36E shows schematic diagram with magnetic flux lines for two DAR devices of a wirelessly coupled DAR array where locking at $f_0$ is achieved by coupling two sense antennas via resistive network (e.g., the resistive network of FIG. 9E).

Figure 37A:
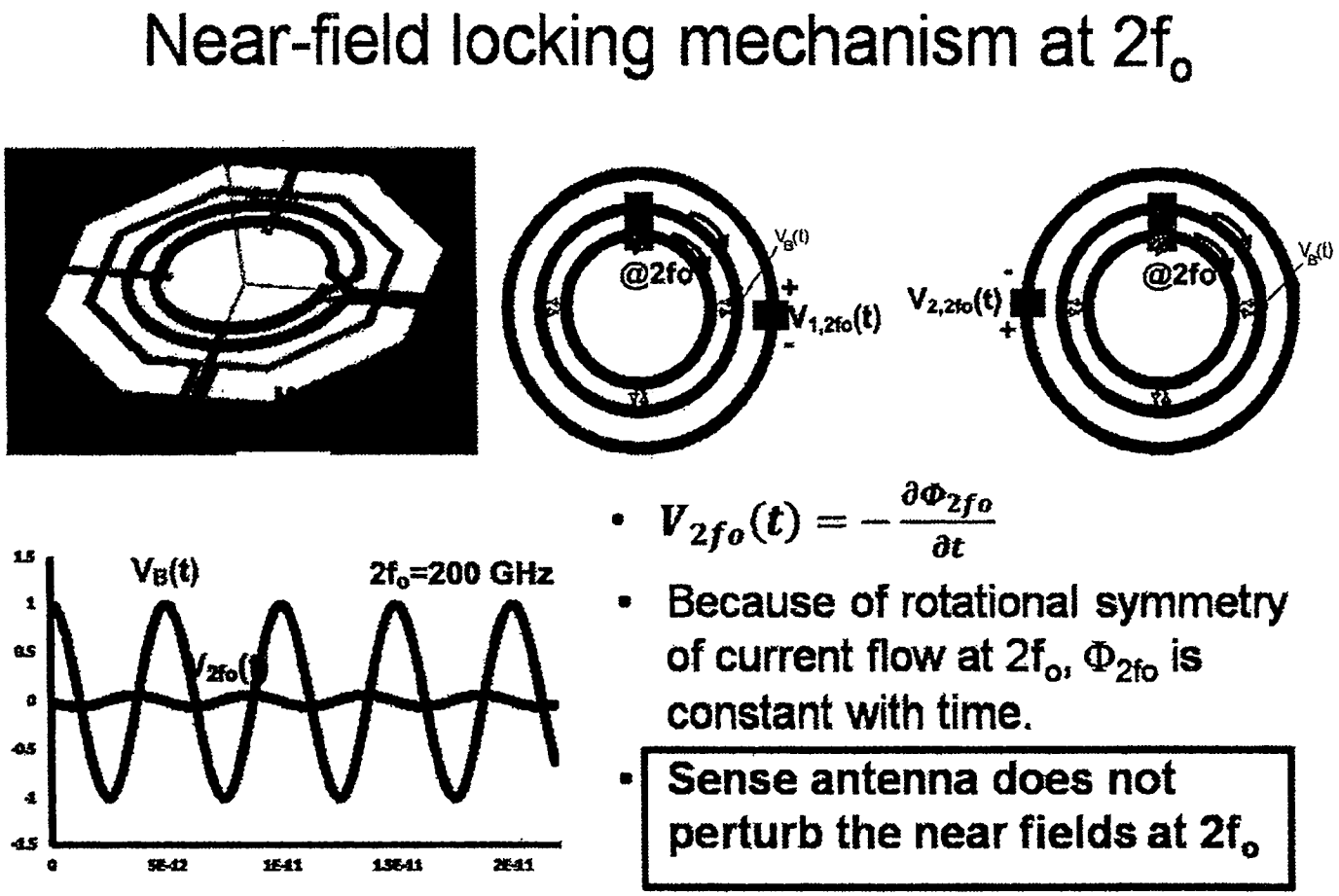
FIG. 37A shows an illustration of one exemplary near-field locking mechanism at $2f_0$.
Figure 37B:
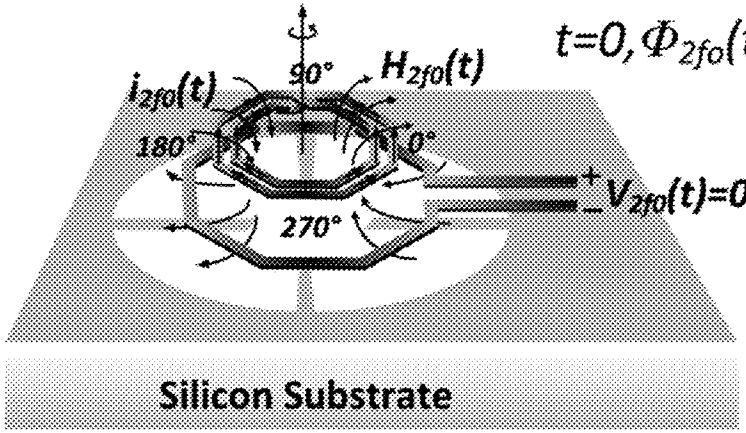
FIG. 37B shows a field line drawing which illustrates lines of magnetic flux at $2f_0$ at a time of t=0.
Figure 37C:
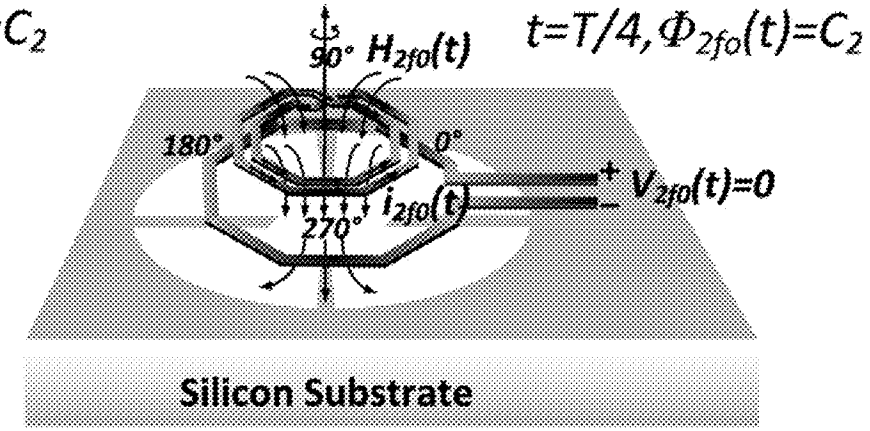
FIG. 37C shows a field line drawing which illustrates lines of magnetic flux at $f_0$ at a time of t=T/4.
Figure 37D:
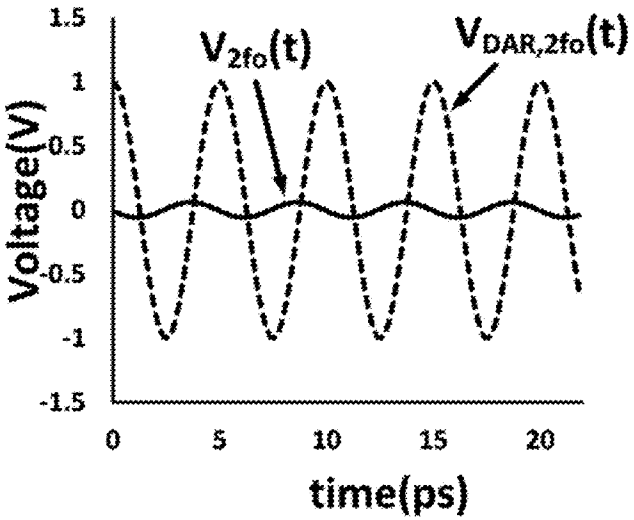
FIG. 37D shows a graph of a sense antenna voltage versus time at $2f_0$.

FIG. 37A shows an illustration of the near-field locking mechanism at $2f_0$. As can be seen in FIG. 37A, the secondary sense antenna does not perturb the near fields at $2f_0$. FIG. 37B shows a field line drawing which illustrates lines of magnetic flux at $2f_0$ at a time of t=0. FIG. 37C shows a field line drawing which illustrates lines of magnetic flux at $f_0$ at a time of t=T/4. FIG. 37D shows a graph of the sense antenna voltage versus time.

Beam-Forming

Figure 38:
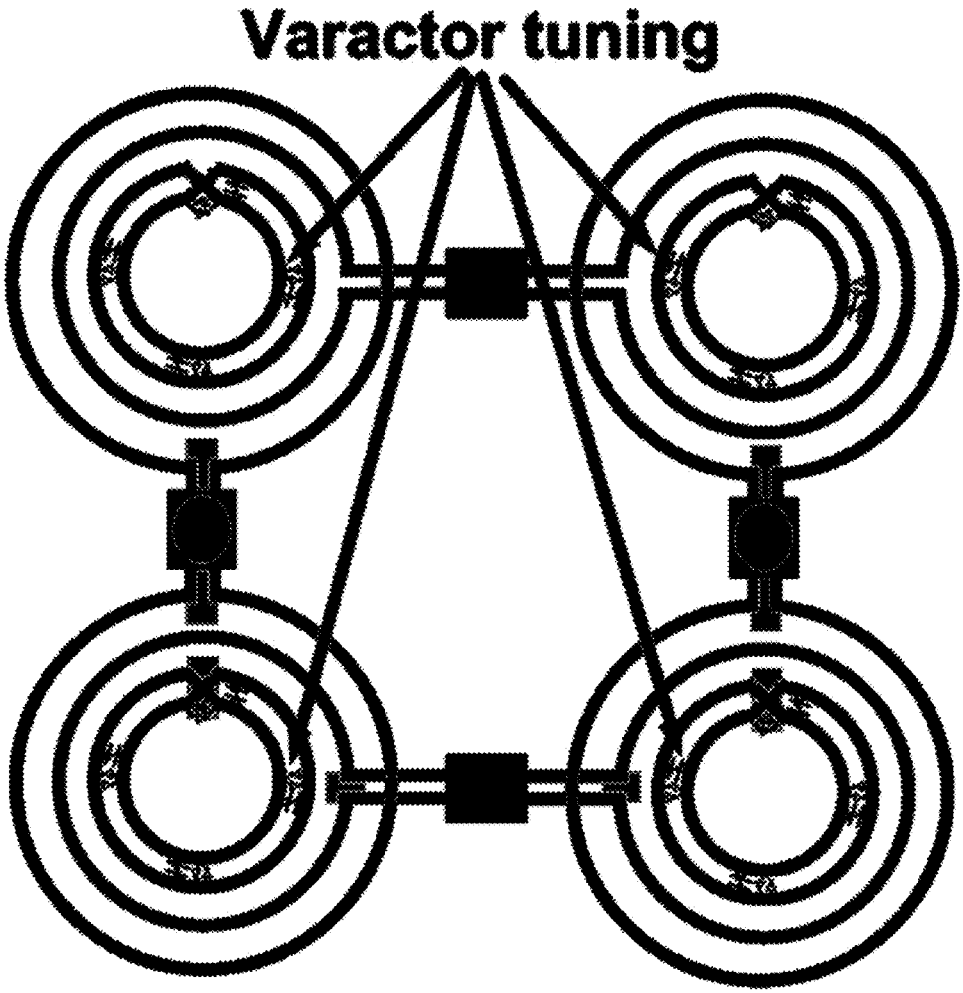
FIG. 38 shows an illustration of one exemplary 4×4 DAR array with beam-forming.
Figure 39B:
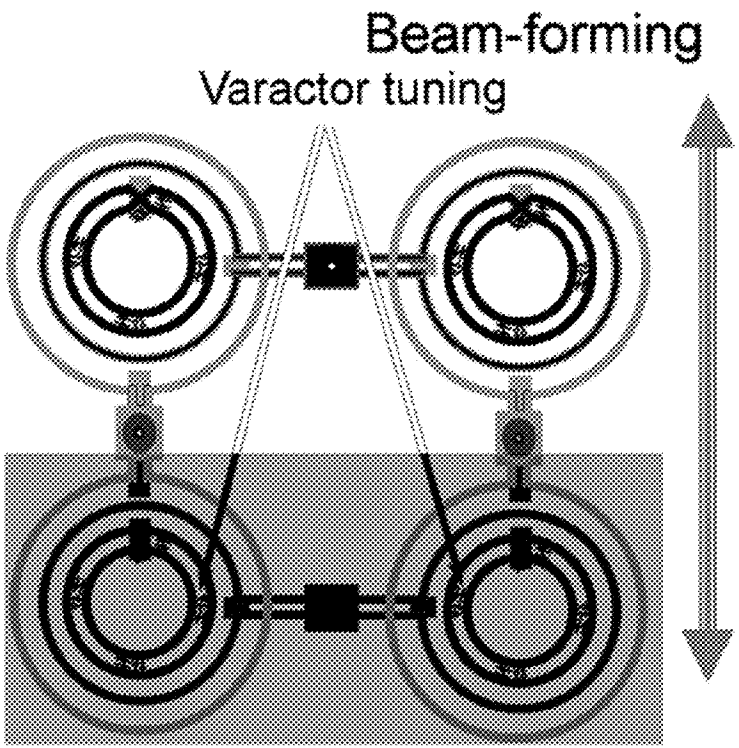
FIG. 39B shows an illustration of the beam-forming DAR of FIG. 38 showing how varactor tuning of the two DAR devices on the lower side can be used to form a beam in the $\Phi=90°$ direction.
Figure 39A:
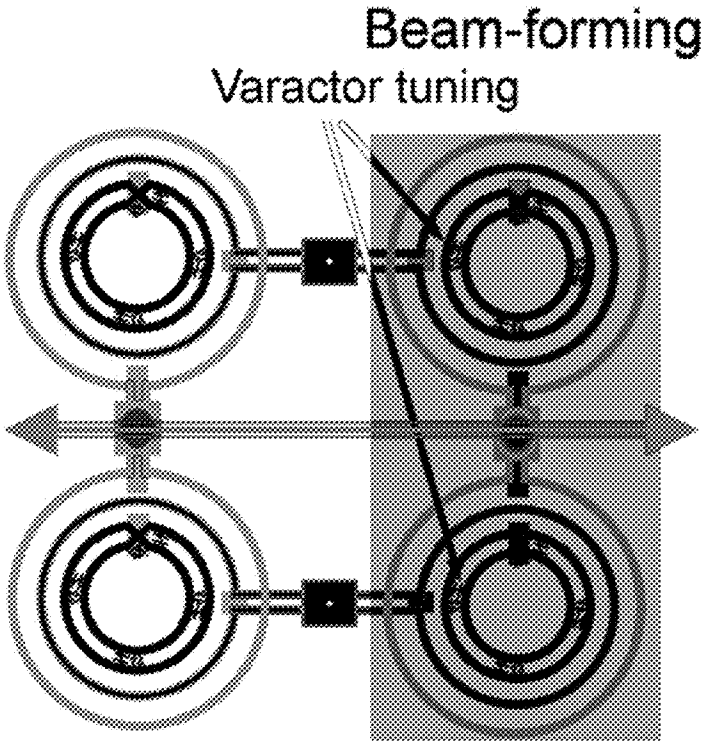
FIG. 39A shows an illustration of the beam-forming DAR of FIG. 38 showing how varactor tuning of the two DAR devices on the right side can be used to form a beam in the $\Phi=0°$ direction.

Turning now to DAR array beam-forming, FIG. 38 shows an illustration of one exemplary 4×4 DAR array with beam-forming. Beam-forming is accomplished by varactor tuning elements that allow phase control at each DAR. In this exemplary embodiment, near-field locking forces frequency synchronization causing additional phase shifts which can also be used in beam-forming. FIG. 39A shows an illustration of the beam-forming DAR of FIG. 38 showing how varactor tuning of the two DAR devices on the right side can be used to form a beam in the Φ=0° direction. FIG. 39B shows an illustration of the beam-forming DAR of FIG. 38 showing how varactor tuning of the two DAR devices on the lower side can be used to form a beam in the Φ=90° direction.

Polarization

A DAR device as described hereinabove typically radiates circularly polarized waves. The circular polarization is caused by the travelling wave nature of DAR harmonic radiation. The harmonic radiation can be either right-hand or left-hand circularly polarized waves, typically depending on initial boundary conditions at DAR device start-up. It is contemplated that DAR devices can be configured to cause either right-hand or left-hand circularly polarized waves.

Front Side and Rear Side Radiation Patterns

A DAR device or DAR array can be configured to radiate predominantly from either a "front" side or "rear" side of a DAR integrated structures. For example, where one side of a device or array is configured for good thermal transfer properties for thermal cooling, the device or array can be configured for optimal EM wave radiation from the other side of the device or array. In some embodiments, a conductive surface, such as a metallic surface can be used as a reflector to direct the EM wave radiation from either a back or front surface of an integrated DAR device or array.

Active Device at the Crossover

In some embodiments, the location of an active element at the "crossover" connections 103 across the gap (FIG. 1D) can prevent a standing wave and ensure the desired travelling wave mode of operation.

Substrate Coupling and Suppression of DAR False States

Figure 40:
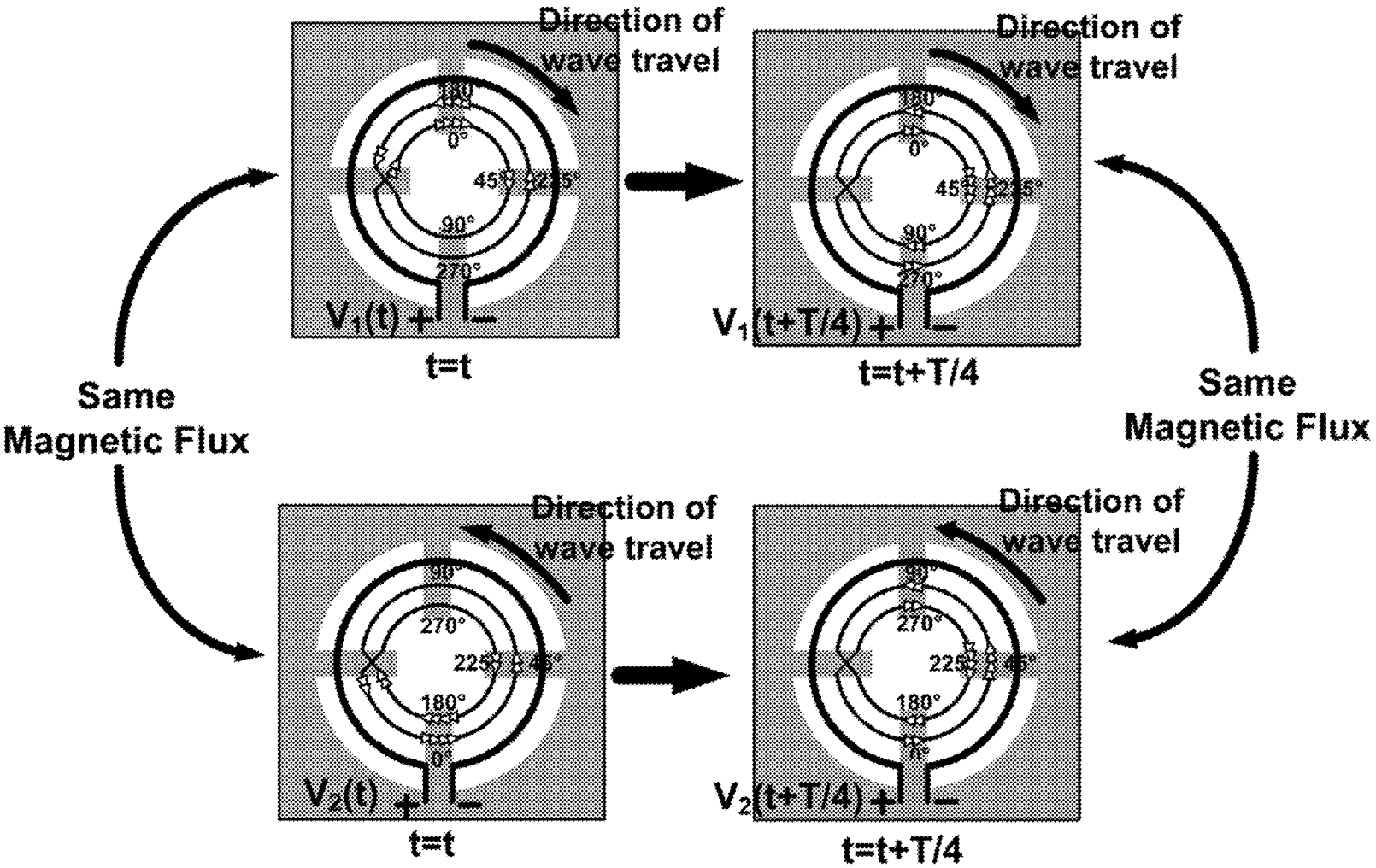
FIG. 40 shows a circuit diagram of a DAR device annotated with conductor currents illustrating the concept of DAR false locking.

In some coupling methods, such as near-field sensing using sensing antennas, there can theoretically be DAR false states, which could detract from locking all DAR devices of a DAR array. FIG. 40 shows a circuit diagram of a DAR device annotated with conductor currents which illustrates the concept of DAR false locking. However, in practice there are other modes of coupling (e.g., coupling modes in a silicon substrate), which prevent false coupling. Therefore in practice, such DAR false states generally do not occur.

Higher Harmonic Generation in a DAR Array

The DARs of a DAR array can be configured to cause the generation of harmonics higher than the second harmonic.

The following is an example how to radiate a fourth harmonic. As described herein above, the first harmonic is cancelled within each DAR. In many of the embodiments described hereinabove, the second harmonic was the desired harmonic and each DAR of a DAR array radiates at the second harmonic. However, to generate a fourth harmonic, the second harmonic should be cancelled and not radiated. To cancel the second harmonic, some DARs can be made to operate 180 degrees out phase at the second harmonic, leaving the fourth harmonic signal to be radiated. Any desired successive even harmonic (e.g., the $6^{th}$ or $8^{th}$ harmonic) can be generated by a DAR array by similar cancellation techniques.

Definitions

Recording the results from an operation or data acquisition, such as for example, recording results at a particular frequency or wavelength, is understood to mean and is defined herein as writing output data in a non-transitory manner to a storage element, to a machine-readable storage medium, or to a storage device. Non-transitory machine-readable storage media that can be used in the invention include electronic, magnetic and/or optical storage media, such as magnetic floppy disks and hard disks; a DVD drive, a CD drive that in some embodiments can employ DVD disks, any of CD-ROM disks (i.e., read-only optical storage disks), CD-R disks (i.e., write-once, read-many optical storage disks), and CD-RW disks (i.e., rewriteable optical storage disks); and electronic storage media, such as RAM, ROM, EPROM, Compact Flash cards, PCMCIA cards, or alternatively SD or SDIO memory; and the electronic components (e.g., floppy disk drive, DVD drive, CD/CD-R/CD-RW drive, or Compact Flash/PCMCIA/SD adapter) that accommodate and read from and/or write to the storage media. Unless otherwise explicitly recited, any reference herein to "record" or "recording" is understood to refer to a non-transitory record or a non-transitory recording.

As is known to those of skill in the machine-readable storage media arts, new media and formats for data storage are continually being devised, and any convenient, commercially available storage medium and corresponding read/write device that may become available in the future is likely to be appropriate for use, especially if it provides any of a greater storage capacity, a higher access speed, a smaller size, and a lower cost per bit of stored information. Well known older machine-readable media are also available for use under certain conditions, such as punched paper tape or cards, magnetic recording on tape or wire, optical or magnetic reading of printed characters (e.g., OCR and magnetically encoded symbols) and machine-readable symbols such as one and two dimensional bar codes. Recording image data for later use (e.g., writing an image to memory or to digital memory) can be performed to enable the use of the recorded information as output, as data for display to a user, or as data to be made available for later use. Such digital memory elements or chips can be standalone memory devices, or can be incorporated within a device of interest. "Writing output data" or "writing an image to memory" is defined herein as including writing transformed data to registers within a microcomputer.

Any of the digital functions, described herein, such as for example, setting the value of a digital to analog converter (DAC) which controls a beam forming varactor can be performed by a microcomputer. "Microcomputer" is defined herein as synonymous with microprocessor, microcontroller, and digital signal processor ("DSP"). It is understood that memory used by the microcomputer, including for example instructions for data processing coded as "firmware" can reside in memory physically inside of a microcomputer chip or in memory external to the microcomputer or in a combination of internal and external memory. Similarly, analog signals can be digitized by a standalone analog to digital converter ("ADC") or one or more ADCs or multiplexed ADC channels can reside within a microcomputer package. It is also understood that field programmable array ("FPGA") chips or application specific integrated circuits ("ASIC") chips can perform microcomputer functions, either in hardware logic, software emulation of a microcomputer, or by a combination of the two. Apparatus having any of the inventive features described herein can operate entirely on one microcomputer or can include more than one microcomputer.

General purpose programmable computers useful for controlling instrumentation, recording signals and analyzing signals or data according to the present description can be any of a personal computer (PC), a microprocessor based computer, a portable computer, or other type of processing device. The general purpose programmable computer typically comprises a central processing unit, a storage or memory unit that can record and read information and programs using machine-readable storage media, a communication terminal such as a wired communication device or a wireless communication device, an output device such as a display terminal, and an input device such as a keyboard. The display terminal can be a touch screen display, in which case it can function as both a display device and an input device. Different and/or additional input devices can be present such as a pointing device, such as a mouse or a joystick, and different or additional output devices can be present such as an enunciator, for example a speaker, a second display, or a printer. The computer can run any one of a variety of operating systems, such as for example, any one of several versions of Windows, or of MacOS, or of UNIX, or of Linux. Computational results obtained in the operation of the general purpose computer can be stored for later use, and/or can be displayed to a user. At the very least, each microprocessor-based general purpose computer has registers that store the results of each computational step within the microprocessor, which results are then commonly stored in cache memory for later use.

Many functions of electrical and electronic apparatus can be implemented in hardware (for example, hard-wired logic), in software (for example, logic encoded in a program operating on a general purpose processor), and in firmware (for example, logic encoded in a non-volatile memory that is invoked for operation on a processor as required). The present invention contemplates the substitution of one implementation of hardware, firmware and software for another implementation of the equivalent functionality using a different one of hardware, firmware and software. To the extent that an implementation can be represented mathematically by a transfer function, that is, a specified response is generated at an output terminal for a specific excitation applied to an input terminal of a "black box" exhibiting the transfer function, any implementation of the transfer function, including any combination of hardware, firmware and software implementations of portions or segments of the transfer function, is contemplated herein, so long as at least some of the implementation is performed in hardware.

Theoretical Discussion

Although the theoretical description given herein is thought to be correct, the operation of the devices described and claimed herein does not depend upon the accuracy or validity of the theoretical description. That is, later theoretical developments that may explain the observed results on a basis different from the theory presented herein will not detract from the inventions described herein.

Any patent, patent application, or publication identified in the specification is hereby incorporated by reference herein in its entirety. Any material, or portion thereof, that is said to be incorporated by reference herein, but which conflicts with existing definitions, statements, or other disclosure material explicitly set forth herein is only incorporated to the extent that no conflict arises between that incorporated material and the present disclosure material. In the event of a conflict, the conflict is to be resolved in favor of the present disclosure as the preferred disclosure.

While the present invention has been particularly shown and described with reference to the preferred mode as illustrated in the drawing, it will be understood by one skilled in the art that various changes in detail may be affected therein without departing from the spirit and scope of the invention as defined by the claims.

What is claimed is:

1. An integrated distributed active radiator (DAR) device, comprising:

a substrate;

a first conductor having a first conductor first end and a first conductor second end;

a second conductor having a second conductor first end and a second conductor second end;

a return path conductor defining an aperture;

said first conductor and said second conductor disposed adjacent each other and overlaying said aperture, said first conductor and said second conductor each defining curves which close on themselves to within a distance of a gap, said first conductor first end electrically coupled to said second conductor second end across said gap, and said second conductor first end electrically coupled to said first conductor second end across said gap;

at least one terminal configured to receive a source of DC power; and at least one active element electrically connected between said first conductor and said second conductor, said at least one active element configured to produce a self-oscillation current at a frequency $f_0$, said self-oscillation current having a first direction in said first conductor and having a second direction in said second conductor, said second direction opposite to said first direction in said first conductor;

said at least one active element configured to generate a harmonic current having a harmonic frequency, said harmonic current having a same direction in said first conductor and in said second conductor and a second harmonic return current in said return path conductor, said integrated distributed active radiator device configured to efficiently radiate electromagnetic energy from said aperture at said harmonic frequency and configured to substantially inhibit the radiation of electromagnetic energy at said frequency $f_0$.

2. The DAR device of claim 1, wherein said harmonic frequency is an even harmonic of $f_0$.

3. The DAR device of claim 1, wherein said harmonic frequency comprises a frequency in the THz band.

4. The DAR device of claim 1, further comprising 2N additional loops before said first conductor first end is electrically coupled to said second conductor second end across said gap, and said second conductor first end electrically is coupled to said first conductor second end across said gap, where N is an integer ≥1.

5. The DAR device of claim 1, wherein either of said at least one first conductor and at least one second conductor comprises an inductor.

6. The DAR device of claim 1 wherein said DAR is configured to radiate from a selected one of a front side and a rear side of said DAR.

7. The DAR device of claim 1, wherein a current of said return path conductor for a radiating signal at said harmonic frequency has a different phase with respect to a phase of said same direction current in both of said first and second conductors at said harmonic frequency, said phase difference between said same direction current and said return current in the range −180 degrees <said phase difference <180 degrees.

8. The DAR device of claim 1, wherein said first and second conductors comprise substantially concentric circles, one circle within the other.

9. The DAR device of claim 1, wherein said first and second conductors comprise substantially concentric polygons, one polygon within the other.

10. The DAR device of claim 1, wherein said at least one active element comprises a gain element.

11. The DAR device of claim 10, wherein said gain element comprises a selected one of a single ended FET, a cross coupled FET pair, and two complimentary FET pairs.

12. The DAR device of claim 1, further comprising a direct biasing.

13. The DAR device of claim 1, further comprising a transmission line biasing, wherein said transmission line biasing is configured to provide an open circuit under a phase locked condition at both $f_0$and a desired even harmonic of $f_0$.

14. The DAR device of claim 1, wherein said DAR device is fabricated in a CMOS technology.

15. The DAR device of claim 1, further comprising one or more additional DAR devices configured as a DAR array.

16. The DAR device of claim 15, wherein said DAR array is configured for beam-forming.

17. The DAR device of claim 15, wherein said DAR array further comprises at least one varactor tuning element configured to adjust at least a selected one of beam shape and beam direction of said radiation of electromagnetic energy at said harmonic frequency.

18. The DAR device of claim 15, wherein said DAR array comprises one or more transmission lines electrically coupled between two or more DAR devices, said transmission line configured to frequency lock each of said two or more DAR devices.

19. The DAR device of claim 18, further including at least one mutual coupling block electrically disposed between at least two of said DAR devices.

20. The DAR device of claim 15, wherein said DAR array comprises two or more DAR devices configured to frequency lock each of said DAR devices by mutual electromagnetic coupling.

21. The DAR device of claim 20, wherein at least two of said DAR devices further comprise a sense antenna.

22. The DAR device of claim 15, wherein two or more of said DAR devices are frequency locked to each other by a common frequency source derived from a common reference oscillator.

23. The DAR device of claim 22, further comprising an adjustable phase shift element disposed between said common frequency source and each of said DAR devices, said adjustable phase shift elements configured for beam-forming.

* * * * *